US012613074B1

(12) United States Patent
Miller

(10) Patent No.: US 12,613,074 B1
(45) Date of Patent: Apr. 28, 2026

(54) ARCHERY BOW WITH AXIAL TENSILE SPRINGS AND SLOPE-BASED CAMS

(71) Applicant: Russell Bruce Miller, Richland, WA (US)

(72) Inventor: Russell Bruce Miller, Richland, WA (US)

( * ) Notice: Subject to any disclaimer, the term of this patent is extended or adjusted under 35 U.S.C. 154(b) by 35 days.

(21) Appl. No.: 19/284,346

(22) Filed: Jul. 29, 2025

(51) Int. Cl.
*F41B 5/00* (2006.01)
*F41B 5/10* (2006.01)

(52) U.S. Cl.
CPC ..... *F41B 5/0094* (2013.01); *F41B 5/10* (2013.01); *F41B 5/105* (2013.01)

(58) Field of Classification Search
CPC .. F41B 5/00; F41B 5/0094; F41B 5/10; F41B 5/105; F41B 5/1403; Y10S 124/90
USPC ..... 124/16, 23.1, 25.6, 86, 88, 900
See application file for complete search history.

(56) References Cited

U.S. PATENT DOCUMENTS 428,912 A * 5/1890 Holmes ..... F41B 5/1411 124/23.1
2,116,650 A * 5/1938 Zima ..... F41B 5/0073 124/23.1
2,307,021 A * 1/1943 Duvall ..... F41B 5/0094 124/22
2,714,377 A * 8/1955 Mulkey ..... F41B 5/0094 124/24.1
3,486,495 A * 12/1969 Allen ..... F41B 5/10 124/25.6
3,518,980 A * 7/1970 Hamm ..... F41B 5/0073 124/24.1
3,595,213 A * 7/1971 Storer ..... F41B 5/0094 124/22
3,625,193 A * 12/1971 Palma ..... F41B 5/0073 124/23.1
3,744,473 A * 7/1973 Nishioka ..... F41B 5/0094 124/25.6
3,802,410 A * 4/1974 Palma ..... F41B 5/0073 124/88
3,826,239 A * 7/1974 Palma ..... F41B 5/0052 124/88
3,874,359 A * 4/1975 Cesin ..... F41B 5/12 124/16
3,913,556 A * 10/1975 Palma ..... F41B 5/0031 124/23.1
3,989,026 A * 11/1976 Nishioka ..... F41B 5/10 124/16

(Continued)

*Primary Examiner* — Alexander R Niconovich

(57) ABSTRACT

An archery bow includes a riser, a cam module rotatably mounted to a fixed pivot supported by the riser, and an energy storage system comprising at least one axial tensile spring operatively coupled to the cam module via a multi-roller shuttle assembly. The cam module includes a cam track with a variable slope profile that governs the draw force curve during rotation. The multi-roller shuttle assembly engages both the cam track and a guide track surface to constrain the shuttle to a defined path, thereby elongating the axial tensile spring as the bow is drawn. The cam module includes parallel string grooves for engaging a single bowstring without synchronization cables. The axial tensile spring may be folded around a turning element to form two tensile legs and housed within the riser. This configuration enables compact, lightweight bows with customizable draw characteristics and reduced lateral torque.

20 Claims, 40 Drawing Sheets

(56) References Cited

U.S. PATENT DOCUMENTS 4,041,927 A * 8/1977 Van House ..... F41B 5/0094 124/16
4,201,182 A * 5/1980 Butler ..... F41B 5/0094 124/88
4,227,509 A * 10/1980 Jones ..... F41B 5/0094 124/900
4,334,678 A * 6/1982 Doyel ..... A63B 21/4035 482/128
4,338,909 A * 7/1982 Plummer ..... F41B 5/0094 124/16
4,457,288 A * 7/1984 Ricord ..... F41B 5/10 124/900
4,458,657 A * 7/1984 Stockmar ..... F41B 5/105 124/17
4,471,747 A * 9/1984 Nishioka ..... F41B 5/105 124/88
4,530,342 A * 7/1985 Simo ..... F41B 5/10 124/88
4,646,708 A * 3/1987 Imes ..... F41B 5/10 124/23.1
4,651,707 A * 3/1987 Bozek ..... F41B 5/0094 124/20.1
4,662,344 A * 5/1987 Mitchell ..... F41B 5/0094 124/24.1
4,672,943 A * 6/1987 Bozek ..... F41B 5/10 124/900
4,739,744 A * 4/1988 Numney ..... F41B 5/105 124/90
4,756,295 A * 7/1988 Guzzetta ..... F41B 5/0094 124/44.5
4,803,970 A * 2/1989 Mattheck ..... F41B 5/0094 124/16
4,858,588 A * 8/1989 Bozek ..... F41B 5/10 473/578
4,903,677 A * 2/1990 Colley ..... F41B 5/105 124/23.1
4,971,020 A * 11/1990 Soderstrom ..... F41B 5/105 124/900
4,989,577 A * 2/1991 Bixby ..... F41B 5/0031 124/900
5,054,463 A * 10/1991 Colley ..... F41B 5/105 124/900
5,099,819 A * 3/1992 Simonds ..... F41B 5/10 124/88
5,150,699 A * 9/1992 Boissevain ..... F41B 5/0094 124/900
5,205,269 A * 4/1993 Guzzetta ..... F41B 5/0094 124/23.1
5,353,777 A * 10/1994 Fincher ..... F41B 5/0094 124/16
5,373,831 A * 12/1994 Cushman ..... F41B 5/10 124/88
5,503,135 A * 4/1996 Bunk ..... F41B 5/10 124/16
5,638,804 A * 6/1997 Remick ..... F41B 5/10 124/900
5,722,385 A * 3/1998 Bunk ..... F41B 5/10 124/25.6
5,950,609 A * 9/1999 Thielen ..... F41B 5/10 124/25.6
5,996,566 A * 12/1999 Malan ..... F41B 5/0031 124/23.1
6,055,974 A * 5/2000 Dieziger ..... F41B 5/0094 124/23.1
6,371,098 B1 * 4/2002 Winther ..... F41B 5/10 124/44.5
6,629,522 B2 * 10/2003 Andrews ..... F41B 5/10 124/900
6,698,413 B1 * 3/2004 Ecklund ..... F41B 5/105 124/23.1
6,994,079 B1 * 2/2006 Darlington ..... F41B 5/10 124/900
7,143,757 B1 * 12/2006 Cooper ..... F41B 5/10 124/900
7,201,161 B1 * 4/2007 York ..... F41B 5/0094 124/16
7,673,626 B1 * 3/2010 Hennings ..... F41B 5/14 124/900
7,721,721 B1 * 5/2010 Kronengold ..... F41B 5/10 124/90
8,136,514 B2 * 3/2012 Howard ..... F41B 5/10 124/16
8,220,446 B2 * 7/2012 Batdorf ..... F41B 5/10 124/25.6
8,522,763 B2 * 9/2013 Nebergall ..... F41B 5/10 124/25.6
8,789,519 B2 * 7/2014 Nebergall ..... F41B 5/10 124/25.6
8,789,520 B2 * 7/2014 Nebergall ..... F41B 5/10 124/25.6
9,273,921 B2 * 3/2016 Koch ..... F41B 5/10
9,423,201 B2 * 8/2016 Miller ..... F41B 5/1403
9,810,503 B2 * 11/2017 Serviss ..... F41B 5/1426
9,958,231 B2 * 5/2018 McPherson ..... F41B 5/1469
10,254,072 B2 * 4/2019 Danielsson ..... F41B 5/10
10,267,589 B1 * 4/2019 Snook ..... F41B 5/0094
10,641,577 B1 * 5/2020 Archer ..... F41B 5/1469
10,746,496 B2 * 8/2020 Nishihira ..... F41B 5/105
11,156,428 B1 * 10/2021 Nishihira ..... F41B 5/105
11,255,627 B1 * 2/2022 Nishihira ..... F41B 5/105
11,320,230 B2 * 5/2022 Thalberg ..... F41B 5/12
11,525,650 B1 * 12/2022 Nebergall ..... F41B 5/0094
11,592,071 B2 * 2/2023 Hansen ..... F41B 5/123
11,828,564 B2 * 11/2023 Moriyasu ..... F41B 5/10
2013/0074819 A1 * 3/2013 McPherson ..... F41B 5/105 124/25.6
2015/0362281 A1 * 12/2015 Derus ..... F41B 5/1403 124/88
2017/0115088 A1 * 4/2017 Grace ..... F41B 5/105
2019/0293381 A1 * 9/2019 Peacemaker ..... F41B 5/1469
2022/0018626 A1 * 1/2022 Nishihira ..... F41B 5/105
2022/0221244 A1 * 7/2022 Moretti ..... F41B 5/123
2025/0093124 A1 * 3/2025 Langley ..... F41B 5/10

* cited by examiner

ARCHERY BOW WITH AXIAL TENSILE SPRINGS AND SLOPE-BASED CAMS

CROSS-REFERENCE TO RELATED APPLICATIONS

This application claims the benefit of U.S. Provisional Application No. 63/679,438, filed on Aug. 5, 2024, which is incorporated herein by reference in its entirety.

BACKGROUND

Modern compound bows have achieved impressive levels of energy efficiency, returning a high proportion of input energy to the arrow and minimizing losses due to moving mass and string dynamics. However, despite these advances, current designs are fundamentally limited in the amount of input energy that can be delivered to the bow during a typical draw. This limitation arises from the shape of the draw force curve, which represents the force applied to the bowstring over the distance drawn.

As shown in FIG. 1, Panel I, the solid curves A represent typical draw force curves of modern compound bows at 2 different draw lengths: a nominal full draw length of approximately 30 inches (30A) and a shorter draw length of approximately 25 inches (25A). In both cases, the draw force rises gradually after the brace height (point 1), reaching peak draw force at point 2, and then decreasing gradually to the let-off region (points 3 and 4). Importantly, the average draw force over the draw distance-corresponding to the area under the curve—is significantly lower than the peak force, particularly at shorter draw lengths. This results in "missing" input energy that cannot contribute to arrow speed.

The dashed curves B in Panel I represent idealized draw force curves that rise more quickly, maintain higher force throughout most of the draw, and then sharply transition into let-off at the end of the draw. Achieving such a curve would increase the input energy, potentially improving arrow speed.

These limitations are rooted in the mechanical properties of the cam systems currently used in compound bows. As illustrated schematically in FIG. 1, Panel II, existing cam designs rely on the bowstring and cables winding around convex cam surfaces as the bow is drawn. The initial configuration of a typical cam includes a string groove 40, pivot point 41, and cable winding surface 42 with the cable attached at point 43. The cable end 44 is attached to an energy storage mechanism, typically the opposite limb. As the bow is drawn, the cam rotates approximately 90°, moving the cable attachment point to position 46 and raising the cable end 47. The solid lines in Panel II represent the starting state, and the dashed lines represent the rotated state. This quarter-turn of cam rotation produces the full transition from high leverage to low leverage, but it necessarily spreads this transition over a substantial portion of the draw distance. Consequently, the draw force cannot rise as quickly or let off as sharply as desired.

FIG. 1, Panel III illustrates this constraint geometrically. It shows incremental angular displacement of a cam over 24 equal-length segments of draw distance, corresponding to a typical 24-inch draw (with a 30-inch draw length and 6-inch brace height). Wedge 50 shows the minimal cam rotation achieved in the first inch of draw, demonstrating how little leverage change occurs at the beginning of the draw. Even at the midpoint of the draw (the first 12 wedges accumulated), the cam has rotated only about 90°, meaning that half of the draw distance is required to effect a full leverage change. At the end of the draw, wedge 51 shows the cam turning more quickly per unit draw distance, but by this point the opportunity to raise input energy has already passed. Thus, the geometry of current cam systems inherently limits the achievable draw force curve.

Conventional compound bows rely on string and cable windings over convex cam surfaces more complex than those shown here to control the draw force curve (at minimum, usually both the string and cable grooves will be noncircular, and the axle not centered). As explained in connection with FIG. 1, however, this results in inherently gradual changes in force ratio, limiting the ability to produce desirable sharp transitions in the curve.

FIG. 2 illustrates, in schematic form, the principle underlying the present invention's cam system. In this simplified model, a cam surface 60 is constrained to slide horizontally while a roller 62, connected to a resisting load 64, is constrained to move vertically along dashed line 63. The force required to slide the cam surface horizontally is directly proportional to the slope of the cam surface at the point of contact with the roller.

In Panel I, the roller 62 contacts the steepest region of the cam surface at point 65, requiring the greatest horizontal force 70 to move the cam and raise the load. As the cam continues to move and the roller transitions to a gentler slope at point 66 in Panel II, the required force 71 decreases sharply. Similarly, in Panel III, the roller contacts a still gentler slope at point 68, and the required force 72 further decreases.

This illustrates how shaping the cam surface to incorporate steep-to-gentle slope transitions enables precise control over the force required to continue drawing the bow. Importantly, this control can be achieved over very short displacements, unlike conventional string-winding cams that require large angular rotations to change the force ratio. Additionally, the process is reversible, allowing most of the input energy to be recovered upon release of the draw, subject to frictional losses.

This schematic also highlights the importance of precisely constraining the motion of the interacting components. In the present invention, the differential cam is implemented as a pivoting rather than sliding mechanism, with rigidly constrained components mounted to a stiff riser to maintain precise motion paths. The detailed mechanical implementation of this concept is described in connection with FIGS. 35-40, which illustrate the full operational cycle of the bow. Some prior attempts at non-traditional compound bow designs have utilized metal coil springs, either in compression or extension, as the energy storage element. While these designs can be conceptually sound, they are inherently limited by the low specific energy density of coil springs, which require large masses of steel to store sufficient energy for practical arrow speeds. For example, a steel coil spring capable of storing the approximately 100 foot-pounds of energy desirable for a high-performance bow must weigh several pounds and occupy considerable volume, rendering it impractical for handheld archery equipment.

FIG. 3 schematically compares 3 spring configurations capable of storing the same amount of energy. Spring 80 represents a conventional steel coil compression spring of appropriate stiffness and travel. Spring 81 illustrates the relative amount of composite material required to store the same energy if configured as an axial tensile spring, which is significantly smaller in diameter and mass (approximately 100 times lighter). Spring 82 represents the axial tensile spring in its functional configuration, showing its much greater length. Although tensile springs—long, essentially 1-dimensional structures that are directly extended—are inherently less compact than coil springs, their high energy-to-mass ratio makes them particularly advantageous in applications, such as archery, that can accommodate a long, narrow element. Although many attractive materials with high energy return have failure elongations under 5%, the present invention's geometry and cam system enable the practical use of axial tensile springs by providing the necessary space and constraints for their operation. Alternative energy storage mechanisms such as coil springs or flexural beams can be substituted if desired.

SUMMARY

The present invention provides an archery bow in which a rotating cam module actuates an axial tensile spring via a multi-roller shuttle. The cam module is mounted to a fixed pivot that is supported by the riser and includes a cam track with a slope that varies along its length to shape the draw force curve. A bowstring engages string grooves on the outer periphery of the cam module, allowing the cam to rotate as the bowstring is drawn.

The multi-roller shuttle includes at least one cam roller that engages the cam track and at least one guide roller that engages a guide track surface mounted to or formed in the riser. The interaction between the cam track and guide track surface constrains the motion of the shuttle to a predetermined path. As the cam rotates, the shuttle is displaced along this path, thereby elongating at least one axial tensile spring connected to the shuttle and storing energy in the spring.

In some embodiments, the axial tensile spring is folded about a turning element to form two tensile legs extending in opposite directions, effectively doubling the active spring length while enabling compact packaging within the riser. The riser may comprise a hollow structure to house the spring, and may include multiple parallel tubes connected by cross-members. A preload mechanism using a threaded spring terminator and a nut may be used to adjust spring tension.

The system enables a compound-like draw force profile without requiring limbs or synchronization cables. A pair of parallel string grooves on the cam module allows for a centered bowstring configuration, reducing lateral torque. The cam track profile can include a steep initial slope to rapidly increase draw force, a flat region for stable holding weight, and a sharp slope reduction near full draw to achieve let-off. Stop features may be used to define the brace and full draw positions of the shuttle along the cam track.

DETAILED DESCRIPTION

Figure 1:
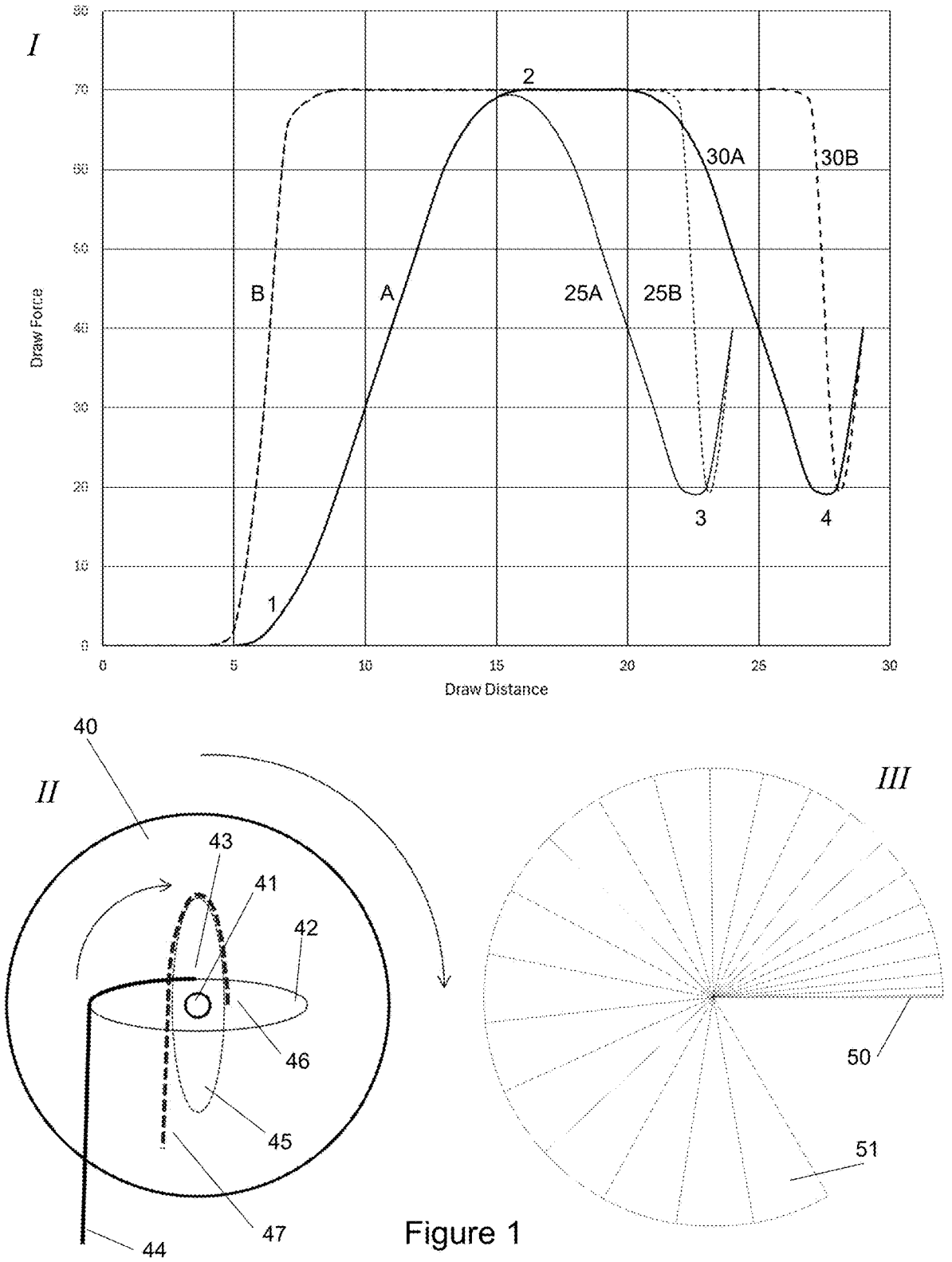
FIG. 1 is a schematic illustration, in 3 panels, showing the limitations of conventional compound bows in achieving an ideal draw force curve.

The following detailed description refers to the accompanying drawings, in which like reference numerals identify corresponding elements throughout the several views. The drawings are not necessarily to scale, and certain features may be exaggerated or omitted for clarity of illustration. The terms "left," "right," "front," and "rear," as used herein, refer to directions from the perspective of an archer holding the bow in a typical right-handed shooting position, with the left hand gripping the bow and the bowstring drawn by the right hand.

Figure 4:
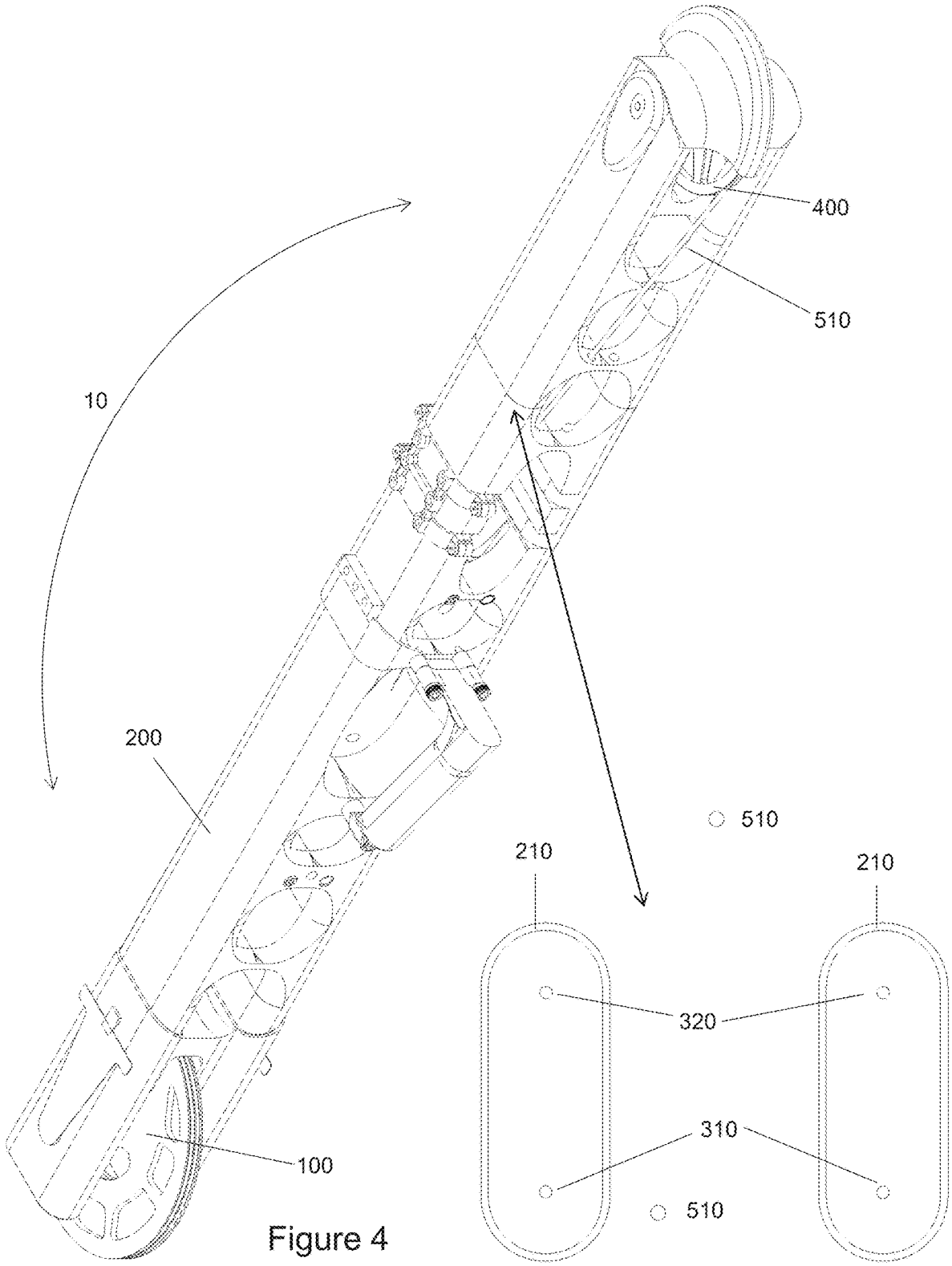
FIG. 4 is an isometric view of a bow according to an embodiment of the invention, showing the major components including a cam assembly, straight riser assembly, axial tensile spring system, spring folding idler assembly, and bowstring. A transverse cross-sectional detail illustrates the internal arrangement of the straight riser assembly, showing the parallel hollow members housing the folded axial tensile springs and the bowstring.

FIG. 4 is an isometric view of a bow 10 according to an embodiment of the invention. Bow 10 generally comprises a cam assembly 100 at the lower end, a straight riser assembly 200 extending longitudinally, a power storage spring system 300 housed within the straight riser assembly, and a spring folding idler assembly 400 at the upper end. A bowstring 510 is shown extending from the cam assembly 100, around the spring folding idler assembly 400, and back to the cam assembly 100 in a continuous loop.

Straight riser assembly 200 is the primary structural member of the bow, and in this embodiment comprises a pair of parallel hollow members 210 extending between the cam assembly 100 and the spring folding idler assembly 400. These hollow members 210 are shown more clearly in the sectional view at lower right in FIG. 4, which illustrates a transverse cross-section through the straight riser assembly at the indicated location. The hollow members 210 may be fabricated from carbon fiber composite, aluminum alloy, or another suitable material providing high stiffness and low weight.

The power storage spring system 300 is housed within the hollow members 210 of straight riser assembly 200. As shown in the cross-sectional detail, each hollow member 210 contains 2 elongated tensile springs configured in a folded arrangement. Springs 310 are cam-side springs that extend from the cam assembly 100 to the spring folding idler assembly 400, and springs 320 are tensioning-side springs that extend from the spring folding idler assembly 400 to tensioning points near cam assembly 100. To avoid terminology tied to a particular orientation (such as "upward" or "downward"), the spring segments are hereinafter referred to as the cam-side spring segment 310 and the tensioning-side spring segment 320, corresponding respectively to the segment attached to the multi-roller shuttle of the cam assembly and to the segment anchored to the spring tensioning plate at the opposite end of the bow. This folded configuration enables the use of axial tensile springs of the type described above, while maintaining a compact bow length. Spring folding idler assembly 400 includes an idler wheel for redirecting bowstring 510, as well as components of the spring folding system. Bowstring 510 is shown in both the isometric view and the cross-sectional detail. In the cross section, the upper centered instance of bowstring 510 corresponds to the drawn portion of the string while the lower offset instance of bowstring 510 corresponds to the return portion of the string.

Notably, bow 10 employs only a single continuous bowstring 510 and does not include synchronization or power-transfer cables commonly found in conventional single-cam or dual-cam compound bows.

Although additional components such as a stabilizer, arrow rest, sight, and arrow are not shown, they may be added as desired. Further views of the bow from additional angles, and more detailed depictions of the cam assembly, riser components, spring attachments, and spring folding idler assembly are provided in FIGS. 5-8 and subsequent figures.

Figure 5:
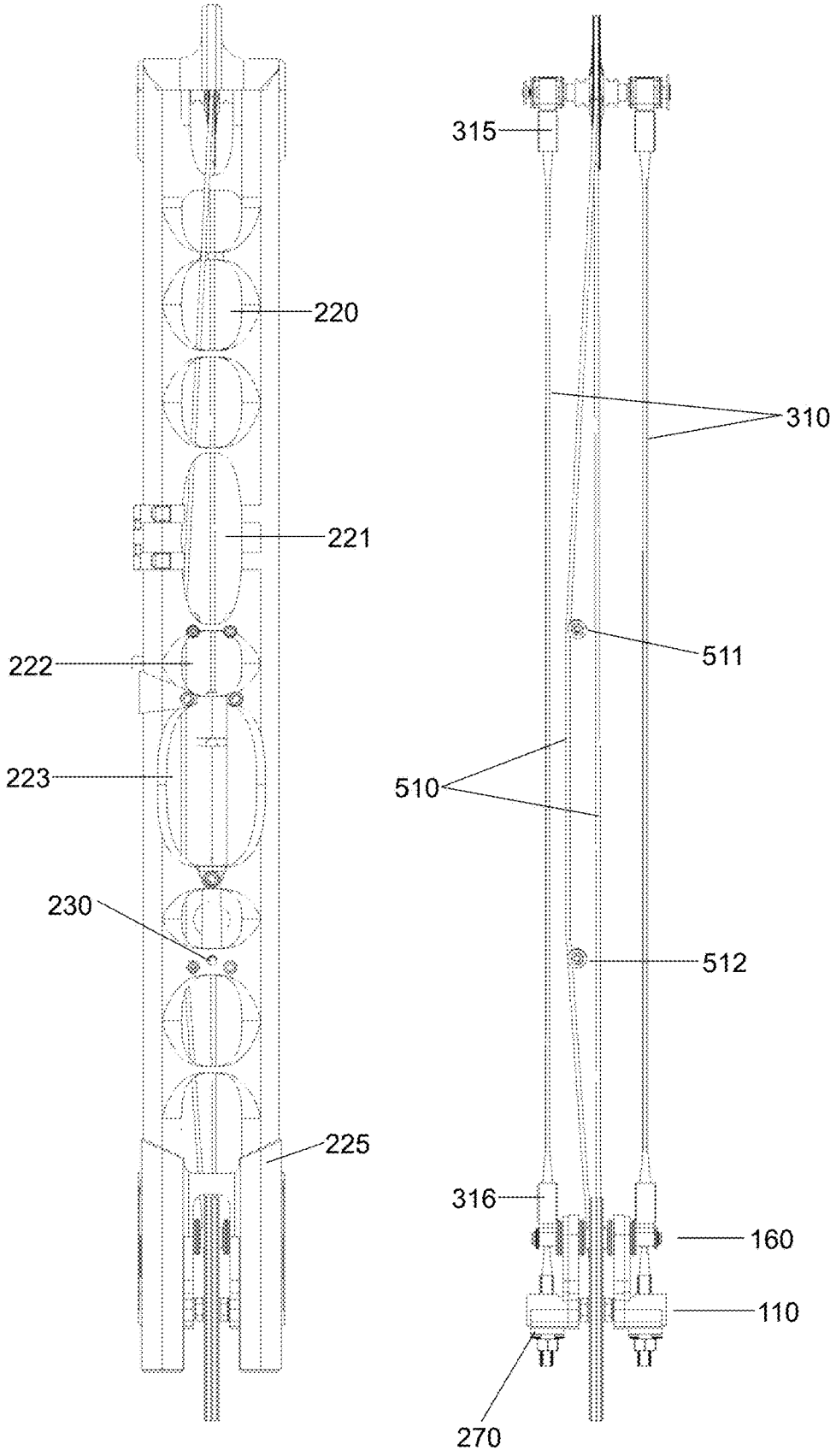
FIG. 5 shows front elevation views of the bow, including a full assembly view (left) and a skeletonized view showing only moving components (right). The straight riser assembly includes multiple windows for weight reduction, sighting, arrow clearance, and gripping. Internal axial tension spring attachment points, spring tensioning mechanisms, and bowstring diversion rollers are also shown.

FIG. 5 shows front elevation views of bow 10, including a full assembly view (left) and a skeletonized view (right) illustrating only the moving components. The straight riser assembly 200 in this embodiment comprises 2 parallel, obround hollow members joined by cross-members at intervals, forming a ladder-like structure with intermediate windows 220. These windows reduce weight while maintaining stiffness and allow access to internal components.

Window 221 is a sight window, aligned to allow the archer to view a target through the straight riser assembly when a sight is mounted in front of this opening. Window 222 is the arrow pass-through, aligned with the bowstring 510 so that an arrow rests in front of this opening on a standard arrow rest. Window 223 is the grip window, which is wider than the others to accommodate the archer's forward hand while maintaining a straight, enclosed path for the internal axial springs. Window 225 shows an area of the straight riser assembly where the tubing is reinforced with a sleeve or thicker wall to increase strength in this high-stress region. A threaded mounting hole 230 is provided below the grip area for attachment of a stabilizer or other accessories using standard hardware.

In the skeletonized view, bowstring 510 is visible, including its return portion, which is diverted laterally to provide clearance for the archer's hand. This diversion is accomplished by a pair of small U-groove rollers 511 and 512 mounted on the straight riser assembly. In the depicted configuration, the bow is set up for a right-handed archer, with the rollers positioned on the appropriate side of the straight riser assembly. The bow is inherently symmetric and may be converted for left-handed use simply by repositioning the rollers to pre-drilled mounting holes on the opposite side of the straight riser assembly.

The cam-side axial springs 310 are visible running parallel to the straight riser assembly. In this view the tensioning-side springs 320 are hidden behind the cam-side springs. Spring attachment tabs 315 and 316 at the top and bottom of the straight riser assembly respectively connect the springs to moving assemblies at either end of straight riser assembly 200. At the lower end of the straight riser assembly, multi-roller shuttle assembly 160 rides in the cam assembly and extends the tensile springs during the draw. Non-translating axle assembly 110 is also visible, providing the pivot about which the cam rotates.

Figure 6:
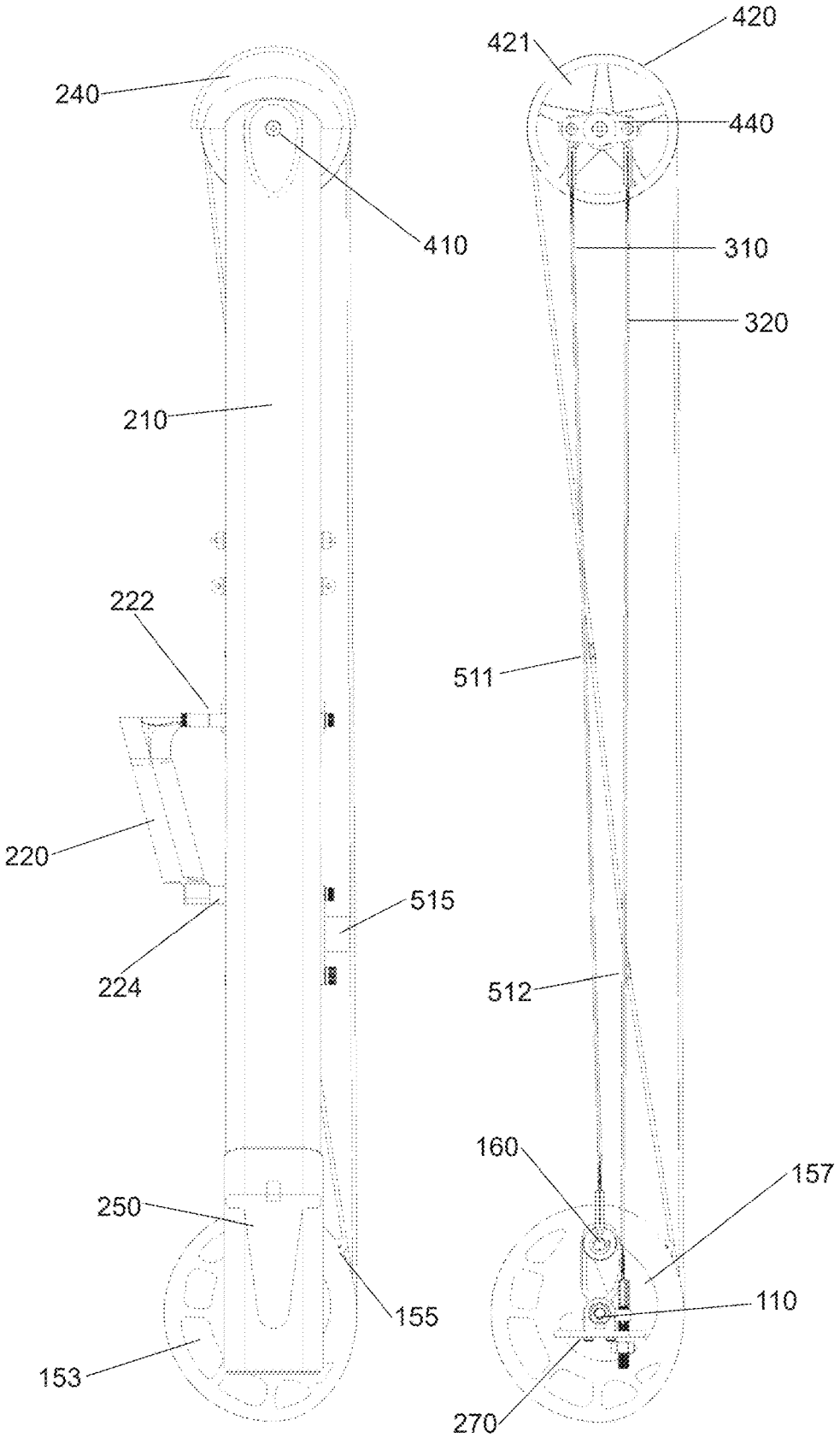
FIG. 6 shows left elevation views of the bow, including a full assembly view (left) and a skeletonized view showing only moving components (right). Major features include the protective upper cap, separate grip, string stop, cam and idler wheel assemblies, spring return lever, and spring and string attachment points.

A spring tensioning plate 270 is provided at the base of the straight riser assembly. This mechanism enables adjustment of the preload on the axial tensile springs by turning an adjustment nut, analogous to limb adjustment screws on a conventional compound bow. FIG. 6 shows left elevation views of bow 10, including a full assembly view (left) and a skeletonized view showing only moving components (right).

At the upper end, a non-structural protective cap 240 covers the top of straight riser assembly 200 and the spring folding idler assembly. Unlike traditional compound bows, where moving limbs and axles make protective structures impractical due to added mass and vibration, the lever pivot axle 410 of the present invention allows for effective protection of components against moisture and mechanical damage.

Straight riser assembly tube 210 is 1 of the parallel hollow members previously described in connection with FIG. 4. Grip 220 is attached at the central portion of the straight riser assembly using bolts and spacers 222 and 224. Unlike traditional compound bows where the grip is an integral structural part of the riser, the grip in this embodiment is a separate component. This allows greater flexibility in grip style, angle, placement, and mechanical isolation to reduce vibration. The grip may optionally incorporate viscoelastic damping materials, electronic components, or other enhancements.

A string stop 515 projects from the straight riser assembly to absorb residual energy in the bowstring 510 at the end of the shot and to prevent the string from striking the archer's hand. A lower cover plate 250 doubles as a foot, enabling the bow to stand on its end without the need for large aftermarket bow stands, which are typically required to rest lower than limb tips in conventional bows.

In the skeletonized view, the cam assembly at the lower end shows several features. Cam 100 includes recessed portions, such as 153, while 157 is a through-opening in 100 in which the multi-roller shuttle assembly 160 travels during draw. The bowstring 510 is secured at the string attachment point 155 after being wrapped around the string groove in a clockwise direction. The cam rotates about non-translating axle 110, while spring tensioning plate 270 provides a bearing surface against which the tensioning-side axial tensile springs are tensioned.

Bowstring diversion pulleys 511 and 512 are shown again in this view, allowing the return portion of the bowstring to be offset to provide clearance for the archer's forward hand. Both the cam-side 310 and tensioning-side 320 axial spring legs are visible running along the straight riser assembly and engaging the cam assembly and spring folding idler assembly.

At the upper end, idler wheel 420 redirects the bowstring. The idler wheel includes several openings 421, although the precise number, size, shape, and material of the idler wheel and its spokes may vary depending on design preferences, material choices, and manufacturing considerations. Spring transfer lever 440 is visible adjacent to the idler wheel; this seesaw-like mechanism enables the axial spring to be folded back on itself, effectively doubling its length within the available riser length.

It will be appreciated that many components, including the idler wheel and cam assemblies, may be implemented using various alternative designs, materials, bearings, and manufacturing techniques while still embodying the principles of the invention. The illustrated embodiment is exemplary and not limiting.

Figure 7:
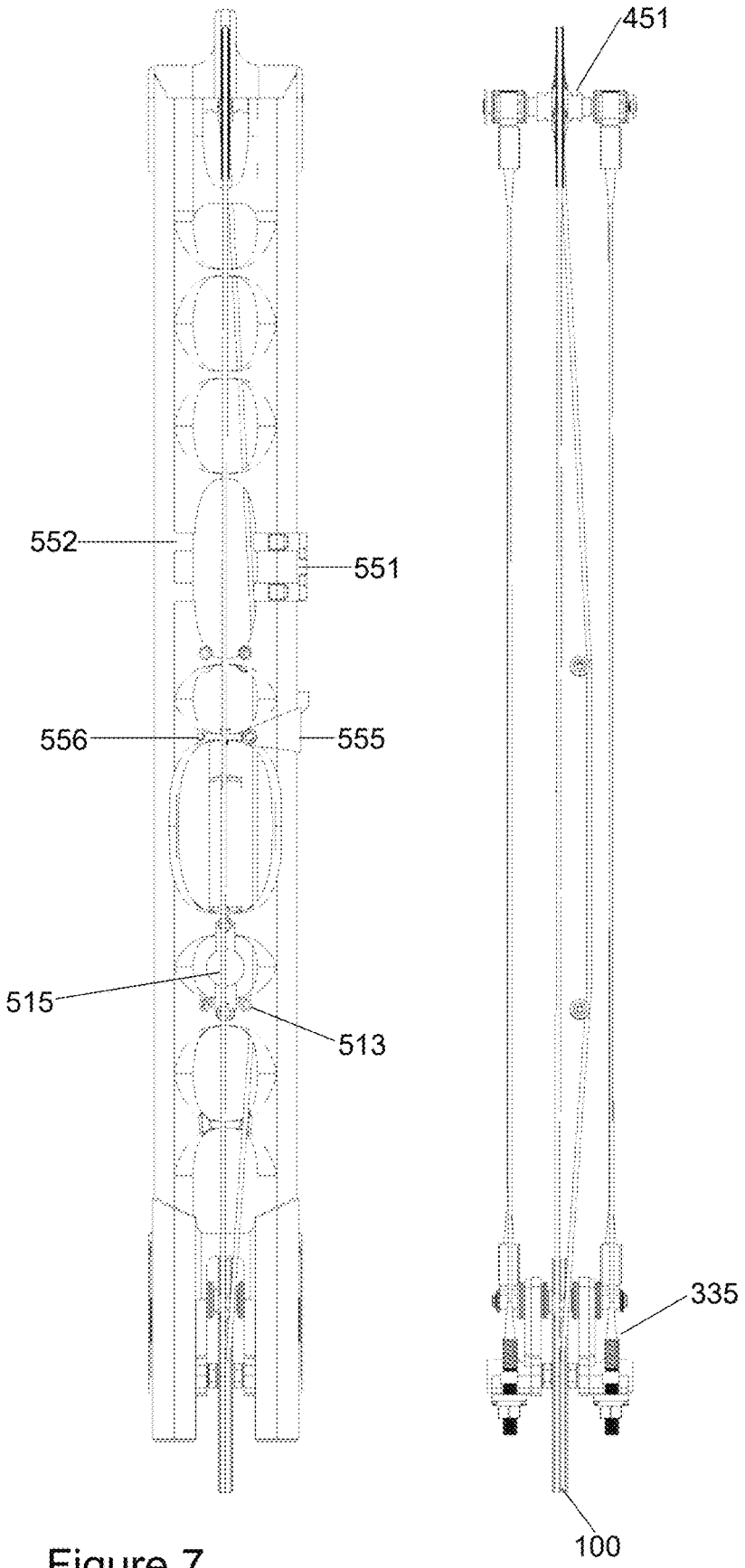
FIG. 7 shows rear elevation views of the bow, including a full assembly view (left) and a skeletonized view showing only moving components (right). Symmetric sight and arrow rest mounting plates, the string stop, pulley mounting holes, eccentric spacer, spring tensioning bolt, and cam assembly string grooves are visible.

FIG. 7 shows rear elevation views of bow 10, including a full assembly view (left) and a skeletonized view showing only moving components (right).

Sight mounting plate 551 is visible clamped around the right riser tube 210. This plate includes standard hole spacing for attaching conventional bow sights and is clamped rather than bolted through the tube itself to avoid introducing holes that could compromise the structural integrity of the straight riser assembly, particularly when fabricated from carbon fiber composite. Mounting plate channel 552 on the opposite riser tube illustrates that the mounting system is symmetric, allowing all accessories to be mounted on either side of the bow.

Arrow rest mounting plate 555 is shown in the standard position relative to the bowstring, with its primary mounting screw hole visible. A second, symmetric mounting hole 556 is provided to maintain ambidextrous compatibility, simplifying production of left- and right-handed models. Additional mounting holes on either side of the straight riser assembly may be used for less common accessories.

The rear of string stop 515 is visible in this view, with its viscoelastic or foam button for absorbing residual string energy. Screw hole 513 is shown for mounting bowstring diversion pulley 512, as previously described in connection with FIGS. 5-6.

At the top of the skeletonized view, eccentric spacer 451 is visible. This component allows for fine adjustment of the relative position of the bowstring idler wheel and the spring return mechanism, which share the same axle. At the bottom, spring tensioning plate 270 is visible, showing its position in relation to the cam assembly 100.

The rear view of cam assembly 100 highlights how the 2 ends of the bowstring 510 are brought together and secured in 2 parallel string grooves, maintaining alignment and balance during draw and release.

Figure 8:
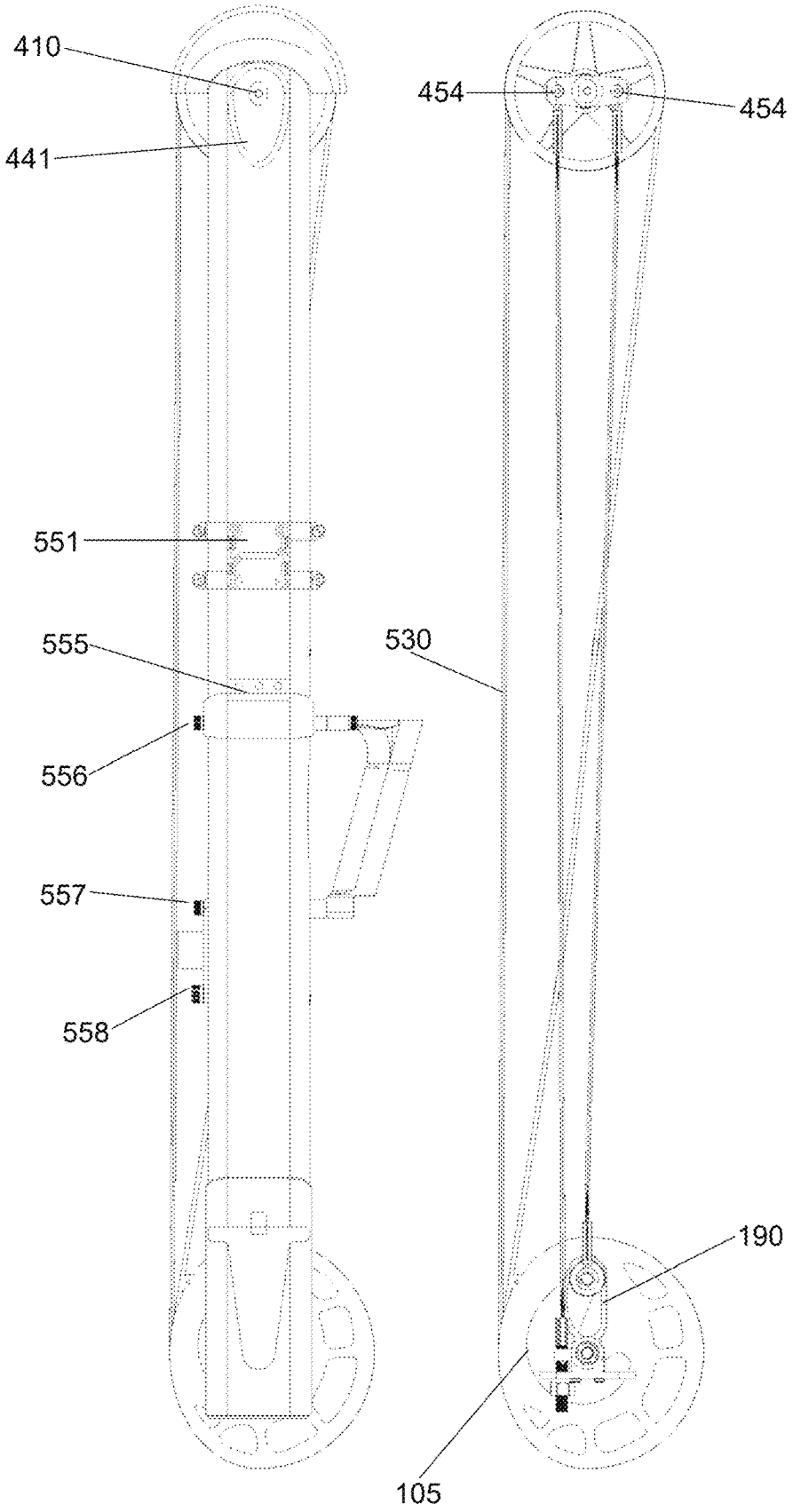
FIG. 8 shows right elevation views of the bow, including a full assembly view (left) and a skeletonized view showing only moving components (right). The sight and arrow rest mounting plates, grip and string stop mounting points, idler and return mechanism axles, D-loop position, and the precisely shaped cam surface and guide track at the lower end are visible.

FIG. 8 shows right elevation views of bow 10, including a full assembly view (left) and a skeletonized view showing only moving components (right).

At the upper end, lever pivot axle 410 supports both the idler wheel and the spring folding mechanism, with forces transferred into the straight riser assembly via strengthening plate 441. This plate distributes the high loads imparted by the tensile springs, maintaining dimensional stability at the axle mounting location.

Sight mounting plate 551 and arrow rest mounting plate 555 are shown on this side, each positioned and tapped to accept standard commercial accessories intended for conventional compound bows. Arrow rest mounting plate 555 is fastened using bolts 556, which pass through a long hole shared with the grip mounting hardware. Similarly, the string stop is mounted using holes 557 and 558, which coincide with existing mounting points at the lower grip and stabilizer locations, respectively. This reuse of mounting points minimizes unnecessary perforation of the straight riser assembly, maintaining its integrity.

Spring folding module side axles 454 are visible at the upper end in the skeletonized view. These axles allow the ends of the folded spring to pivot freely as the spring transfer lever rocks about its lever pivot axle 410.

Point 530 on bowstring 510 may include a D-loop or other standard interface for use with mechanical release aids. This position is approximately aligned with the arrow rest, ensuring consistent nocking point alignment.

At the cam assembly, cam track surface 105 implements the desired mathematical transfer function between draw distance and tensile spring extension. This surface is precisely shaped, hardened, and polished to produce a relatively flat draw force curve with sharp initial draw and let-off regions, although other profiles may be implemented as desired. Cam track surface 105 operates under substantial forces—on the order of 2000 lbf at full draw—requiring tight tolerances and robust structural support. Cam guide block 190 provides this support, tying together all high-stress members at the lower end of the straight riser assembly. Cam guide block 190 holds the cam's non-translating axle, constrains the multi-roller shuttle's path, and anchors the spring tensioning bolt, ensuring consistent and reliable operation under load.

Cam

As used herein, the term "cam" refers to a rotating module mounted to a non-translating axle on the riser, having a specially shaped internal surface that defines a cam track. This track governs the motion of a multi-roller shuttle and thereby defines the draw force experienced by the archer during string displacement.

The cam of the present invention forms the heart of the bow's mechanical system, converting linear bowstring motion into controlled extension of the axial tensile springs, thereby defining the force—draw relationship experienced by the archer. In the disclosed design, the cam performs this function under load conditions far beyond those typically encountered in conventional compound bows, requiring new approaches to both geometry and construction.

In concept, the cam provides a variable radius track that governs the rate at which the multi-roller shuttle displaces relative to the non-translating axle as the bowstring is drawn. Because the tensile springs are essentially linear in force versus elongation, it is the slope—not radius—of this track that directly defines the force-draw curve of the bow. The disclosed cam is therefore capable of producing an exceptionally flat plateau in draw force with steep initial and let-off regions, although other force curves may readily be implemented by cutting different track shapes (for example, track cut to maximize accuracy at the expense of arrow speed, or to accommodate an archer with a particular disability). Small differences in track slope result in substantial differences in draw force, and the profile may be tailored for a given archer at fabrication time to achieve the desired combination of draw length, let-off, and feel. The disclosed cam is not designed to provide field-adjustable draw length or let-off via movable pins, plates, or modules, as is common in some prior art. Rather, it is intended to be fabricated with a track profile cut specifically for the intended draw length and force curve. This approach simplifies the cam mechanically and allows it to maintain the extremely high stiffness and precision alignment demanded by the internal spring system, which operates at much higher forces than conventional limb-based systems. Adjustments to draw weight can similarly be made at fabrication or service time by changing spring cross-sectional area or number of fibers. Because the forces carried by this cam are substantially greater than in prior art designs—and because even slight deformation or misalignment of the cam under load can produce binding or dead spots in the draw—the disclosed embodiment uses a hybrid construction designed to combine high torsional stiffness, high compressive strength at the track surface, and very low elastic deformation under load. The working embodiment described herein uses a combination of hardened steel, carbon fiber plate and winding, aluminum, and off-the-shelf fasteners to meet these requirements, although a monolithic machined cam of appropriate material (e.g., 7075 aluminum or hardened tool steel) could in principle also be produced if sufficient thickness and heat treatment are provided. The materials and methods disclosed are exemplary of 1 proven configuration but are not limiting.

The cam further incorporates a multi-roller shuttle assembly, which interfaces directly with the tensile springs, riding on a pair of rollers that follow the cam track. 2 alternative implementations of the multi-roller shuttle are disclosed herein, each capable of meeting the functional requirements.

The cam mounts on a non-translating axle through the lower riser tube, centered in a hardened cam guide block. As will be described, the interface between cam, non-translating axle, and guide tracks must maintain precise concentricity and smoothness under high radial and thrust loads to allow the cam to rotate freely without excessive friction or play.

The following figures illustrate the cam assembly in detail, beginning with an overview of its assembled configuration and primary function (FIG. 9), continuing through an exploded view of its components, and then describing the details of the cam body, track, non-translating axle assembly, and multi-roller shuttle alternatives. Although the cam may be placed at either end of the straight riser assembly, illustrations here place it at the bottom.

Figure 9:
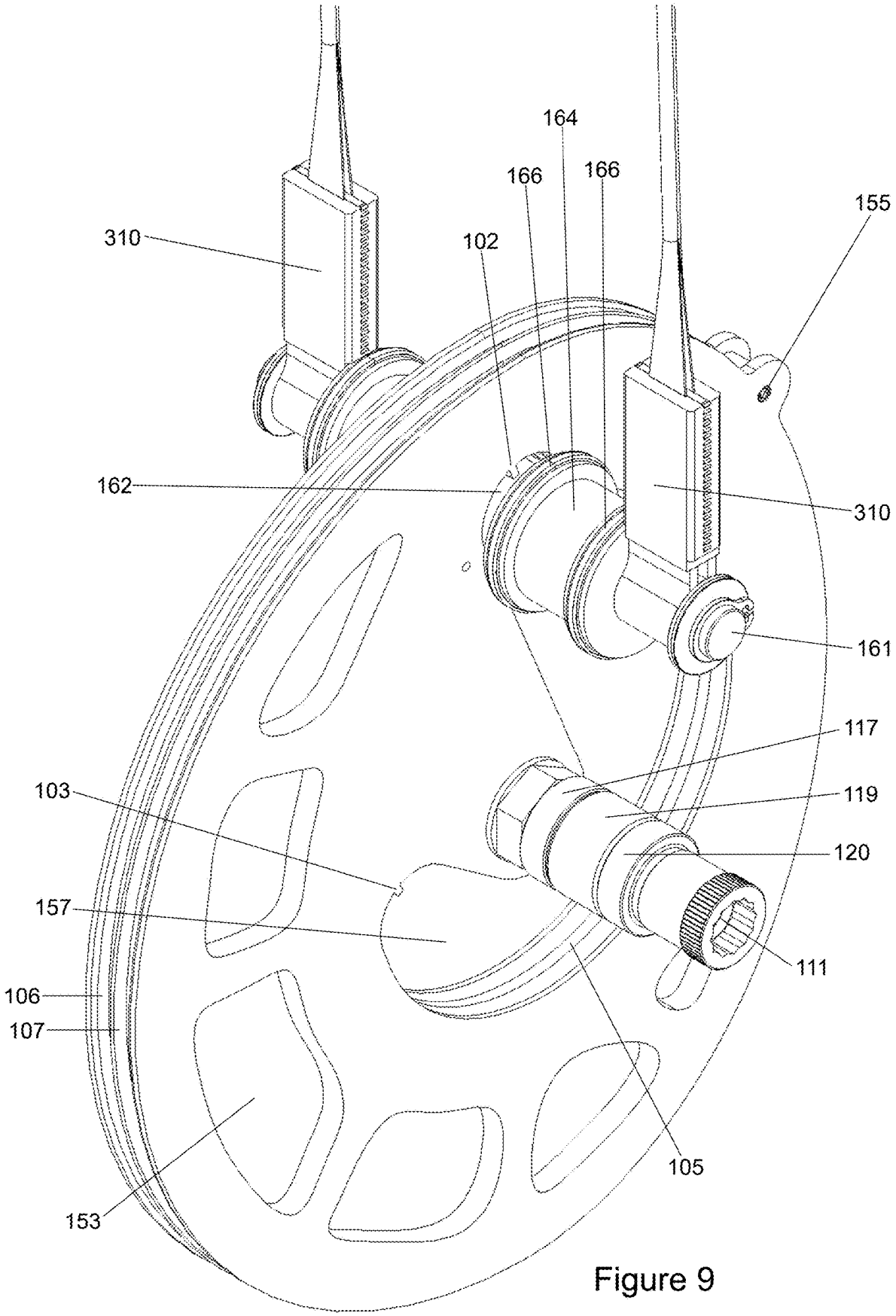
FIG. 9 is an isometric view of the cam assembly in the undrawn position, showing the non-translating axle, multi-roller shuttle, axial tension springs, and associated axle hardware.

FIG. 9 is an isometric view of the cam assembly 100, illustrating its principal components and operation in the undrawn position. The cam assembly 100 controls both the winding of the bowstring and the extension of the cam-side axial tensile springs 310 during the draw cycle. Like a conventional compound cam, the cam assembly 100 pivots about a non-translating axle 111 mounted to the straight riser assembly. In this embodiment, the axle 111 is fixed to the cam body, and the axle 111 and cam body rotate together within a stack of bearings 117, 119, and 120 (duplicated on both sides but shown here on 1 side only). Bearings 119 are preferably roller bearings to handle the high radial loads imposed by the cam-side springs 310, while bearings 117 and 120 also contribute radial load support and protect against incidental axial loads.

2 separate string grooves, 106 and 107, are formed on the periphery of the cam body to wind the 2 ends of the bowstring. These grooves 106 and 107 may be identical or may differ slightly to minimize vertical nock travel during the draw and firing sequence. Such travel may arise from the slightly different geometry at the top and bottom of the bow and stretch in the return leg of the bowstring. The ends of the bowstring are secured at an anchor point 155 near the periphery of the cam.

The cam body itself may be solid, spoked, or a hybrid construction as shown, where cutouts 153 reduce weight without compromising stiffness. The non-translating axle 111 is supported by the bearings while allowing the cam body to rotate freely relative to the straight riser assembly.

A central cutout 157 in the cam body defines the path of the multi-roller axle 161, which is constrained to follow a guided path during cam rotation. The multi-roller axle 161 serves as the interface to the cam-side axial tensile springs 310, 1 of which is visible connected at each end. The motion of the multi-roller axle 161 is constrained by 2 mechanisms: first, the cam roller 162 rolls along the contoured cam surface 105, which defines the draw force curve by determining the downward motion of 161 as a function of cam rotation. Fine adjustment tabs 102 and 103 at the start and end of surface 105 allow irreversible fine tuning of the cam roller 162 contact points for precise let-off characteristics.

Second, a pair of guide rollers 164, flanked by thrust bearing stacks 166, roll along a guide track (provided by the cam guide block 190 seen in earlier figures) to maintain constrained motion of the multi-roller axle 161 while permitting relative rotation of the cam roller 162 and cam-side springs 310 about 161.

During the draw, the cam rotates counterclockwise (in this view), causing the multi-roller shuttle 161 and cam-side springs 310 to move downward as determined by the slope of surface 105. The initial steep slope near 102 produces a sharp initial increase in draw weight, while the flatter slope near 103 maintains consistent draw force as the string angle changes and the springs extend.

The layers of the cam body may be observed at surface 105, comprising 5 distinct layers. Counting outward from the left, layers 2 and 4 are hard, low-friction rolling surfaces that directly contact roller 162, while layers 1, 3, and 5 are structural layers that distribute loads between the bowstring, cam surface, non-translating axle 111, and multi-roller axle 161. Due to the high forces generated in this design, the cam construction must combine extreme strength and stiffness with low mass to minimize vibration and maximize efficiency.

Figure 10:
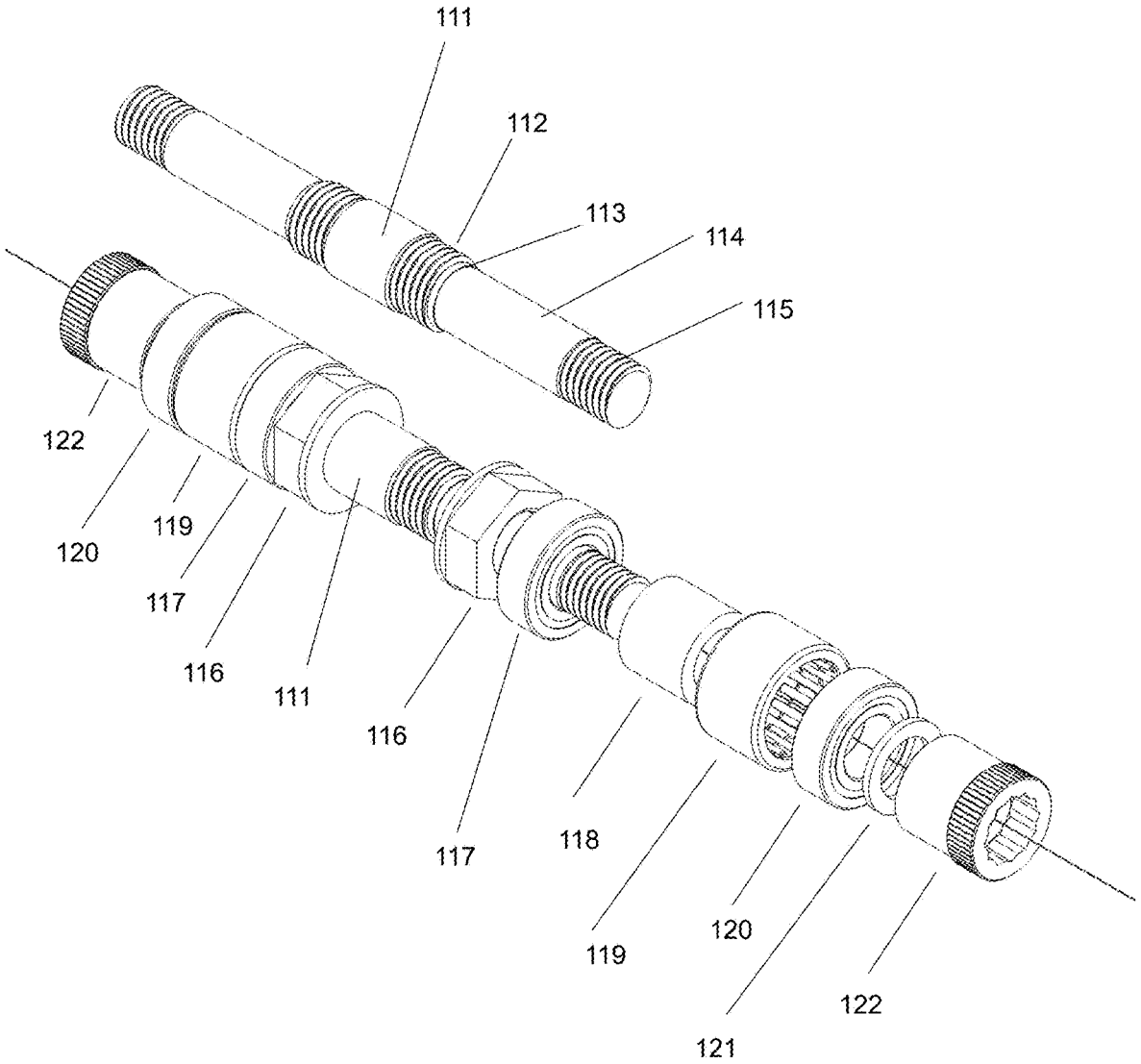
FIG. 10 is an isometric partially exploded view of the non-translating axle assembly, showing the shoulders and threaded sections of the stepped axle, along with bearings and other hardware.

Details of the internal construction and assembly of the cam are provided in subsequent figures, while FIGS. 35-40 illustrate the full cycle of operation and the cam surface shape in detail. FIG. 10 is an isometric view of 1 embodiment of the non-translating axle assembly 110, shown exploded on the right side for clarity. The main axle component 111 is duplicated above the primary view to illustrate its stepped features. A centerline axis is also shown in the main figure for reference.

As used herein, the term non-translating axle refers to an axle that maintains a fixed position relative to the riser and defines the axis of rotation for the cam module. The axle may either rotate or remain stationary during operation but does not translate relative to the riser or cam guide structure.

The non-translating axle assembly 110 supports the cam under the high radial and moderate axial loads imposed by the axial tensile springs during operation. Many bearing styles and configurations may be employed, provided they resist significant radial forces, dynamic axial loads, and prevent unacceptable elastic or inelastic deformation under peak forces.

In this embodiment, the axle 111 is a steel shaft with a series of stepped diameters, maintaining symmetry about its center. The central portion of 111 has the largest diameter and mates snugly with the bore of the cam body. Outboard of this central portion are 2 threaded sections 112, with a major diameter slightly smaller than the central section and a minor diameter slightly larger than the section labeled 114. Flanged hex nuts 116, positioned below in the main figure, engage the threads 112 to secure the cam rigidly to the axle.

Short shoulders 113 provide reaction surfaces for the inner rings of thrust-capable bearings 117. Each bearing stack consists of a bearing 117, an inner ring 118, a needle roller bearing 119, and another bearing 120. These components fit along the reduced-diameter section 114, which is dimensioned to accommodate them securely. Outboard threaded ends 115, with a major diameter slightly smaller than 114, accept flat washers 121 and socket nuts 122 to clamp the assembly together.

The primary radial loads of the cam are borne by 2 needle roller bearings 119 acting against separate hardened inner rings 118. This arrangement allows the axle 111 to carry loads without requiring ultra-precise surface finishes. Bearings 117 and 120, located on either side of each roller bearing 119, may be any type capable of carrying incidental thrust loads and contributing additional radial support-options include deep groove ball bearings, thrust ball bearings, or other combined designs. The entire 117-120 bearing stack could alternatively be replaced with a single combined radial/thrust bearing if desired.

In this embodiment, all bearing components have a uniform outer diameter, and no component on the axle exceeds this diameter. This allows the fully assembled non-translating axle assembly 110 to fit into a pair of preinstalled metal tubes embedded in the straight riser assembly, enabling the straight riser assembly to be assembled permanently while still allowing the cam and axle to be inserted and secured from the sides.

Socket nuts 122 are preferred at the ends of the axle so that a hex key may be used to tighten the assembly, given the constrained access inside the riser tubes.

Unlike in a traditional compound bow, where cam axles are mounted at the ends of flexible limbs and undergo slight translational motion due to limb bending, the non-translating axle 110 in this design remains stationary relative to the straight riser assembly and undergoes only pure rotation. Accordingly, the axle is designed heavier and stiffer than in conventional designs, capable of resisting bending and supporting spring loads that may reach approximately 2000 pounds-force without significant deflection.

Figure 11:
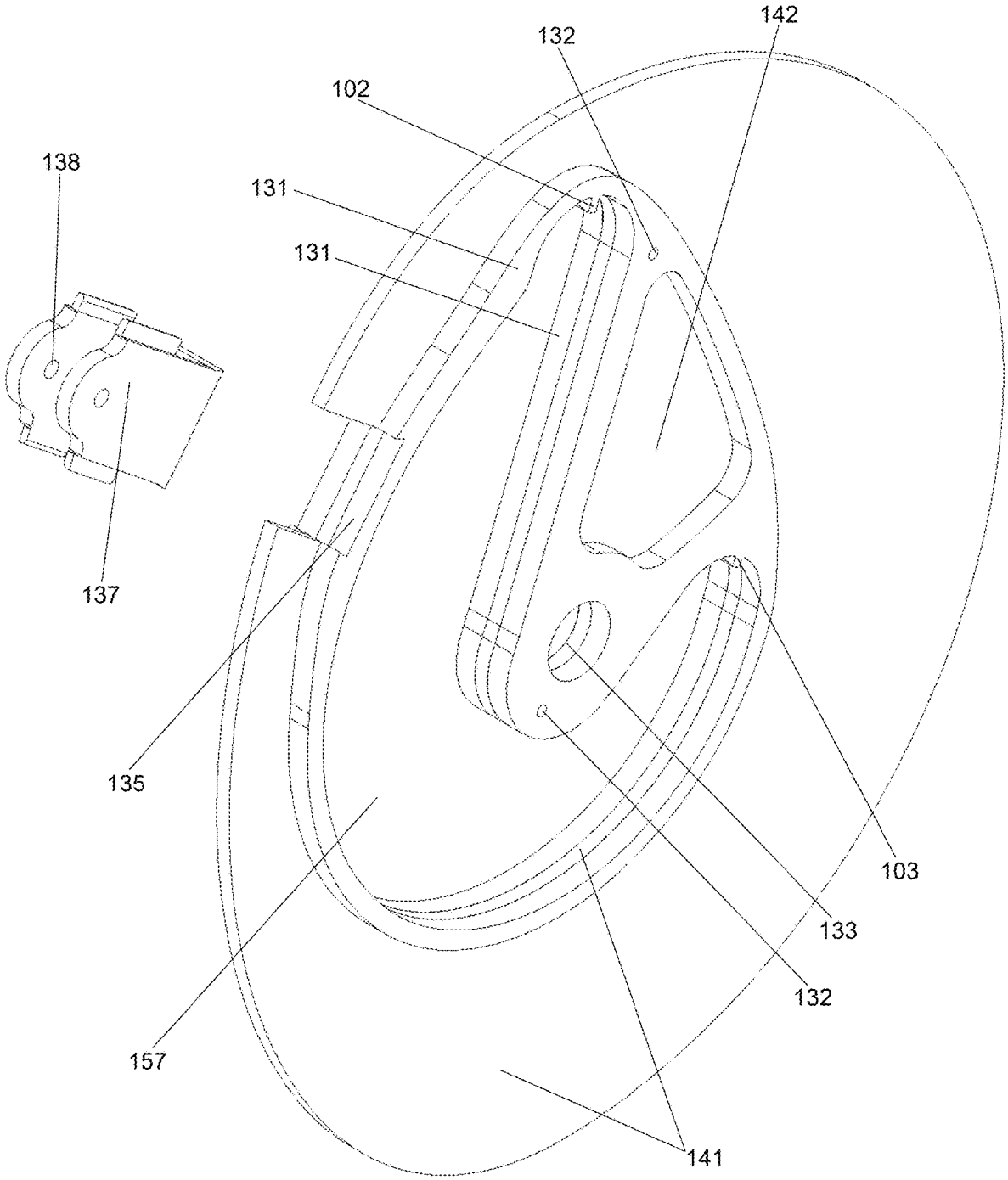
FIG. 11 is an isometric, partially exploded view of the early assembly steps of the cam, showing the steel cam track components, carbon fiber web, and string anchor.

FIG. 11 is an isometric, partially exploded view illustrating early assembly steps of the cam. The figure shows the central steel and carbon fiber elements which form the core load-bearing and rolling surface of the cam. The cam track components, 131, of which there are 2 (1 largely hidden behind 141 but visible through the cutout 157), form the primary rolling surface of the cam that converts rotational motion into linear extension of the axial tensile springs. This cam track surface, extending from point 103 clockwise to point 102, is subject to very high contact pressures from the hardened steel roller, requiring it to possess excellent strength, toughness, smoothness, and hardness.

In this embodiment, the cam track components 131 are fabricated from hardened steel, selected because no other material currently offers the same combination of properties (hardness, toughness, machinability, and dimensional stability) in such a constrained geometry. Although only the rolling surface of the cam absolutely requires steel, the steel portion in this embodiment is extended inward to include the axle hole 133 and additional bracing ribs between 102 and 103. This design choice maximizes the strength and stiffness of the cam in its most highly loaded region, minimizes elastic deformation, and ensures accurate tracking of the roller under load. The inner region around hole 133 defines the minimum distance between the non-translating axle and the closest approach of the multi-roller shuttle, limiting how compact the cam can be made. Since this is a critical stress region and space is at a premium, retaining steel here provides the most reliable performance without requiring impractically complex fabrication.

2 locating holes 132 are provided in 131 to assist in precise assembly of the cam stack; dowel pins may be inserted here temporarily or permanently as needed. These holes extend through to the outer layers as shown in later figures.

Central web 141 is made from carbon fiber composite plate in this embodiment. While the steel 131 is highly wear-resistant, it is not sufficiently stiff on its own to resist flexing under the very high radial and torsional loads imposed by the springs. The carbon fiber web 141 greatly increases the out-of-plane stiffness of the cam while minimizing weight. Quasi-isotropic or balanced woven layups are preferred; unidirectional layups should not be used due to their poor performance in transverse directions.

As steel and carbon fiber are dissimilar materials, galvanic corrosion can occur over time if they are in direct electrical contact in the presence of moisture. To mitigate this, the steel surfaces of 131 are treated with protective and low-friction coatings. Suitable coatings include electroless nickel-phosphorus, hard chrome plating, diamond-like carbon (DLC), or PVD coatings such as TiN or TiCN. These coatings provide corrosion resistance, reduce rolling friction, improve surface hardness, and isolate the steel electrically from the carbon fiber. Alternatively, hard but corrosion-resistant steels such as 440C, 420, 17-4PH, or 15-5PH could be used, though these alloys generally provide lower hardness than tool or bearing steels such as 1095, O1, or A2. In all cases, the finished steel surface must be hard, square, smooth, and corrosion-resistant to maintain reliable rolling contact over the bow's service life.

Window region 142 shows that the carbon fiber web 141 extends into a cutout to provide additional stiffness near the center. Since carbon fiber alone is not ideal for holding threaded fasteners or pins, a separate metal string anchor component 137 is included. This anchor is fitted into a keyed slot 135 in the steel 131 and carbon fiber 141 stack and will later be overwrapped with carbon during subsequent assembly, locking it securely in place. Anchor 137 is not subjected to the same contact stresses as the cam track, so it may be made of lighter metals such as aluminum or titanium alloys. If aluminum is used, hard anodizing is recommended to improve reliability of its interface with carbon fiber. The anchor includes holes 138 which serve to secure the ends of the bowstring via screws or pins.

All components shown in FIG. 11 are assembled using epoxy or similar adhesives, ensuring full surface bonding and load transfer between layers. Many alternative embodiments are possible. For example, the 2 separate 131 plates could be replaced by a single thicker steel plate, with 141 omitted or replaced by distal web elements. Choice of fabrication technique may also influence material choices and thicknesses. In this embodiment, laser cutting is preferred for producing the steel 131 plates, as it provides excellent dimensional accuracy, clean edges, and small minimum feature sizes even at reduced thicknesses, reducing the weight of the steel components. Other suitable manufacturing methods include CNC machining, waterjet cutting, wire EDM, or precision stamping, provided they yield square, accurate, and properly finished edges on the rolling surface.

This combination of materials-steel at the highly loaded rolling surface and inner hub, carbon fiber in the structural web, and lighter metals at the string anchor-enables a cam assembly that meets the demanding mechanical requirements of this design without excessive weight or deformation.

Figure 12:
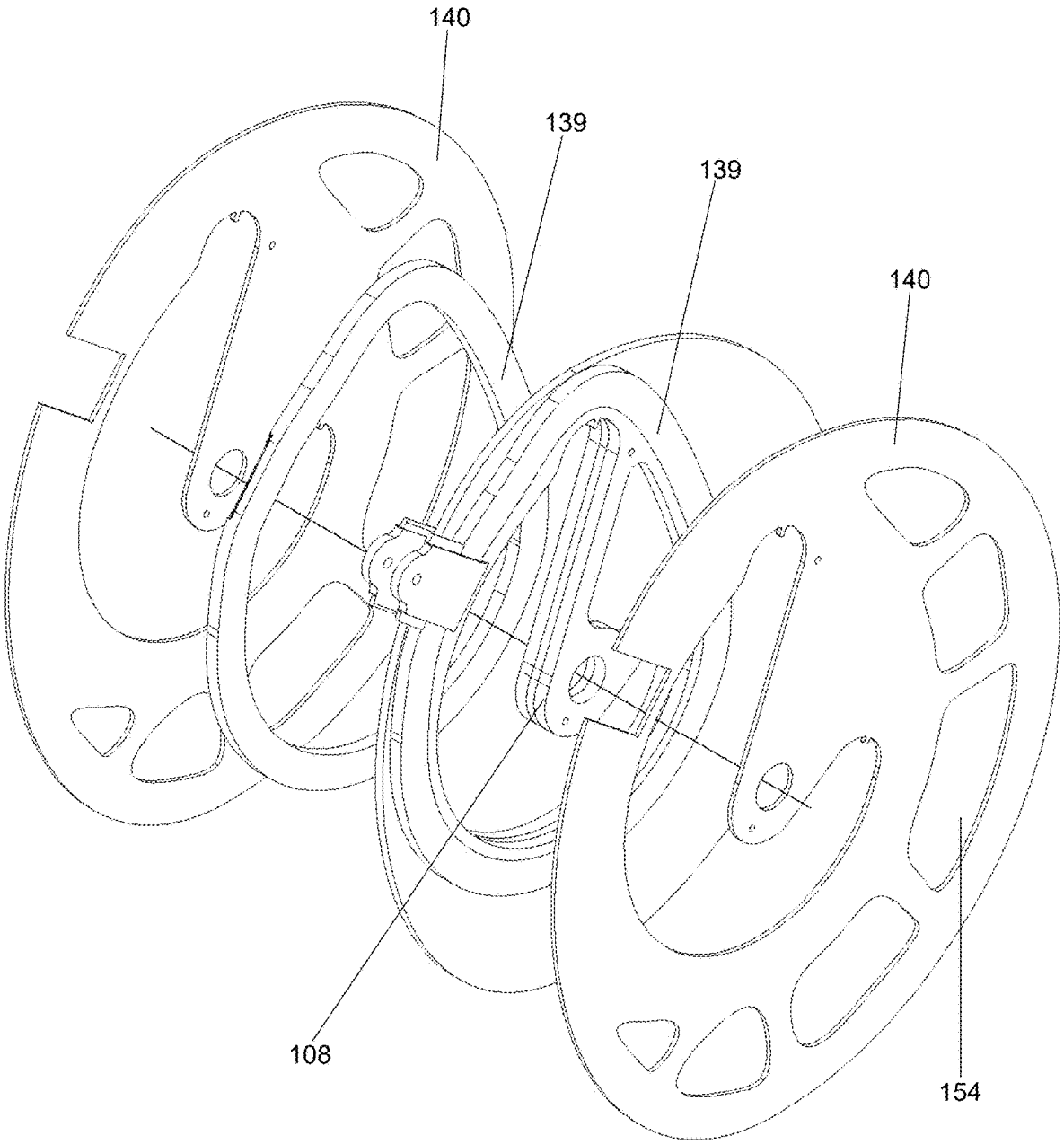
FIG. 12 is an isometric, partially exploded view showing further assembly of the cam, including the outer plates and carbon fiber windings added to the bonded central subassembly.

FIG. 12 is an isometric, partially exploded view showing further assembly of the cam. An axial reference line is included for clarity. Subassembly 108 represents the fused result of the components shown in FIG. 11:2 steel cam track plates 131, a central carbon fiber web 141, and the string holder 137, all bonded together with structural adhesive.

To this subassembly are added 2 outer plates 140, 1 on each side of the cam. These outer plates may include cutouts such as 154 to reduce weight and help balance the cam rotationally. In the illustrated embodiment, the 140 plates are thinner than the central web 141. The combined width of the 131/141/131 stack must be sufficient to accommodate the 2 bowstring grooves 106 and 107 (as previously shown in FIG. 9). In contrast, the outer plates 140 are not required to contribute substantially to the string groove geometry; their primary purposes are to act as outer string guards, secondary stiffening layers, and confining plates for the wound carbon fiber layers applied next.

The carbon fiber windings 139, shown here in position but in practice wound after installation of the 140 plates, wrap around the outside of the 131 cam track plates. These windings act as the primary structural element resisting bending and deflection of the cam tracks during operation. The carbon fiber winding should ideally be several times taller than the steel 131 plates while remaining much lighter, and it also encapsulates the base of the string holder 137, locking it securely in place. The windings are bonded to both the steel 131 and the carbon fiber web 141 to provide integrated load transfer among the materials.

For best results, the winding is performed using epoxy-impregnated fibers laid under controlled tension, followed by vacuum degassing to minimize voids and bubbles in the cured resin. While standard-modulus carbon fibers offer high tensile strength, the cam's performance benefits most from maximizing stiffness rather than ultimate strength. Therefore, high-modulus carbon fiber is preferred in this application, despite its lower tensile strength, as it minimizes even small elastic deflections of the cam surface. Such deflections, if left unchecked, can significantly alter the slope of the cam surface, undermining the desired draw curve and even creating undesirable energy wells in the cam's motion. Space for the windings 139 is limited, particularly near the string holder (137 from FIG. 11), meaning that the stiffest possible fiber should be chosen. Other embodiments are possible. For example, a compression-molded all-carbon cam body with localized metal inserts for the rolling surface, string holder, and axle hub could be used. However, the layered construction presented here offers distinct advantages, particularly the ease of customization. Because the design relies mainly on planar parts cut from sheet or plate material, it can be readily adjusted for different draw lengths or profiles simply by changing a laser cutting recipe, avoiding the time and cost of redesigning a mold or a complex CNC machining process. This flexibility allows for faster iteration and more cost-effective production while retaining the stiffness and reliability demanded by the application.

Figure 13:
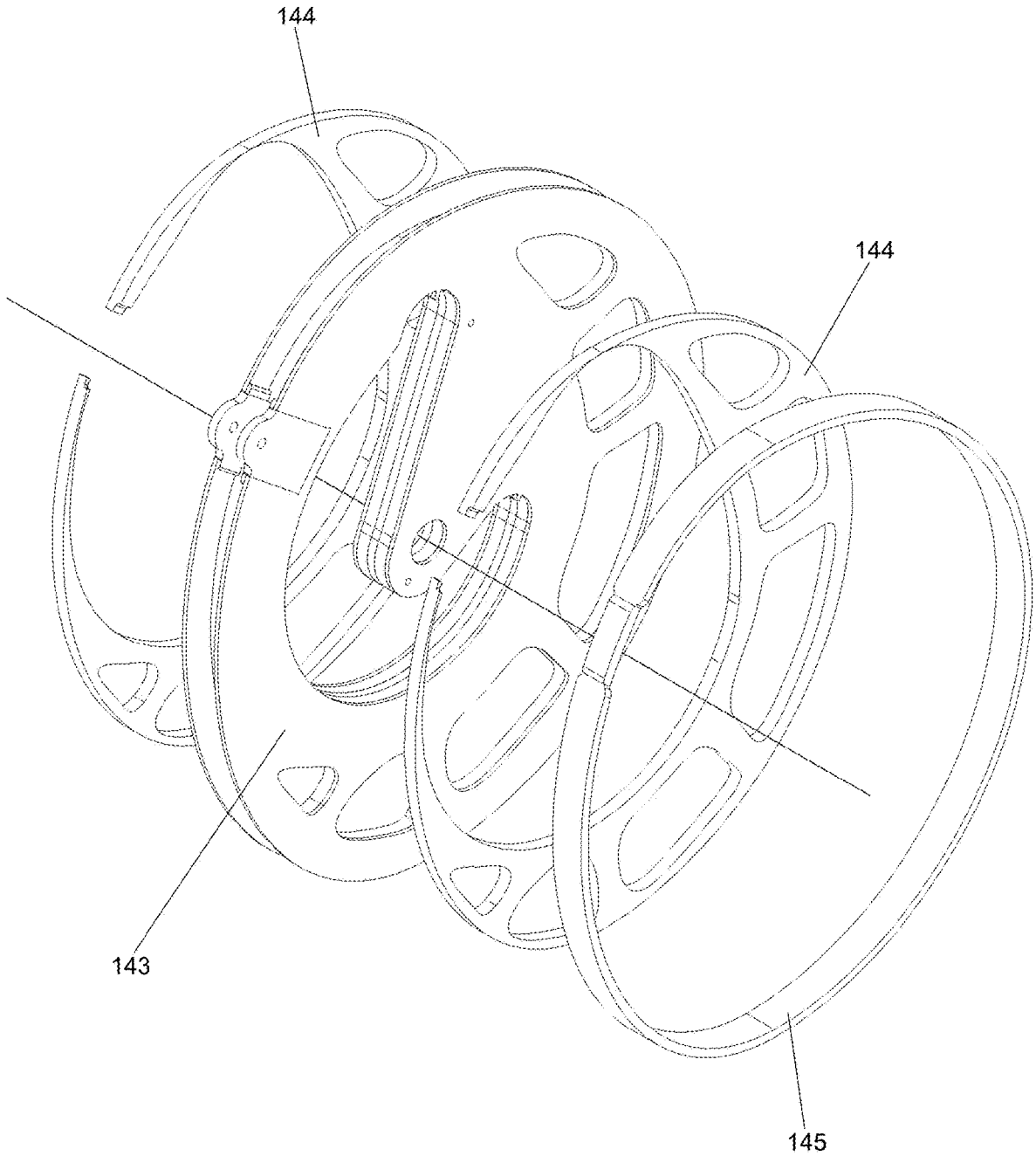
FIG. 13 is an isometric, partially exploded view of the cam showing addition of structural foam inserts and a final carbon fiber winding to complete the outer groove region.

FIG. 13 is an isometric, partially exploded view of the cam at a further stage of assembly, shown again with an axial reference. Subassembly 143 represents the cam as completed in FIG. 12, with the bonded core, outer plates, and first carbon fiber windings in place.

At this stage, lightweight inserts 144 are added. These inserts fit into the spaces between the central web 141 and the 2 outer plates 140, spanning the width of the steel cam tracks 131. The inserts further couple the inner web 141 to the outer plates 140 and provide a defined, continuous path over which a final carbon fiber winding will be laid to form a stiff, stable bed for the bowstring grooves. The outer edges of 144 follow the same profile as the inner web 141, which is slightly smaller in extent than the outer plates 140.

The inserts 144 can be fabricated from a variety of materials, but in the preferred embodiment they are made from a lightweight structural foam. Structural foams commonly used in aerospace and marine cored composite panels-such as PVC foams (e.g., Divinycell H-series), PMI foams (e.g., Rohacell), or SAN foams (e.g., Corecell)—are ideal for this purpose. These foams offer high compressive strength and adequate shear stiffness at very low density, minimizing added weight while preventing buckling or deformation of the overlying carbon winding under compressive load. The internal cutouts within 144 can be created either before bonding or afterward by machining through the openings in the 140 plates, as the foam is easily removed with simple tooling.

Once the 144 inserts are in place and bonded to the surrounding components, the final carbon fiber winding 145 is applied. This winding is laid using similar procedures to the earlier windings 139 described in FIG. 12. Unlike 139, which is the width of a single 131 cam track, the 145 winding spans the full width of both 131 tracks plus the central 141 web. The winding 145 should be thick enough to prevent compressive failure of the foam inserts 144 beneath it and to create a strong structural bond between the outer edges of the inner web 141 and the proximal sides of the outer plates 140.

Since the forces in the bowstring grooves are lower than those borne by the cam track, standard-modulus carbon fiber may be used for winding 145. As before, the fibers are applied under controlled tension, impregnated with epoxy, and may undergo vacuum degassing to minimize voids prior to curing. Winding 145 is depicted here schematically as a solid ring, but in practice it must be wound in place since its final outer dimensions are smaller than that of the outer plates 140 that it lies between.

Figure 14:
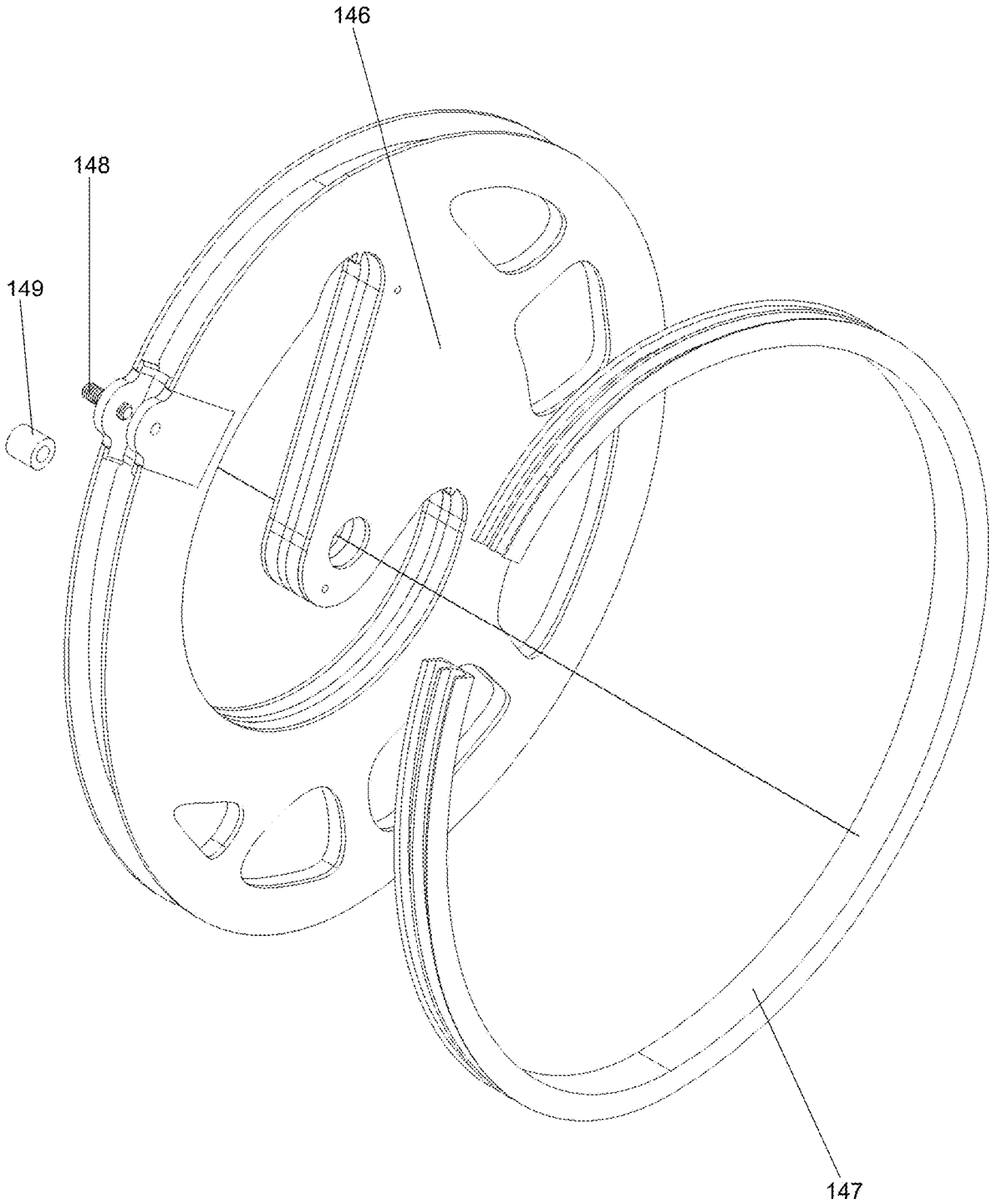
FIG. 14 is an isometric, partially exploded view of the cam showing the addition of parallel string groove inserts, and the fasteners used to secure the bowstring loops to the string holder.

FIG. 14 is an isometric, partially exploded view of the cam, showing the addition of components that secure and route the bowstring. Subassembly 146 represents the cam as completed through the previous stage shown in FIG. 13. At this stage, the cam periphery features a square-bottomed trough running circumferentially around its outer edge, formed by the sides of the outer plates 140 and the base provided by the carbon fiber winding 145.

To create the parallel string grooves, inserts 147 are added into this trough. Various fabrication techniques are possible for the channels 147. In alternative embodiments, the channels could have been molded in place during the application of the 145 winding, or incorporated directly into the 144 foam inserts. In this embodiment, however, 147 is a discrete, replaceable component that is bonded into the trough. Because the mechanical requirements of the channels are modest—sufficient compressive strength to avoid splitting or significant deformation under bowstring tension—they can be fabricated from a wide variety of materials. Lightweight polymers or fiber-filled polymers are preferred, and 3D printing is particularly suitable for this part, allowing for rapid prototyping and tuning adjustments. Injection molding or machining are also acceptable.

Using replaceable channels 147 provides several advantages in bow tuning and maintenance. Since the same cam 100 serves both upper and lower positions on the bow, and since the bowstring paths differ slightly above and below the archer's hand (with the upper segment routed around an idler wheel), fine adjustment of the bow's synchronization and cam balance can be accomplished by substituting or modifying the channels 147. The depth and shape of the channels 147 can also be varied to adjust draw length incrementally. Additionally, minor mass distribution changes can be implemented by varying the internal fill or wall thickness of the printed channels 147. Once fabricated and finalized, 147 is bonded into the trough with adhesive.

The bowstring loops are anchored to the cam via the string holder (137 from FIG. 11), with the ends secured using a set screw 148 and a spacer bushing 149. The bushing 149 is a short segment of metal or polymer tubing that fits over the shank of 148, keeping the bowstring loops clear of the screw threads and providing a smooth bearing surface of appropriate diameter for the loops. Any sufficiently rigid and wear-resistant material may be used for 149. The threads tapped into the string holder (137) should be cut in a single operation through both sides to ensure even clamping and prevent distortion of the holder during assembly.

Figure 15:
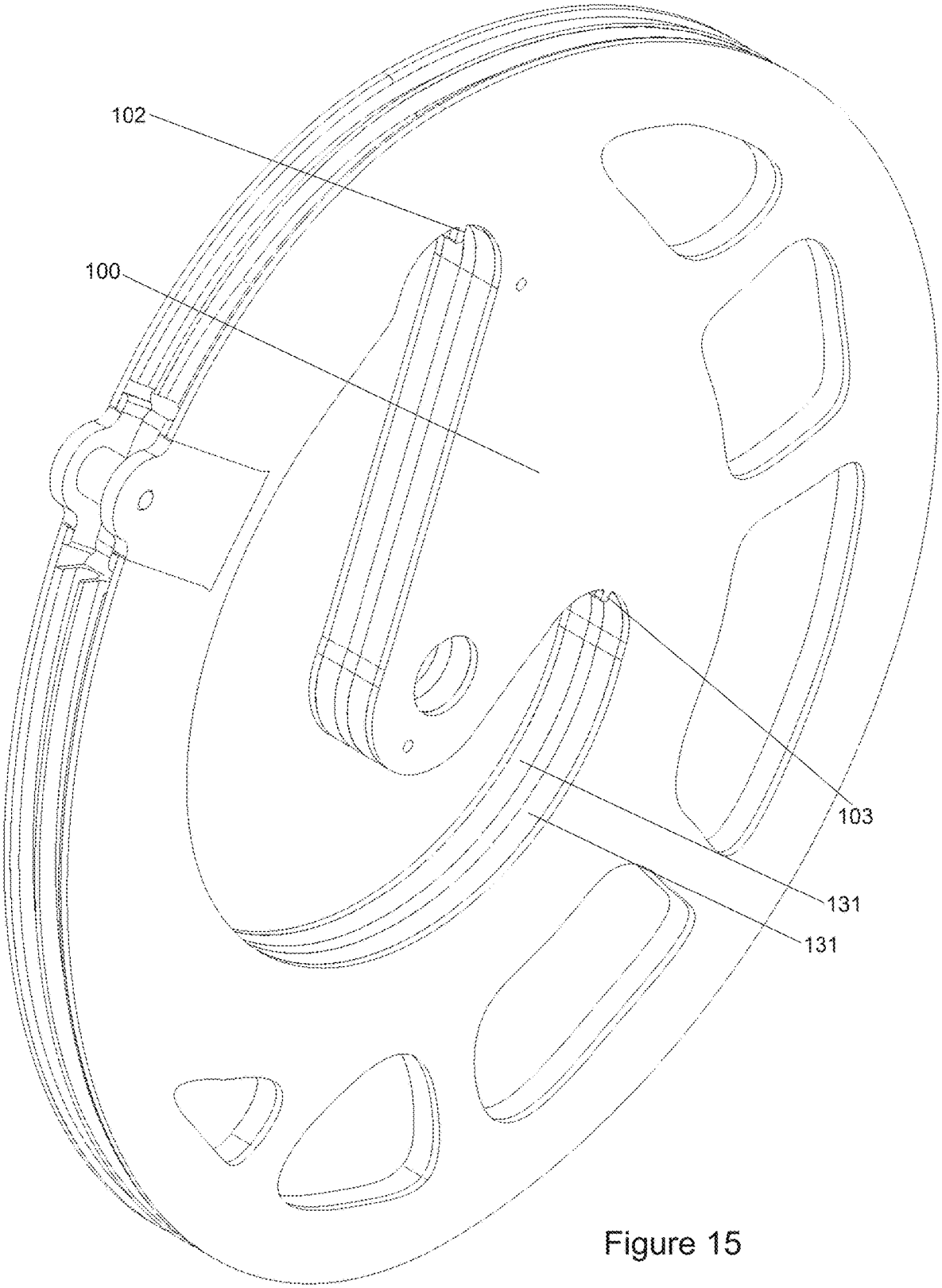
FIG. 15 is an isometric view of the completed cam assembly, showing the relationship of the cam track to the outer plates and indicating key points that define the draw length and maximum spring extension.

FIG. 15 is an isometric view of the completed cam assembly, designated as 100. This view highlights the finished structure of the cam and its functional surfaces. As previously noted, this design is adaptable to achieve nearly any desired draw-force profile by adjusting key elements. The string grooves can be fabricated and installed in custom configurations (see FIG. 14) to allow fine-tuning of draw length and cam synchronization.

The overall outer circumference of the cam determines the effective range of draw length, while the base geometry of the string grooves works in concert with the cam track, 131, to achieve the intended force profile. The cam track itself is visible in this view as 2 hardened steel rolling surfaces 131, which span from a minimum radius region near point 103 to a maximum radius region near point 102. The radial difference between 103 and 102 directly sets the maximum extension of the axial tensile springs over the draw and release cycle, and thus sets the total stored energy of the system.

Fine-adjustment tabs 102 and 103, located at the extreme ends of the cam track, are also used for fine-tuning the start and end of the draw cycle. In practice, these points can accommodate small diameter variations in the multi-roller shuttle's central roller (described in detail with FIGS. 17 and 18) or to adjust the slope at the ends of the cam track for a sharper or softer let-off characteristic.

As noted earlier, the metal cam tracks 131 form the intended rolling surface for the multi-roller shuttle's roller. In this embodiment, the surrounding carbon fiber laminations are drawn flush with the metal surface, but these carbon layers may be abraded back slightly to ensure that the roller contacts only the steel track during operation, minimizing wear and maintaining consistent rolling friction.

For further discussion of the cam's geometric contribution to the bow's operation—including the slope of the cam track and its effect on force-displacement behavior—reference is made to the orthogonal (plan) views provided in FIGS. 35-40.

Figure 16:
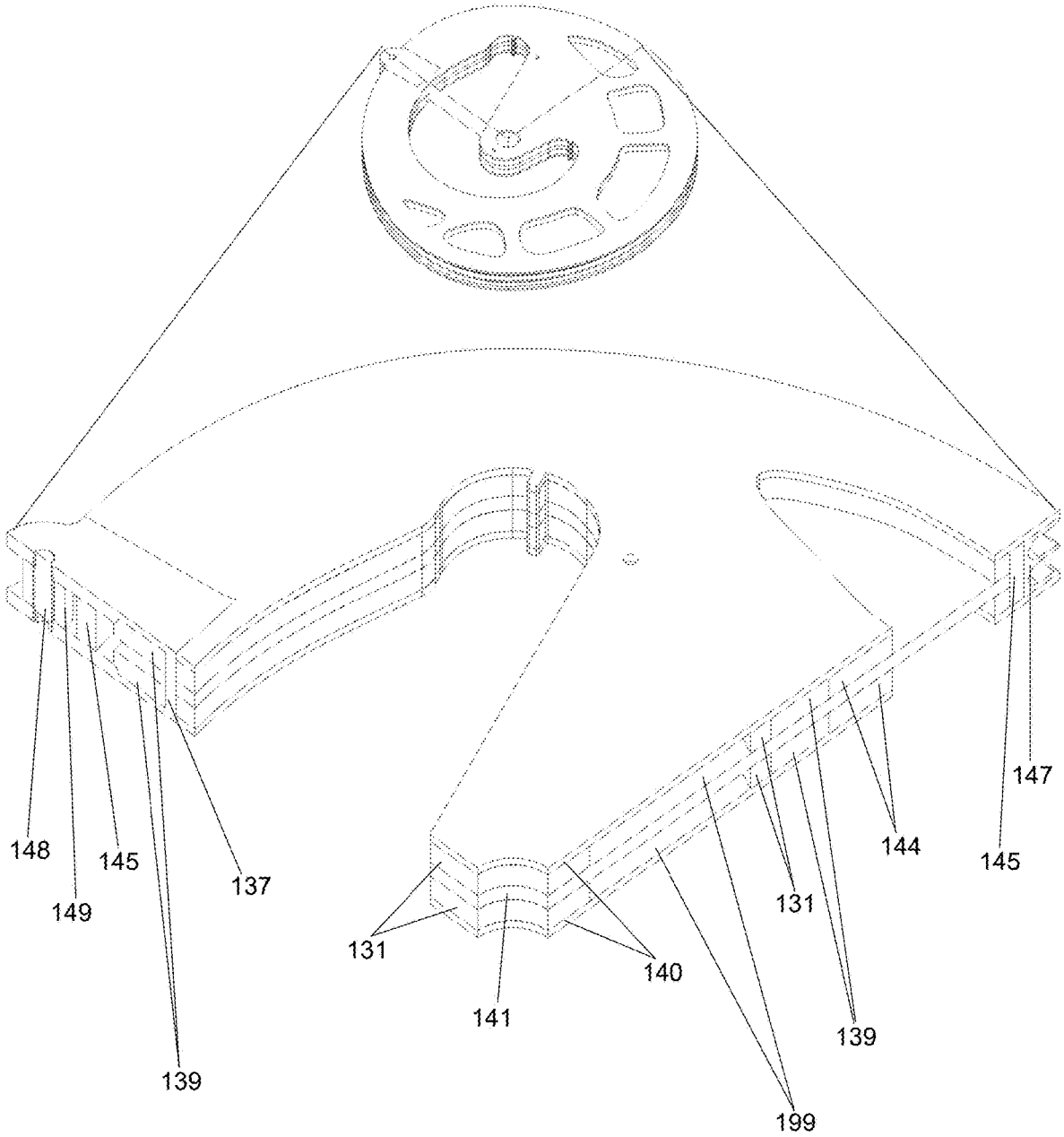
FIG. 16 is an isometric cross-sectional view of 1 quadrant of the completed cam, showing the distribution of materials and internal layering.

FIG. 16 is an isometric cross-sectional view of 1 quadrant of the completed cam assembly 100. For context, the full cam is shown at reduced scale at the top of the figure, with the lower portion illustrating an enlarged detail of the highlighted quadrant. All reference numbers shown correspond to components previously described in FIGS. 11-15, with the exception of 199, which identifies the enclosed hollow chambers present in this embodiment.

This view is particularly useful for examining the material distribution and layering of the cam structure. The construction intentionally combines multiple materials, each chosen for its optimal mechanical properties and suitability in a specific role.

- Steel elements 131 and 148 provide the hardened rolling surfaces for the multi-roller shuttle's roller and the critical clamping for the bowstring ends, respectively.
- Carbon fiber plate elements 140 and 141 form the primary stiffening webs, chosen for their high specific stiffness and excellent in-plane strength.
- High modulus wound carbon layers 139 reinforce the steel cam tracks 131, increasing stiffness and preventing even small elastic deformation during the draw cycle.
- Standard modulus wound carbon layers 145 reinforce the outer periphery of the cam, where stiffness demands are lower but toughness and resilience are beneficial.
- Lightweight structural foam inserts 144 occupy the interior volume of the cam, providing shear transfer between plates and resisting local buckling at minimal mass.
- The string holder insert 137, previously keyed and embedded as shown in FIG. 11, is fabricated from aluminum or titanium to combine lightness with adequate strength and wear resistance.
- The spacer 149, used to protect the bowstring loops from thread damage at the set screw 148, may be fabricated from a lightweight metal or durable polymer.
- The string groove assembly 147, filling the trough around the periphery of the cam, is fabricated from a polymer material, commonly by additive manufacturing (3D printing), providing a lightweight and easily replaceable interface for string tuning.

As noted earlier, all bonded surfaces are assumed to be assembled with epoxy or another suitable adhesive, although this is not explicitly shown in the figure.

This figure serves as a clear summary of the design philosophy behind the cam assembly: to place the strongest, hardest material (steel) only where truly required, while exploiting advanced composites and lightweight fillers elsewhere to achieve a cam that is exceptionally strong and stiff yet reasonably light and manufacturable. While alternative monolithic designs (e.g., all-steel or all-carbon) are conceivable, this layered, hybrid approach offers an advantageous balance of performance, weight, and tunability, as well as practical ease of modification to suit different draw profiles or lengths by altering only selected layers.

Figure 17:
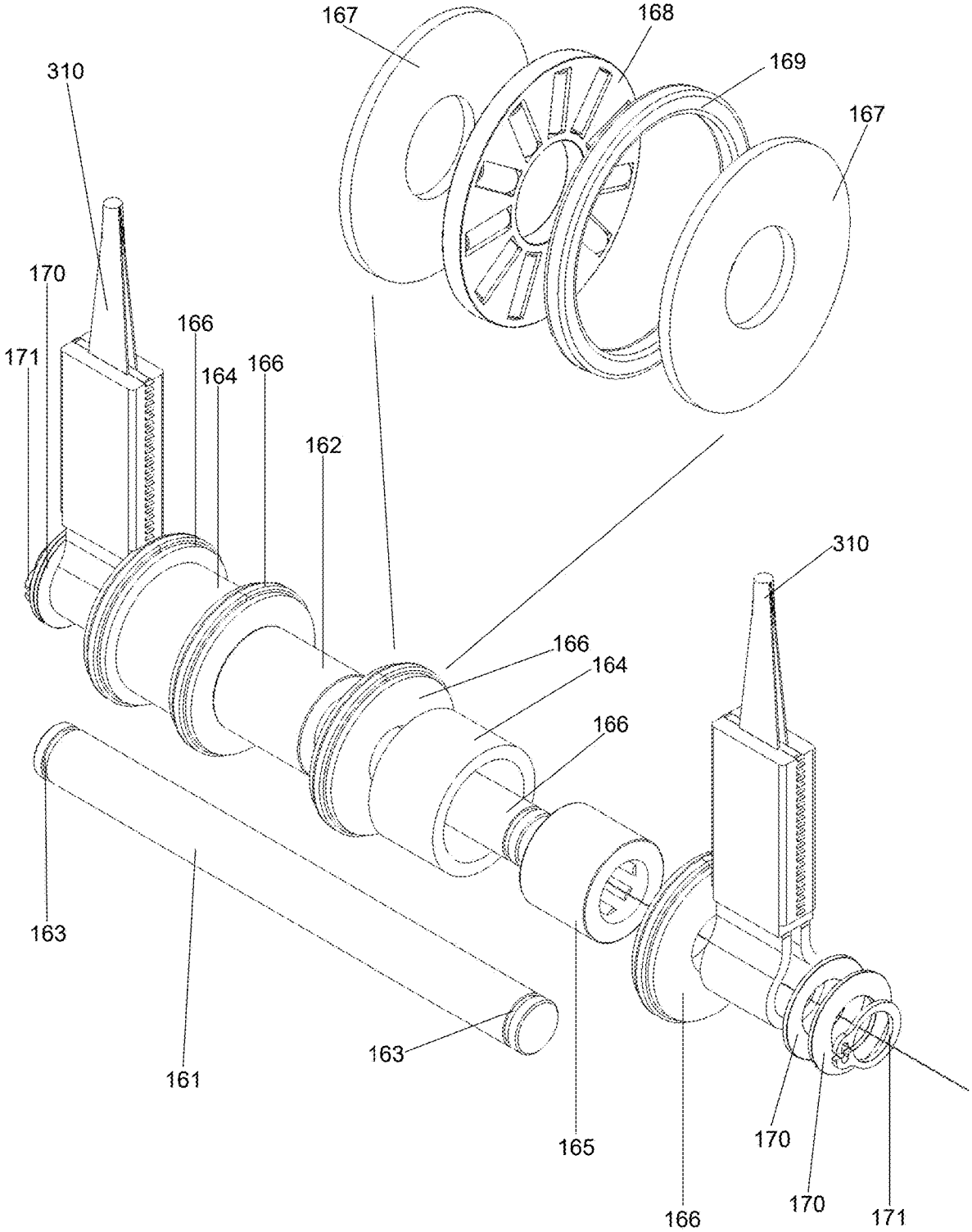
FIG. 17 is an isometric, partially exploded view of the multi-roller shuttle assembly, showing its constituent components along an axial reference line. An exploded view above the main assembly shows details of the thrust bearings.

FIG. 17 is an isometric, partially exploded view of the multi-roller shuttle assembly 160, with an axial reference line indicated for clarity.

As used herein, the term "multi-roller shuttle" refers to a moving assembly that translates along a path defined by the cam track and guide track. The shuttle includes at least three functional elements:

1. One or more cam rollers, which engage a cam track surface to receive motion as the cam rotates;
2. One or more guide rollers, which constrain the shuttle to follow a predetermined path (typically defined by a guide track surface); and
3. One or more spring attachment features, which connect the shuttle to one or more axial tensile springs.

Figure 18:
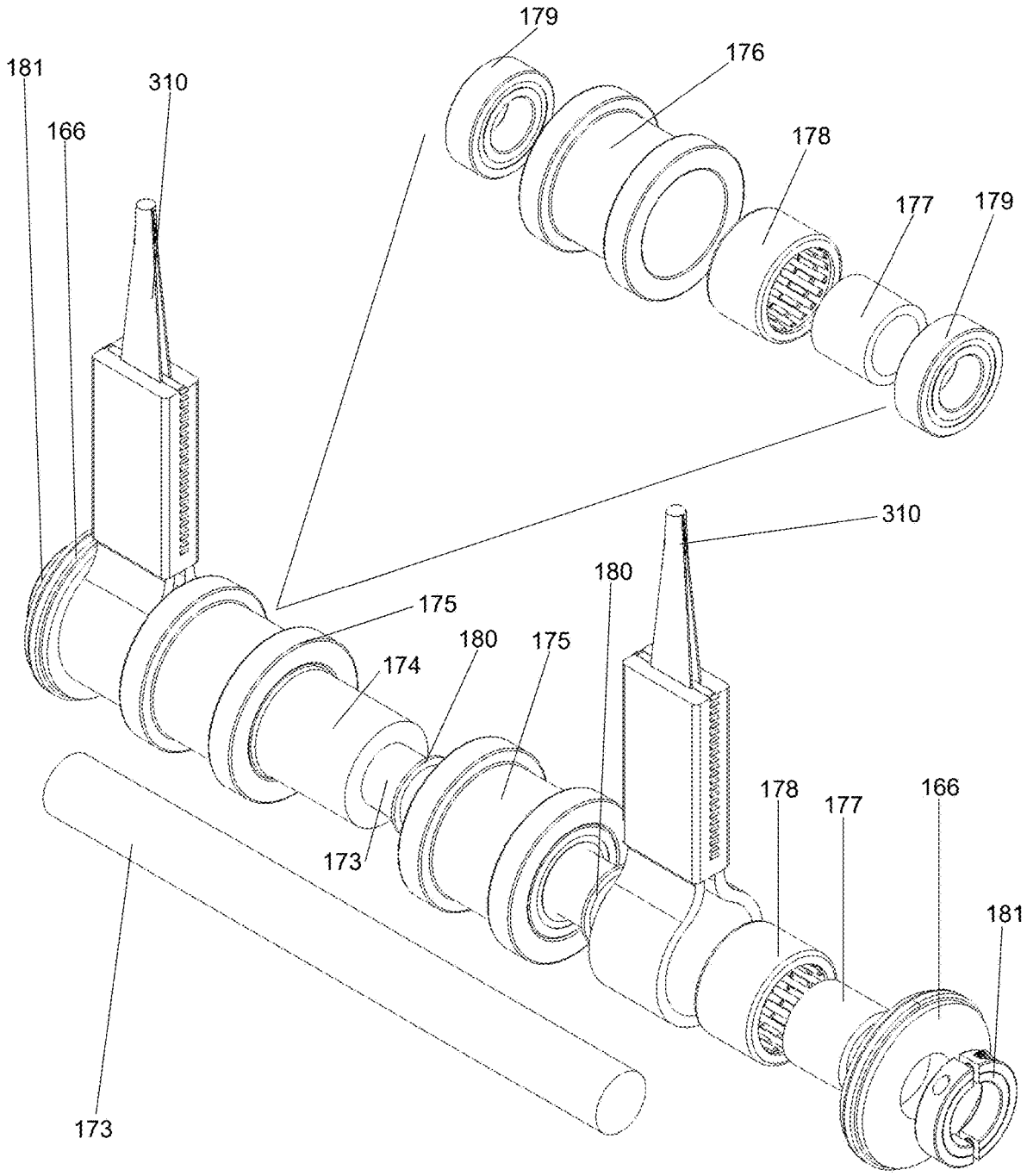
FIG. 18 is an isometric, partially exploded view of an alternative multi-roller shuttle assembly configuration, with an axial reference line. The carbon fiber axle, bearing components, and flanged rollers are shown assembled at bottom, while a detailed breakout of the multi-component guide roller is shown at top.

These elements may be structurally integrated in various ways: any of the three functional groups may be fixed relative to a common axle or shuttle body, while the others rotate independently about that structure. In some implementations, all elements may rotate freely about a shared axle using separate bearings; in others, one or more components may be fixed. The configuration shown in FIG. 17 fixes the cam roller to the axle, while FIG. 18 shows the spring attachment and guide rollers rotating about a central shaft. Other combinations are possible.

The shuttle supports multiple rollers that independently engage these guiding surfaces to transmit force between the cam module and the tensile spring assembly while allowing controlled movement along a predetermined trajectory.

This assembly provides the critical rolling interface between the cam (described previously) and the axial tensile springs (described in conjunction with FIGS. 23-27). Although discussed in this section for functional continuity, the multi-roller shuttle is not mechanically affixed to the cam; rather, it is continuously urged into rolling contact with the cam track by the spring tension and remains mechanically independent of the cam body.

The multi-roller axle itself, 161, is shown both in the assembly view and separately below for clarity. It is a hardened steel shaft, ground and polished to high precision to function as the inner race for needle roller bearings without separate inner rings. The shaft must resist significant radial and bending loads with minimal elastic deformation, and its surface hardness and finish must be adequate to maintain bearing life and low rolling resistance under high contact stress. The shaft has only 2 additional features: shallow grooves 163 near each end, which accept retaining rings to axially locate the stack of components.

As used herein, the term "cam roller" refers to one or more rolling elements that interface between the cam track and the multi-roller shuttle. Each cam roller may be a discrete bearing element that rotates about a translating axle, or may instead be implemented as a rotating portion of the axle itself that rolls directly along the cam track surface. In all cases, the cam roller functions to convert angular motion of the cam into linear displacement of the shuttle.

At the center of the assembly is the cam roller, 162, which interfaces directly with the steel cam track to convert cam rotation into axial movement of the multi-roller shuttle. This roller rotates about 161 via a precision needle roller bearing. These bearings (sometimes called "full-complement needle bearings with solid outer rings" or precision track rollers, as opposed to thin-shell drawn-cup types) provide exceptional radial load capacity and a hardened, concentric outer surface suitable for rolling contact against the hardened steel cam. The solid outer ring construction minimizes elastic deformation and rolling resistance while maintaining geometric stability under load, making them preferable to drawn-cup types in this application. Roller 162 operates very close to its rated load limits, making size selection and surface quality of the shaft and cam track critical.

As used herein, the term "guide roller" refers to one or more rolling elements that interface between a guide track surface on the riser and the multi-roller shuttle. Each guide roller may be a discrete bearing element that rotates about a translating axle, or may instead be implemented as a rotating portion of the axle itself that rolls directly along the guide track surface. In all cases, the guide roller constrains shuttle motion to a predetermined path during cam rotation.

On each side of 162 is a guide roller 164, over a bearing 165, which together constrain the multi-roller shuttle to remain in its plane of motion by rolling along a fixed track surface embedded in the straight riser assembly. Bearing 165 will generally be of similar diameter and quality as roller 162, but with a hardened steel roller 164 over it, adding additional strength and friction reduction through increased diameter. Space constraints are less severe for the guide rollers 164 than for the cam roller 162, allowing for this increased diameter. These rollers also rotate about 161, but must rotate independently of both the axle and the cam roller. To accomplish this, each is isolated from 162 by an axial thrust bearing assembly 166, and from the cam-side spring end 310 by another 166 thrust bearing. Each 166 is illustrated in detail in the breakout view above the assembly: it consists of a hardened steel thrust washer 167, an axial needle roller thrust bearing 168 with an elastomeric seal 169 around the periphery to exclude contaminants and a second hardened washer 167. Other commercially available thrust bearing configurations could be used. In this configuration, the guide rollers 164 and the cam roller 162 can each rotate at their own rate relative to the axle and to each other, while maintaining alignment and smooth motion.

At each end of the axle assembly, the end of a cam-side axial tensile spring 310 is attached to a termination fitting that engages the shaft. The spring ends are radially stationary, so another thrust bearing 166 is required between the spring end and the adjacent guide roller.

Because the multi-roller shuttle stack is assembled "full" along its length, but includes compliant elements (the thrust bearings) that cannot tolerate excessive axial clamping force, the assembly is only lightly preloaded. This is achieved using pairs of spring washers 170 (commonly known as Belleville washers, a generic term for conical spring washers), 1 pair at each end of the shaft. These washers provide a controlled, limited preload force sufficient to eliminate rattle and maintain bearing contact while protecting the bearings from overload. Unlike the non-translating axle assembly (FIG. 10), which is a rigidly clamped stack with solid inner rings carrying compressive torque, the multi-roller shuttle is a spring-preloaded, compliant stack designed for controlled axial freedom and minimal drag.

The assembly is held together by retaining rings 171, which engage grooves 163 and keep the axial stack intact. The lightly preloaded configuration with spring washers ensures that the components remain properly positioned and free of play without risk of over-tightening or bearing damage.

The multi-roller shuttle assembly remains continuously pressed into rolling contact with the cam track by the stored spring force and moves in response to cam rotation, transmitting load to the springs while remaining mechanically separate from the cam.

FIG. 18 illustrates an alternative embodiment of the multi-roller shuttle assembly of the type shown in FIG. 17. As the present invention's only assembly undergoing significant translational motion during firing, low mass for the multi-roller shuttle is crucial for energy efficiency and vibration reduction. The embodiment in FIG. 18 places severe compressive stress on cam roller 162. The embodiment in FIG. 18 intends to reduce the mass of moving components, strengthen the cam roller, and demonstrate further variations on the same design principles. Though different in many respects, it maintains equivalent diameters and spacings of the rollers. In this embodiment, the axle 173 is a uniaxial high modulus carbon fiber rod, with no grooves or other features, and with improved stiffness-to-weight ratio over steel. By increasing the diameter slightly and choosing a higher modulus fiber and high fiber volume fraction laminate, the carbon axle can match the stiffness of steel at a fraction of the weight.

The center rolling element is a hardened steel ring 174 with the same diameter of cam roller 162 in FIG. 17, and an inner diameter allowing adhesive bonding directly to the carbon axle 173.

On either side of 174 are 2 flanged guide roller assemblies 175, designed to mimic the function of 164 plus 166 in FIG. 17 while improving robustness and eliminating thrust bearing stacks. Each 175 assembly is shown in exploded detail at the top of the figure: a hardened steel flanged roller body 176 incorporates both flanges and a precision outer race; a drawn cup needle roller bearing 178 sits inside 176; and a hardened inner ring 177 interfaces with the carbon axle 173 to provide a precise, hard bearing surface. Deep groove ball bearings 179, or other bearings resisting incidental thrust loads, are installed at each end of 176 to provide thrust load capacity.

In other embodiments, 175 can be replaced with a commercial double-flanged guide roller with thrust rating, if desired. Thin washers 180 are added on each side of 175 to ensure proper bearing stack preload and alignment.

Figure 27:
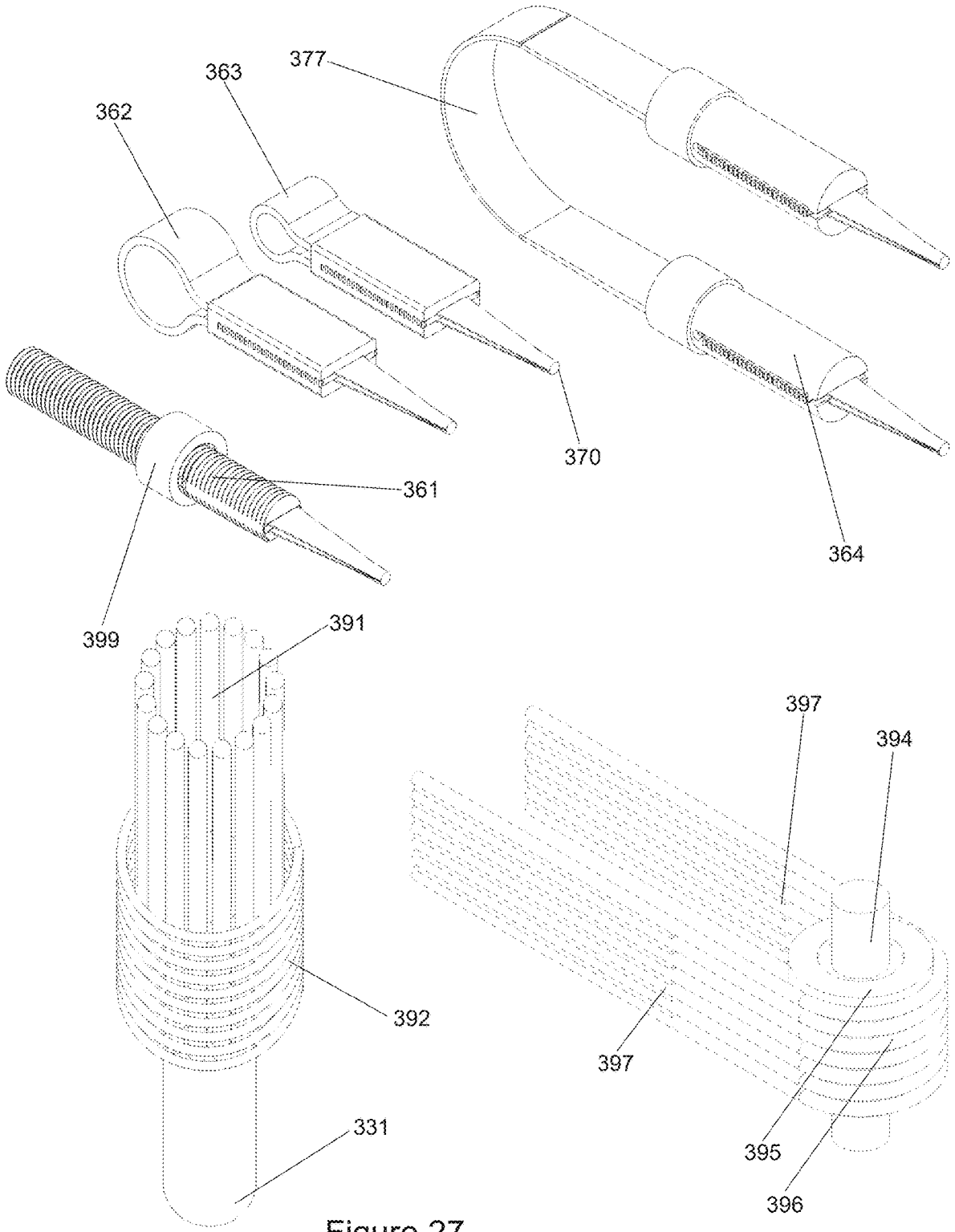
FIG. 27 shows additional embodiments and assembled configurations of axial tensile spring terminations, including tension screw, loop connectors, ribbon connectors, permanent polymer-fiber joiners, and an all-polymer spring with an integrated roller section.

The spring terminations of cam-side springs 310 in this embodiment correspond to style 362 shown in FIG. 27 and use the same bearing stack concept as the 176 guide rollers: each spring end houses a drawn cup needle bearing 178, an inner ring 177, and thrust washers 166 on the distal side to allow independent radial rotation of the axle while keeping the spring ends stationary. In the FIG. 17 embodiment, the axle didn't rotate and the springs were fixed to the axle. In this embodiment, the axle turns with the cam roller, necessitating the bearing system just described.

Since the carbon axle cannot tolerate grooves or clamping pressure from set screws, end restraint is accomplished with 2-piece clamp-style shaft collars 181, which apply uniform radial clamping pressure without localized fiber damage. These collars also allow very fine preload adjustment on the bearing stack, unlike retaining rings with fixed grooves. The user can simply assemble the components, then slide 1 collar into position until the components are snug but the bearings remain free, and tighten the collars.

This embodiment demonstrates several tradeoffs relative to the design in FIG. 17. By allowing the axle itself to rotate, this design moves the high contact stress from a bearing to a solid steel ring at 174. It also shifts more complexity to the spring terminations, which now require radial bearings, but reduces moving mass and improves the load margin on the rolling elements. Elements of both embodiments can be mixed and matched as needed for the application.

The cam assembly and associated multi-roller shuttle represent the heart of the disclosed bow system. The cam's slope-based profile directly defines the draw force curve, and the combination of a hardened steel rolling surface, high-stiffness carbon reinforcements, and carefully managed tolerances ensures the profile is accurately followed even under extreme loads. As described, many aspects of the cam are highly customizable: the string grooves may be adjusted to tune draw length and synchronization; the cam track profile may be re-cut or re-specified for different let-off characteristics; and the materials and construction sequence are flexible enough to allow incremental changes without requiring a complete redesign.

The multi-roller shuttle designs described in FIGS. 17 and 18 exemplify 2 distinct but complementary approaches to interfacing the cam with the axial tensile springs. In both cases, the axle remains in continuous contact with the cam but is not affixed to it, instead rolling along its profile under precisely controlled loads. The use of hardened steel rolling surfaces, appropriate bearing choices, and proper preload techniques ensures minimal friction and reliable performance.

While the embodiment in FIG. 17 emphasizes simplicity and robust thrust stacking with a stationary axle, FIG. 18 highlights the potential for weight reduction and improved load distribution by allowing the axle to rotate and using a carbon shaft with shaft collars. These configurations illustrate that the disclosed invention is not limited to a single mechanical arrangement but admits variations and optimizations according to the needs of the archer and the constraints of the materials.

In all embodiments, the guiding principle is the same: the cam and multi-roller shuttle together translate rotational input from the archer into controlled, symmetric extension of the axial tensile springs, providing an efficient, adjustable, and mechanically elegant energy storage and release mechanism.

Straight Riser Assembly

The riser of the present invention serves as the primary structural element of the bow, maintaining precise spacing and alignment between the upper and lower axle assemblies under substantial compressive forces. Unlike conventional compound bows, which rely on flexible limbs to store and return energy, the disclosed design stores all energy internally using axial tensile springs housed within the riser itself. Accordingly, the riser must resist not only the usual bending, torsional, and axial loads experienced by a bow during the draw and release cycle, but also the concentrated compression loads imposed by the preloaded internal springs.

In preferred embodiments, the straight riser assembly is formed of 2 parallel, straight hollow tubes joined at intervals by cross-members. This configuration provides several advantages: it maximizes compressive strength while minimizing weight, creates internal cavities large enough to accommodate springs, rollers, and other internal mechanisms, and enables easy assembly and service of internal components. The straight, hollow, symmetric geometry of the straight riser assembly is particularly advantageous for housing the internal energy storage mechanisms in a protected and aligned manner. The disclosed straight riser assembly also maintains fully straight and parallel spring paths through the central window, without requiring diversion rollers or deflection mechanisms to clear the archer's hand. Although alternative configurations with rollers or angled spring paths could be used, the present design avoids their associated friction, noise, and reliability drawbacks by keeping the springs aligned equidistant from the bow centerline.

A further benefit of the disclosed straight riser assembly design is the separation of structural and ergonomic functions. The grip itself is a removable, non-structural component attached to the straight riser assembly. This allows for more flexible grip placement and design, as well as opportunities to incorporate damping materials, electronics, or other features into the grip without compromising riser strength.

In addition, the straight riser assembly design disclosed herein supports the use of standard, repeatable manufacturing techniques. In the illustrated embodiments, the straight riser assembly is a straight, symmetrical assembly that can be produced in left- or right-handed versions with minimal changes. This facilitates lower tooling costs and high repeatability, while preserving the strength and alignment needed for the internal spring configuration. Accessory mounting points, including arrow rest and sight plates, are integrated into cross-members or external features without compromising the structural integrity of the hollow riser tubes.

The straight riser assembly's construction and proportions are selected to balance stiffness, weight, internal clearance, and manufacturability. Various materials such as aluminum, carbon fiber composite, or magnesium alloys may be used, and fabrication may include extrusion, winding, bonding, or machining. The specific details of material selection, wall thicknesses, and manufacturing techniques are left to the skill of the practitioner, as these can be tailored to meet the desired performance targets without departing from the inventive concepts disclosed herein.

The following figures illustrate the straight riser assembly in more detail, including structural features, interfaces with other components, and alternative accessory and spring-routing configurations.

Figure 19:
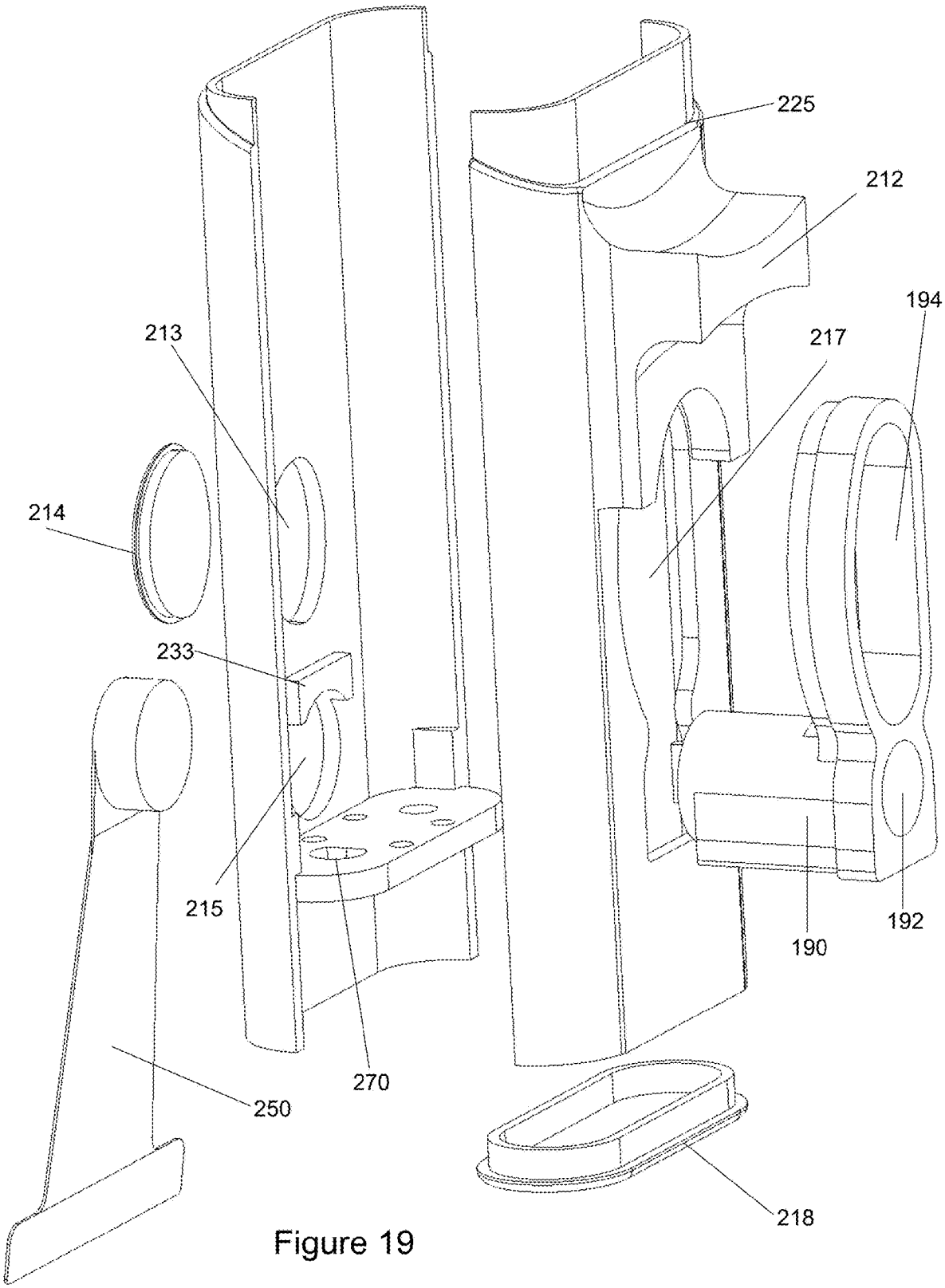
FIG. 19 is an exploded isometric cutaway view of the cam end of a riser tube, showing internal structural features, mounting holes, and the cam guide block.

FIG. 19 illustrates the cam end of the straight riser assembly in an exploded isometric cutaway view, showing structural and service-related details of 1 riser tube and its internal components. The figure depicts the riser tube split longitudinally into left and right sections for clarity; in practice, the riser tube is preferably formed as a single integral piece, such as by extrusion, filament winding, or layup over a mandrel. The sectioning here merely aids in understanding internal features.

On the right side of the figure is the proximal side of the riser tube, which in a fully assembled bow faces the archer. The tube terminates at a thickened portion 225, previously introduced in FIG. 5, which provides additional material around high-load regions. Inside the riser tube is a cross support element 212, representing 1 of several (e.g., ten in the depicted embodiment) such internal cross members distributed along the straight riser assembly's length to improve local and global buckling resistance, distribute loads, and align components. These cross members may be fabricated from the same material as the riser tubes (e.g., aluminum or carbon fiber composite) or made as hybrid structures combining a carbon skin over a structural foam core, such as rigid PVC foam or other closed-cell polymer foams.

At this end of the straight riser assembly, 3 large holes pierce the tube wall to allow installation and maintenance of the cam system. On the proximal side, opening 217 receives the cam guide block 190, which is bonded in place inside the tube. This component passes fully through the tube, abutting the distal edge at opening 215. Above opening 215 is another through-hole providing access for installation and adjustment of the multi-roller shuttle assembly (previously described in FIGS. 17-18). Cam guide block 190 has an internal bore 192 that defines the tunnel through which the fixed cam axle passes, with guide tracks 194 serving as precision bearing and guide surfaces for the guide rollers of the multi-roller shuttle. These surfaces must be hard, stiff, and accurately aligned with the tube axis.

As used herein, the term "guide track surface" refers to one or more precision-machined bearing surfaces that constrain the motion of the guide rollers of the multi-roller shuttle. These surfaces are typically part of the cam guide block and serve both structural and kinematic functions, ensuring that the shuttle follows a predetermined linear path aligned with the riser. The cam guide block includes one or more guide track surfaces and defines the tunnel through which the cam axle passes. It provides the structural foundation and alignment for shuttle guidance, and is typically fixed within the riser.

Also shown is spring tensioning plate 270, which is removably mounted inside the straight riser assembly via bolts. Plate 270 includes a D-shaped hole to accept the keyed spring tensioning bolt, 4 smaller mounting holes for secure attachment to cam guide block 190, and an optional hole for a vibration-damping accessory, as this region is subject to substantial dynamic loads. Non-structural covers and caps are shown as examples of how the straight riser assembly may be sealed or accessorized. Cap 218 is a slip-on end cap for the open end of the tube, while cover 214 is a plug that fills opening 213 after the multi-roller shuttle is installed. Hole 215 may be used for deploying an accessory foot 250 (previously introduced in FIG. 6), shown here rotated into its deployed position. Other accessories, such as dampers, weights, or purely cosmetic covers, may also be installed at these openings as desired.

The internal feature 233 is a reinforcement or indexing shoulder formed on the tube's interior to help locate and bond cam guide block 190 in the correct position.

The depicted embodiment highlights the straight riser assembly's ability to house and support highly loaded internal mechanisms while keeping the structural envelope clean and free from unnecessary penetrations elsewhere, maintaining the straight riser assembly's overall stiffness and strength.

Figure 20:
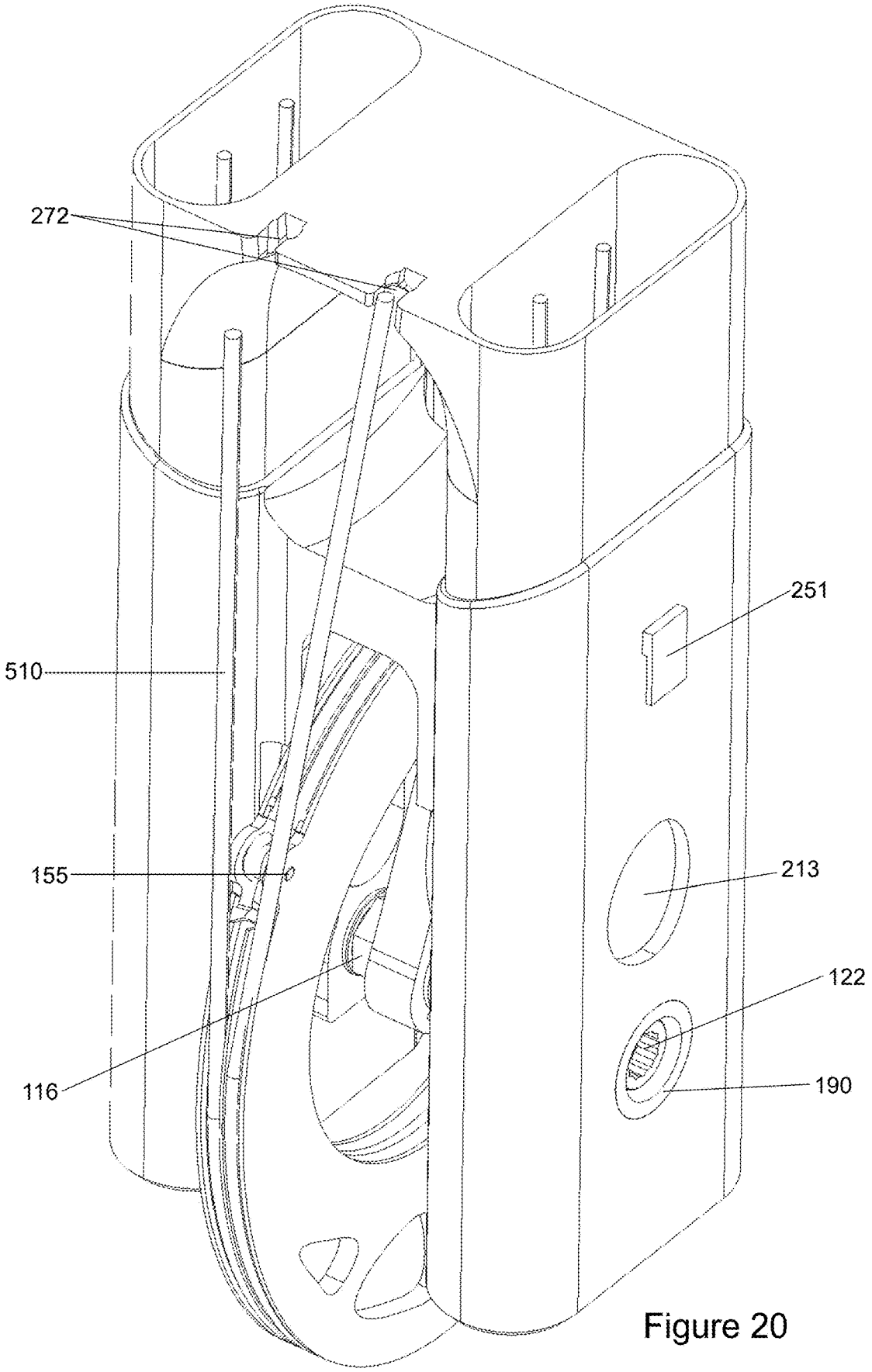
FIG. 20 is an isometric view of the cam end of the riser showing the cam, string routing, crossmember cutout, and access ports.

FIG. 20 shows an isometric view of the cam end of the straight riser assembly, highlighting several components and features not clearly visible in earlier figures. The view depicts the riser tubes assembled, with the cam and string installed.

The cam guide block 190 is visible here only as the exposed ring on the distal side of the right riser tube, where it is bonded into place (as described previously in FIG. 19). Adjacent to this, socket nut 122 is partially recessed into the distal face of the riser tube; this nut secures the fixed cam axle and is recessed to leave room for the optional foot 250 (not shown here). The flanged hex nut 116, introduced earlier in FIG. 10, is seen tightened against the left side of the cam, securing the cam onto the non-translating axle.

Access port 213 is uncovered in this view. During assembly and service, this hole provides access to install and adjust components of the multi-roller shuttle within the straight riser assembly. identical access holes exist on both riser tubes, enabling work from either side.

The bowstring 510 is shown strung and routed around the cam. As depicted here, the bowstring engages the 2 parallel string grooves of the cam and is anchored by fastener 155, which secures both ends of the bowstring to the cam body. The string is routed cleanly around the straight riser assembly structure, passing through cutout 272 in an internal crossmember. This cutout ensures that the string remains straight as it diverts around the forward hand of a right-handed archer. To facilitate manufacture of both right- and left-handed bows from the same components, the cutout 272 is mirrored on both sides of the straight riser assembly.

Also shown in this view is clip 251, which is bonded to the straight riser assembly surface and serves as a simple stowage clip for the optional foot 250 when not deployed.

This view illustrates how the straight riser assembly accommodates the cam and string while maintaining a compact, protected, and symmetrical design.

Figure 21:
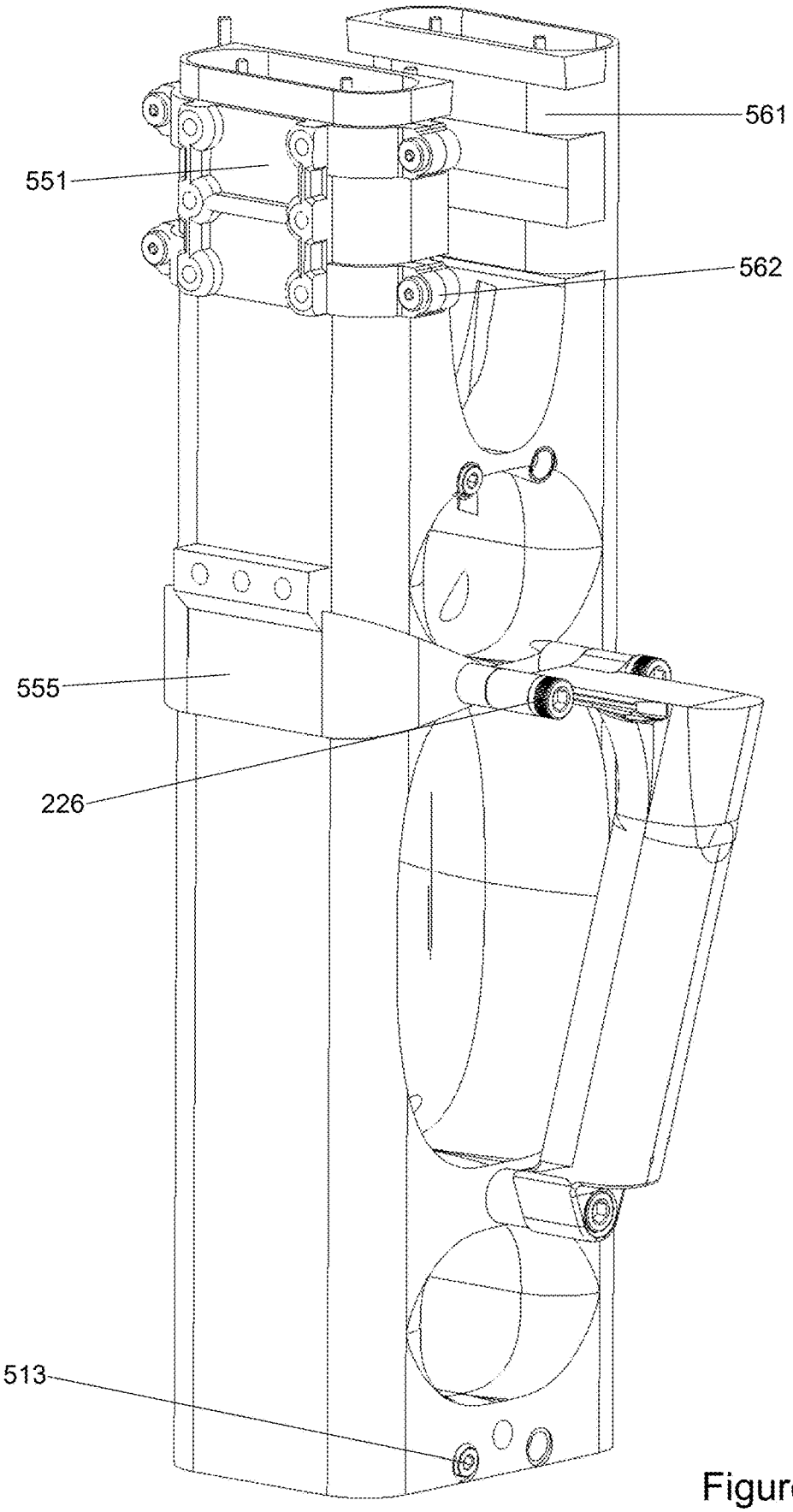
FIG. 21 is an isometric close-up of the riser center section showing sight and arrow rest mounting plates, grip hardware, and accessory mounting points.

FIG. 21 is an isometric close-up view of the center region of the straight riser assembly, illustrating the mounting points for several accessories and how they integrate with the straight riser assembly structure. This view supplements the previous orthogonal figures by showing the spatial relationships of these features more clearly.

Sight mounting plate 551, and arrow rest mounting plate 555, were previously shown in FIGS. 7 and 8. Here, the isometric perspective emphasizes how securely these critical components are mounted, which is important to archers since even slight movement of the sight or rest can noticeably degrade accuracy.

Sight mounting plate 551 is fixed to the straight riser assembly via a clamping system. The riser tube has an externally machined or molded locating groove 561, which ensures repeatable and precise positioning of the sight. The 2 halves of the sight plate are joined around the riser tube by 4 bolts 562, tightening the clamp against the groove. The sight assembly itself is mounted to the right riser tube in this view, but this configuration is fully symmetric to accommodate left- or right-handed use.

Arrow rest mounting plate 555 is secured differently, but also achieves excellent rigidity. Here, the plate is fastened to 1 of the internal riser crossmembers rather than the riser tube itself. This avoids introducing holes into the tube wall while still providing a robust mounting point. 1 end of plate 555 is held by mounting screw 226, which also serves as 1 of the bolts securing the grip (discussed more clearly in FIG. 22).

This view also shows that the internal riser crossmembers can be used to support additional accessories beyond structural reinforcement. For example, bolt 513 here anchors a string diverter pulley assembly (shown elsewhere), demonstrating that the crossmembers provide versatile mounting real estate while contributing to overall riser stiffness and buckling resistance.

This figure also discloses 2 common approaches to securely attaching accessories to riser tubes that should remain free of through-holes: (1) clamping around the tube using locating grooves, and (2) tapping into or integrating fasteners in the crossmembers. Although neither of these techniques is novel in itself, they are disclosed here to establish prior art and to fully describe the working embodiment of the straight riser assembly.

Figure 22:
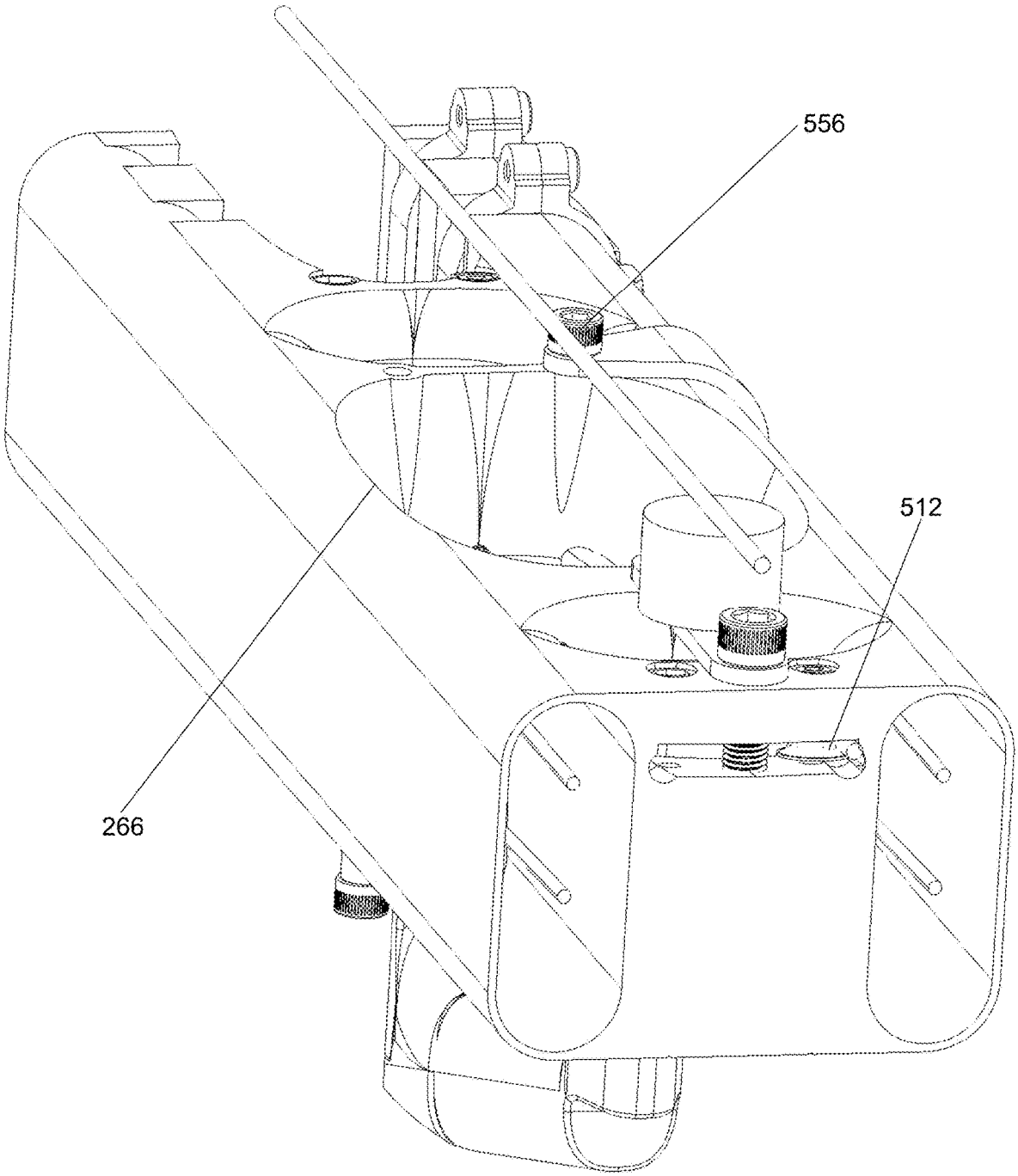
FIG. 22 is an isometric bottom view of the central riser section showing the placement of the lower string diversion pulley, the arrow rest mounting bolt, and the riser window accommodating the straight spring paths.

FIG. 22 is an isometric view of the central portion of the straight riser assembly, viewed from below, supplementing FIG. 21 by showing features otherwise obscured. The lower string diversion pulley 512 is visible here, located within a riser cross member. The diversion pulley 512 allows the bowstring to pass cleanly around the archer's forward hand without interference, while maintaining proper alignment through the riser window. The pulley 512 is mounted on an axle that is secured to the cross member using fasteners, such as screw 513 previously shown. Bolt 556 is also visible in this view, securing the rear portion of the arrow rest mounting plate (not shown) to a cross member. This arrangement avoids piercing the riser tube walls, preserving their strength while providing a secure attachment point for the arrow rest.

Feature 266 is also indicated, representing the maximum lateral width of the riser window, which is designed to accommodate the archer's forward hand, the arrow rest, and the arrow itself, while ensuring that the axial tensile springs remain straight and aligned on either side of the centerline. This straight spring path eliminates the need for additional rollers or diversion mechanisms for the springs themselves.

This view emphasizes how the riser geometry, including the placement of cross members and the open window, accommodates accessories and the archer's hand while preserving the straight, symmetrical routing of the axial tensile springs.

Certain features of the upper section of the straight riser assembly will be discussed with the spring folding idler assembly, FIGS. 28-32.

Axial Tensile Springs

Bow 10 employs an energy storage system based on 1 or more axial tensile springs. As used herein, the term axial tensile spring refers to a substantially 1-dimensional elastic member that stores potential energy when placed under tension along its longitudinal axis. Unlike beams or coils, which store energy through bending or shear deformation and which necessarily include material at a neutral axis or other regions that contribute less efficiently to energy storage, an axial tensile spring utilizes essentially all of its material volume in tension and achieves near-optimal specific energy storage.

Any solid material may be used to form an axial tensile spring, but few materials have the properties required for the disclosed invention. Desired properties include:

1. High energy return, i.e., how much of the energy used to elongate the spring can be reclaimed for launching an arrow. Most elastomeric plastic or rubber materials have inadequate energy return, as do most natural or synthetic materials in rope such as hemp or nylon.
2. Adequate yield or failure elongation. Steel and many other metals have excellent energy return, but very low failure elongation (typically 0.5%: a music wire tensile spring would need to be 200 inches long to stretch 1 inch before yielding). Representative elongation values for common composites are significantly higher. Carbon fiber can achieve values closer to 1.5%, electrical glasses (E-glass) up to 3%, and structural glasses (S-glass) over 4%. (As used herein, the term 'S-glass' refers to high-strength glass fiber, commonly marketed under trade names such as S-2 Glass® (by Owens Corning) and occasionally referred to generically as high-modulus glass or structural glass in technical literature.)
3. Minimal creep. Most materials "creep" under constant heavy loads, as experienced by a preloaded spring, meaning that the tension will decrease over time if the length is fixed.

Axial tensile springs described here are fabricated from materials that are typically rigid in bulk form, such as glass fibers, basalt fibers, aramid fibers, ultra-high-molecular-weight polyethylene fibers (UHMWPE), or other low stretch polymers, configured into a long, narrow element that can stretch elastically within its tensile limits. The spring may be formed from isotropic or anisotropic materials; when formed from unidirectional composite materials, the fibers are aligned parallel to the tensile axis to maximize strength and elongation.

Elongation closer to 10% would be ideal for the present invention, but few materials in this range have adequate energy return or creep performance. In the illustrated embodiment, the bow includes 2 folded axial tensile springs housed within the hollow riser tubes. Each spring consists of a pair of legs running longitudinally within the straight riser assembly, anchored at the lower and upper ends by attachment assemblies. The folded configuration allows the use of springs approximately twice the riser length within a compact bow form factor.

The spring material and geometry may vary. In the illustrated embodiment, the springs are approximately 60 inches in total length and operate at about 4% elongation under full draw, with a portion of that elongation allocated to preload and safety margin. Materials such as S-glass/epoxy composites are particularly well suited to this application, providing high specific energy density, appropriate elongation, and acceptable durability. Other materials such as E-glass, carbon fiber, aramid (e.g., Kevlar®), poly (p-phenylene-2,6-benzobisoxazole) (PBO), or Dyneema® UHMWPE may also be used, with appropriate adjustments to length and number of legs to achieve the required energy storage and travel.

In practice, the springs may be fabricated from commercially available pultruded rods or custom-wound and impregnated by hand. While S-glass with high-quality epoxy is preferred for performance reasons, such pultruded rods are not widely available, and hand-fabricated springs have been found to outperform available E-glass pultrusions. Accordingly, both pultruded and hand-wound spring terminations are illustrated and described in the following figures.

It is to be understood that the illustrated configurations and materials are exemplary and not limiting; any material and number of spring legs providing the necessary elongation and energy storage within the dimensional constraints of the bow may be used. Likewise, while the illustrated embodiment shows 2 spring legs per spring, configurations with more than 2 legs, or with unfolded single legs of longer length, are within the scope of the invention.

FIGS. 23-27 illustrate exemplary embodiments of the axial tensile spring assemblies and their attachment systems.

Figure 23:
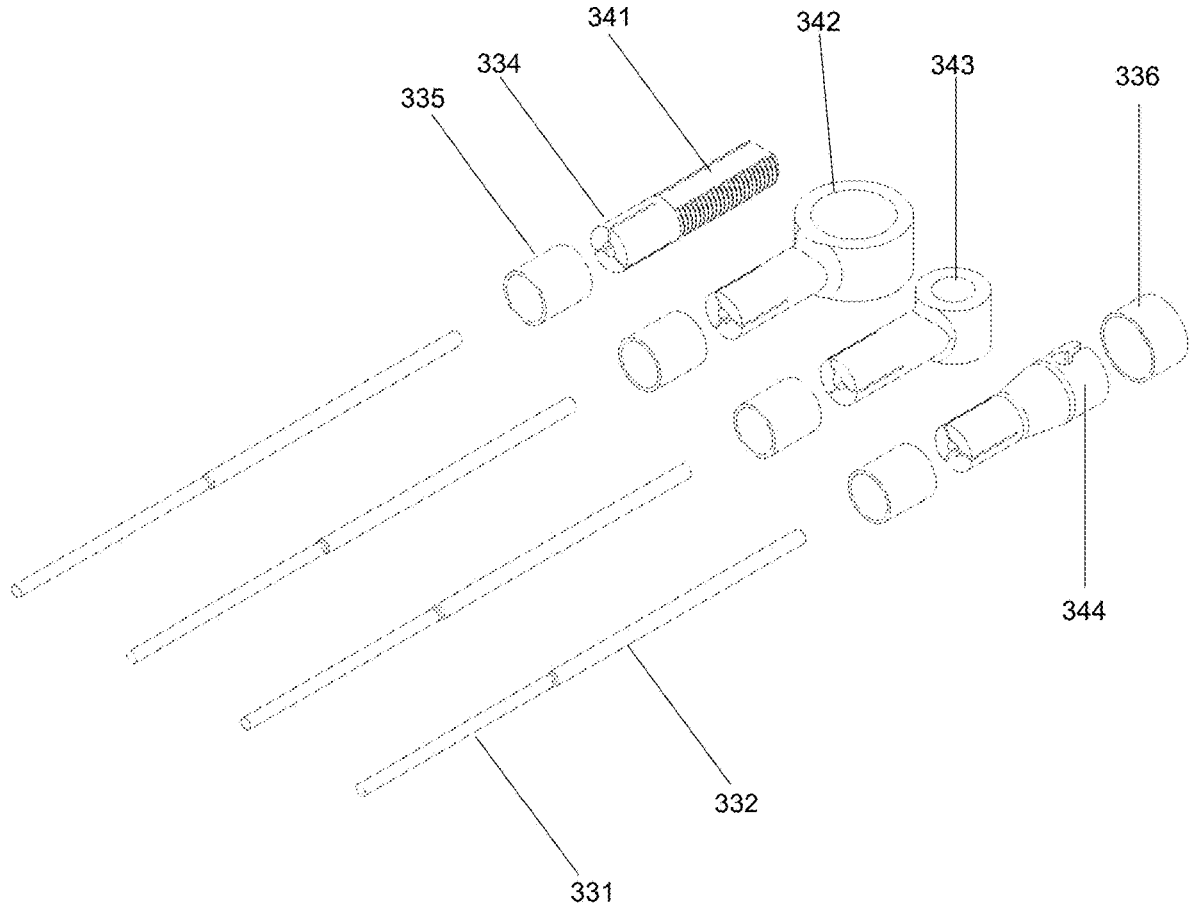
FIG. 23 shows an exploded view of an axial tensile spring assembly employing a commercially produced rod with butted ends and a mechanical termination system, including split collets, crimp collars, keyed bolt, loop connectors, and ribbon connector.

FIG. 23 shows an exploded view of an axial tensile spring assembly employing a commercially produced cylindrical rod. Such rods may be fabricated from S-glass/resin composites with an appropriate fiber-to-resin ratio and cure conditions, but could also include other materials previously mentioned provided the rod exhibits sufficient tensile strength, elongation, and dimensional consistency. The defining feature of this embodiment is that the rod 331 has a consistent diameter suitable for precise mechanical joining. In some implementations, the rod includes butted ends 332, increasing cross-sectional area locally to mitigate stress concentrations and improve joint strength at these high-load regions.

This attachment system utilizes 3 mechanisms to secure the spring termination to the rod: adhesive bonding (e.g., epoxy), mechanical clamping, and hoop-strength reinforcement of the joint. In the illustrated embodiment, the butted end of rod 331 is inserted into a split collet 334, analogous to a 3-slit collet as used in machining, which provides radial clamping when compressed. Crimp collars 335 are pre-installed on the rod, then slid back over the split collet and crimped to uniformly apply radial compression, securing the connection. Although an internally threaded collar and externally threaded collet could also be used, the illustrated crimp collar is preferred for its simplicity and uniform compression. Any suitable adhesive may also be applied within the joint for additional strength. 4 rod terminations are shown, each using the same collet, crimp, and adhesive joining method.

Additional components in FIG. 23 illustrate these alternative termination elements. Keyed bolt 341 is designed for tensioning the spring. It will pass through a keyed plate and be tightened with a nut. Keying is necessary to prevent twisting of the spring during tension adjustment. Loop connectors 342 and 343 enable the spring to be draped over an axle at either a rotating or non-rotating interface, depending on the assembly point. Connector 344 enables the attachment of a ribbon element to the spring, as will be described in connection with FIG. 25.

It is to be understood that the illustrated attachment system is exemplary and not limiting; a variety of fastening mechanisms—including adhesives, mechanical locks, swaged fittings, or other techniques—may be employed to connect the tensile spring to the bow structure while preserving strength and maintaining compact form factor.

Figure 24:
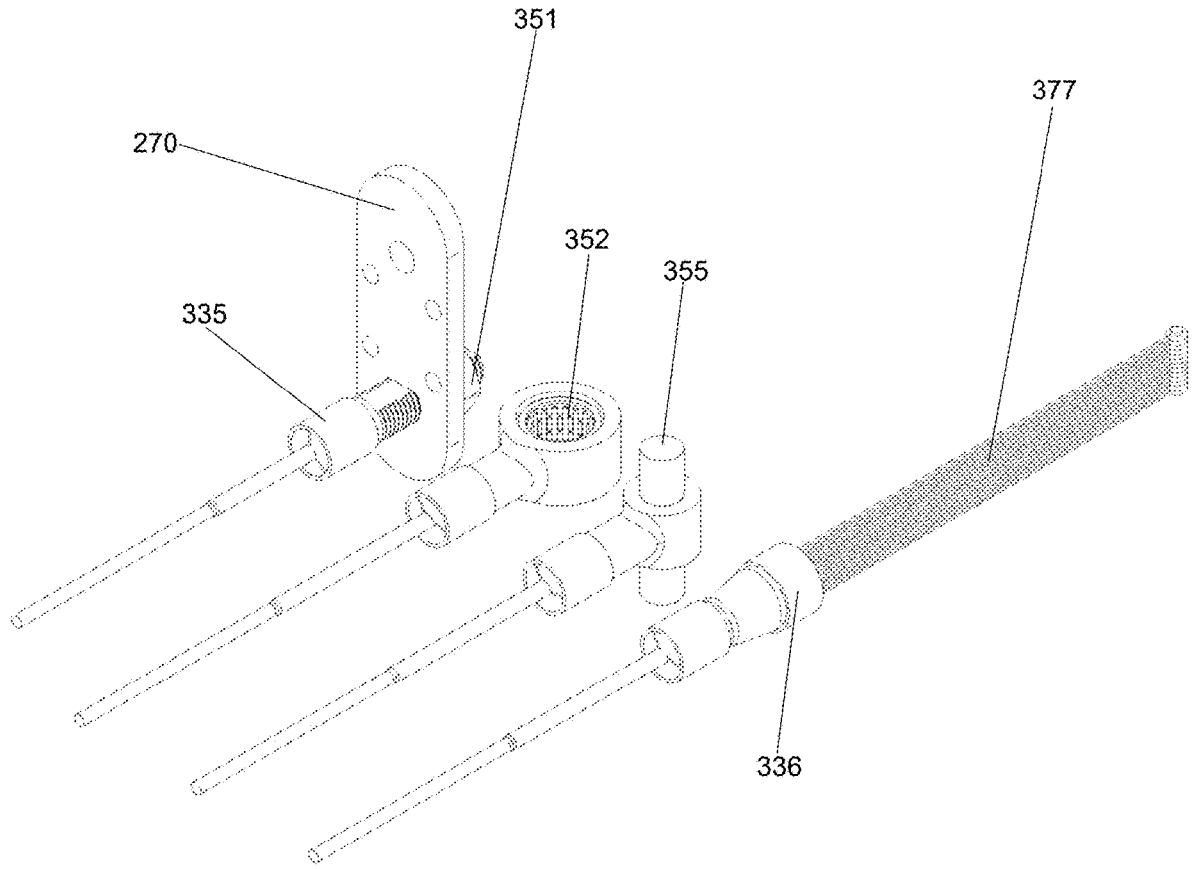
FIG. 24 shows the 4 spring termination configurations fully assembled, including a crimped and epoxied split collet, keyed spring tensioning plate with nut, bearing-supported rotating fitting, fixed non-rotating fitting, and ribbon connection with crimped collar.

FIG. 24 shows the 4 termination configurations of the axial tensile spring, fully assembled, as introduced in FIG. 23.

On the left, crimp collar 335 is shown compressed in place over the split collet, which has been epoxied onto the butted end of the spring rod. This combination of adhesive, mechanical clamping, and hoop compression secures the spring rod to its termination.

Spring tensioning plate 270, shown outside its normal position within the straight riser assembly, has a keyed hole through which the keyed tensioning bolt passes. Nut 351 is threaded onto the tensioning bolt to adjust spring preload. Optionally, a jam nut may be added for additional security once the desired tension is set.

Bearing 352 is illustrated in the next termination as a representative example of a bearing element that allows the end fitting to rotate freely about an axle while supporting the high tensile loads of the spring, as is necessary in the alternative multi-roller shuttle in FIG. 18. Bearing 352 may be implemented as a needle roller bearing directly on the axle, as a needle roller bearing with an inner ring over the axle, as another type of rolling-element bearing, or as a plain bearing. While the number of rotations required during operation is relatively small, the bearing must nonetheless accommodate substantial forces without significant deformation or frictional loss. Termination 355 illustrates a non-rotating fitting secured over an axle when no relative rotation is required at the attachment point, as is necessary with the multi-roller shuttle in FIG. 17.

At the right, ribbon 377 is shown secured to the spring rod with a crimp collar 336, which may be of different diameter or length from crimp collars 335. In this embodiment, the ribbon connection does not employ adhesive, allowing either the ribbon or spring segment to be replaced independently in the event of wear or damage. The ribbon connector is described in greater detail in connection with FIG. 25.

These termination examples illustrate that various connection configurations, with or without rotational freedom, and with or without adhesive, may be implemented as needed to suit the mechanical requirements of a given attachment point.

Figure 25:
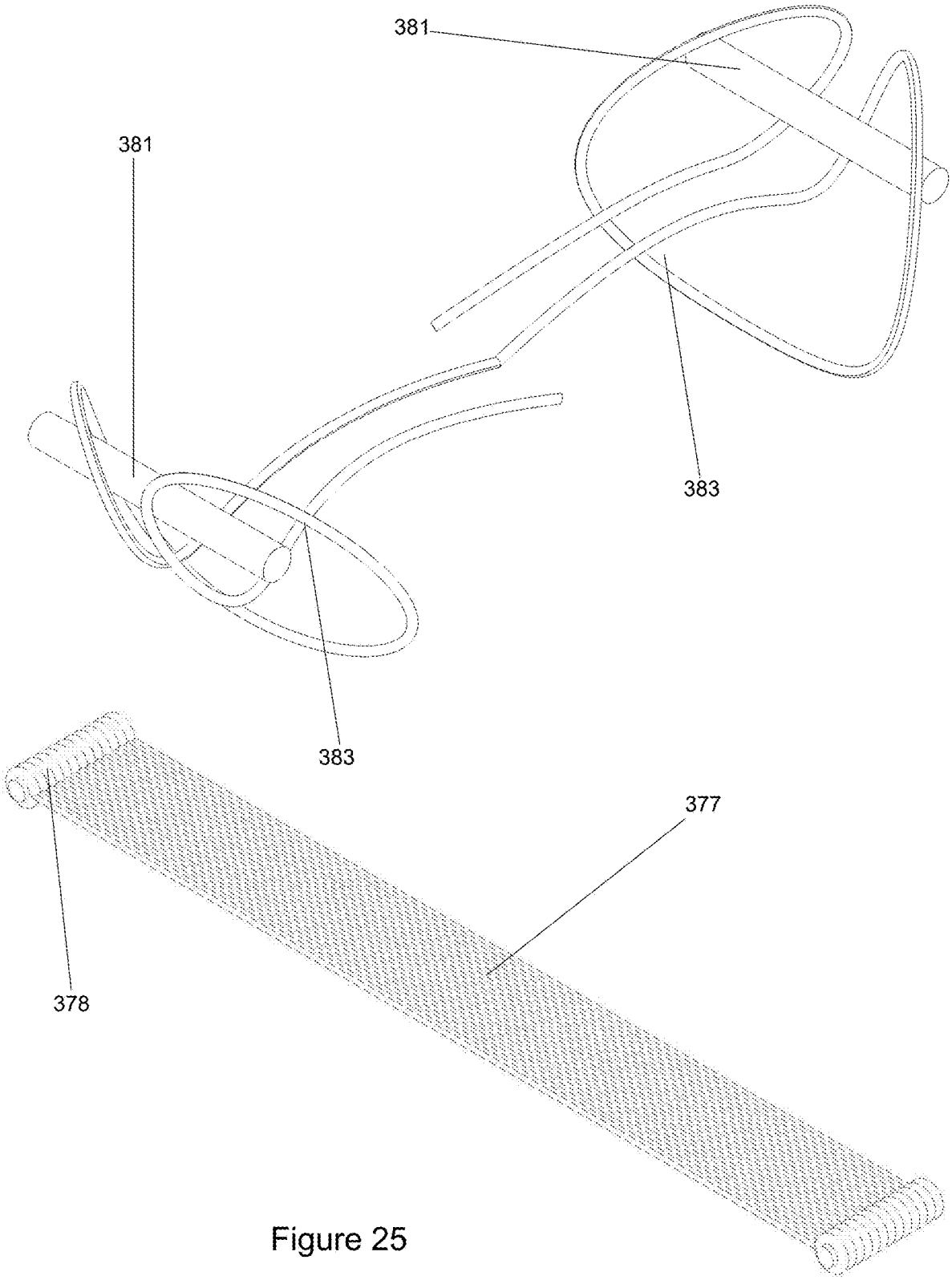
FIG. 25 shows a flexible ribbon connector used as a joiner in the axial tensile spring system, including fabricated ends for mechanical attachment and an exemplary winding method using dowel pins and alternating girth hitches.

FIG. 25 illustrates an exemplary flexible ribbon connector 377, used as a joiner in the axial tensile spring system to allow the spring to fold back over a low-friction roller at the spring folding idler assembly. By enabling the spring to reverse direction in a compact space without excessive bending stress or frictional loss, the ribbon joiner allows an effectively longer spring length to be packaged within the bow straight riser assembly.

The ribbon 377 consists of a plurality of unidirectional high-strength fibers arranged in a flat, ribbon-like geometry. This configuration provides lower frictional losses when draped over a roller compared to conventional round cables, which exhibit higher contact pressure and greater friction at tight radii. The ends 378 of the ribbon are significantly larger in diameter than the ribbon itself, allowing them to seat securely in mounting holes (such as hole 388 in FIG. 26) or in vertical holes of connectors such as 344 in FIG. 23. The larger ends also permit mechanical securing using crimps or other side-to-side stabilizing elements.

One method of fabricating ribbon 377 is also shown in FIG. 25, where 2 dowel pins 381 serve as end mandrels. High-strength fibers, such as UHMWPE or Vectran® bowstring strands, are wound back and forth between the dowel pins to form a flat ribbon. To prevent slippage of individual fibers and maintain ribbon uniformity, alternating girth hitches 383 are tied at each end as winding progresses. Once the desired number of fibers has been laid up to achieve the required load capacity with safety margin, the knots may optionally be stabilized by removing wax from the knot region, applying a low-surface-energy primer, and sealing with epoxy.

In some embodiments, a slotted C-profile pin may be added over each end for added mechanical protection, with the ribbon passing through the slot.

This ribbon joiner is 1 example of a flexible connector capable of sustaining the high tensile loads of the spring system while minimizing frictional loss and creep. Other methods of constructing a high-strength, low-friction flexible joiner may be substituted, and the invention is not limited to the illustrated fabrication technique.

Figure 26:
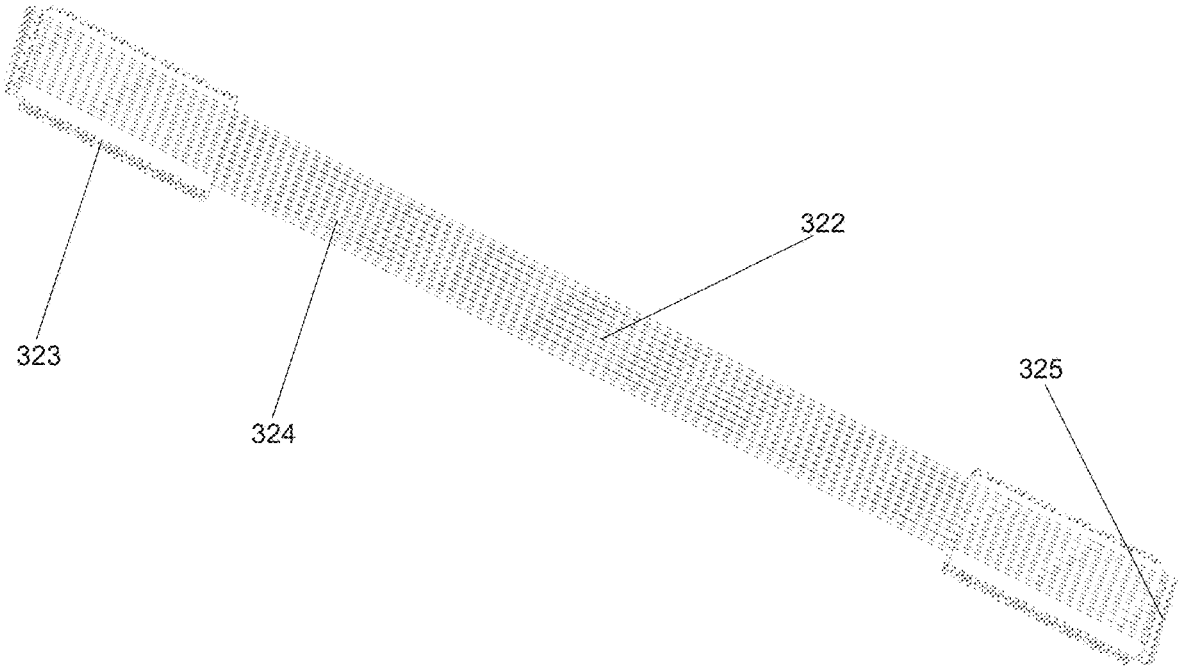
FIG. 26 shows a hand-wound axial tensile spring with toothed end plates and mating connectors, illustrating fabrication, end reinforcement, and interface options including tensioning bolt, loop connector, and ribbon connector with provision for a ribbon end.
Figure 26:
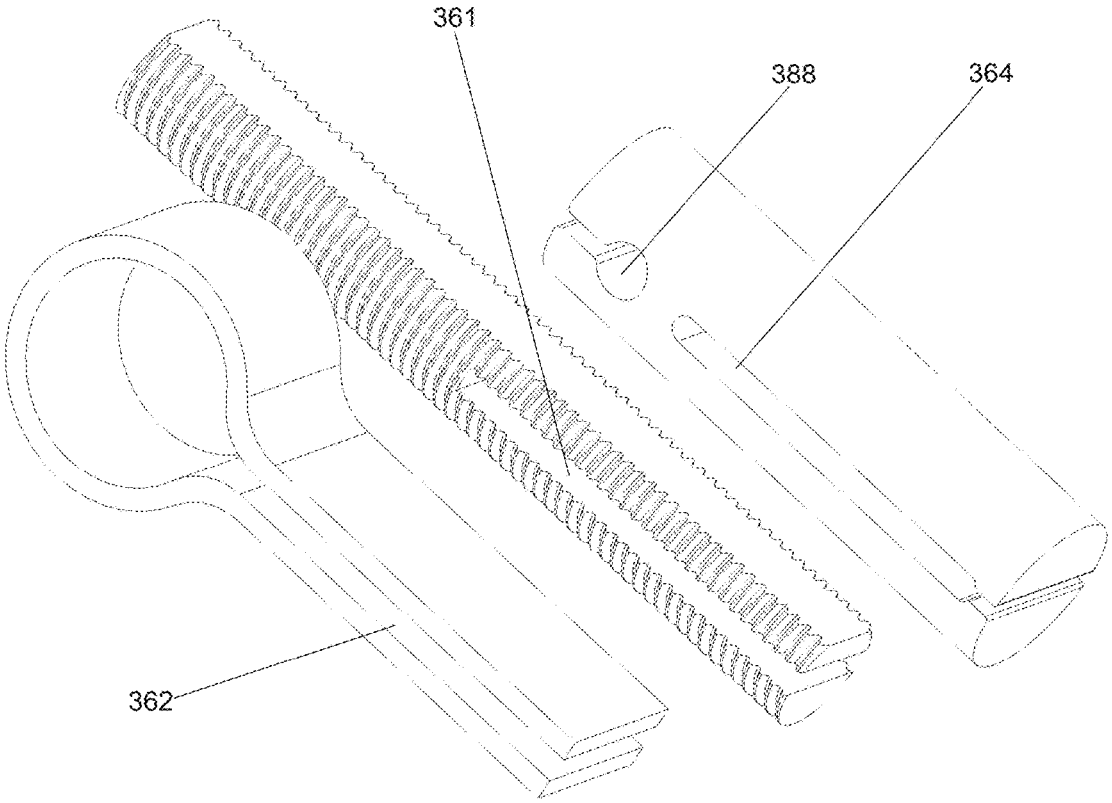

FIG. 26 illustrates a hand-fabricated axial tensile spring assembly 322, used when commercially produced rods of adequate material and quality are not available. The hand-wound spring has several advantages, including greater bonding area at the terminations, full control over fiber selection, resin system, curing conditions, and end reinforcement.

Spring 322 is fabricated by impregnating continuous high-strength fibers with resin and winding them back and forth between end connector plates 323 until the desired amount of fiber is achieved. The process may be carried out with pre-impregnated fibers or with in-process impregnation followed by vacuum treatment to enhance resin penetration and minimize voids. In the as-wound state, the spring exhibits a ribbon-like cross section, though the central portion of the finished spring is typically rounded, as shown elsewhere in the drawings.

Region 324 of the spring is analogous to the butted section of the commercial rod in FIG. 23, where additional fibers are introduced in a tapered manner to gradually transition the cross-section from the thicker end region down to the standard spring diameter. This smooth tapering mitigates stress concentrations at the transition and improves durability under repeated high-load cycles.

Connector plates 323 include fine teeth 325, which help evenly distribute the fibers, align successive wraps, and maintain even tension. In practice, approximately 1 gram of S-glass fiber per foot of spring length, plus resin, has been used successfully. The connector plates 323 may be fabricated from a variety of materials, including steel, aluminum, carbon fiber plate, or titanium, with titanium providing the most reliable long-term bond with composites.

During fabrication, the wet resin in the fiber bundle bonds directly to the mating connector (e.g., 361, 362, or 364) while additional hoop reinforcement—such as fiber winding over the overlap area—may be applied to improve peel resistance. Fine teeth on the long edges of 323 facilitate mechanical interlock of such windings. The resulting joint combines adhesive bonding, mechanical interlock via the slot in the connector, and hoop reinforcement to produce a durable, high-load connection.

The lower portion of FIG. 26 shows 3 exemplary connectors that interface with the hand-wound spring:

1. Tensioning bolt 361, analogous to 341 in FIG. 23, provides adjustable preload while preventing torsion in the spring.
2. Loop connector 362, analogous to 342 or 343, enables the spring end to wrap over an axle either with or without rotational freedom depending on the application.
3. Ribbon connector 364, analogous to 344, allows a ribbon joiner such as 377 (FIG. 25) to be attached, with the end seated securely in hole 388.

All connectors include a slot that engages the toothed portion of 323, distributing load and preventing slip. The connectors themselves may be fabricated from steel, aluminum, or other suitable materials, with steel preferred for 361 and 362, and aluminum often used for 364.

FIG. 27 illustrates additional embodiments and final forms of axial tensile spring terminations and spring constructions. These examples demonstrate the versatility of the axial tensile spring concept while highlighting preferred and alternative configurations.

At the upper left, tensioning bolt 361 is shown in its final assembled form, with internally threaded tube 399 engaged over the toothed internal plate 323 embedded in the hand-wound spring. The threaded tube 399 engages the teeth of the plate to resist axial pull-out, while the external threads of 361 remain clear to function as the spring's tensioning adjustment bolt. Additional winding of impregnated fibers around the lower portion of tensioning bolt 361 may optionally be applied for further peel resistance.

Connectors 362 and 363 are loop fittings analogous to 342 and 343 of FIG. 23, providing a choice of rotating and non-rotating axle interfaces, respectively. Ribbon 377 is shown in its operational form, with 364 connectors at both ends, attached to spring segment 370. Although the spring ends are ribbon-like during fabrication, they taper into cylindrical rods along most of their length for compatibility with the bow's internal riser channels and to minimize surface area.

At the lower left, commercial rod 331 is shown with a permanent flexible connector. Surrounding the rod is a sheath of unimpregnated polymer fibers 391, secured at the overlap region with impregnated fibers 392. This approach functions as an integrated ribbon joiner, though it is non-removable and permanently combines the spring segments, with some trade-offs in creep and long-term reliability.

At the lower right, an all-polymer spring construction is illustrated. Roller 395 is mounted on axle 394, and the spring fibers 396 loop over the roller. The unimpregnated section around the roller remains flexible, while sections 397 to the left are impregnated to form a semi-rigid spring. As in 370, the spring tapers into a cylindrical rod along its length. This all-polymer approach is potentially the simplest and least expensive embodiment, but may not deliver optimal performance or longevity. Importantly, the unimpregnated roller section is not viable for brittle fibers such as glass or carbon, which cannot withstand bending at small radii without fracture. These examples collectively illustrate a range of viable spring constructions and terminations, with various trade-offs in manufacturability, cost, removability, and performance.

The axial tensile spring assembly is a key innovation enabling highly efficient, lightweight energy storage in a compact bow riser. The described embodiments demonstrate multiple viable construction techniques—including commercial rods and hand-wound springs—as well as a variety of attachment and joiner methods. While certain configurations are preferred for their performance, manufacturability, and reliability, the invention is not limited to the illustrated materials, dimensions, or attachment schemes. Any arrangement achieving the stated goals of tensile energy storage, compact packaging, and reliable operation under high loads is within the scope of the present disclosure.

Spring Folding Ider Assembly

The assembly positioned at the opposite end of the bow from the cam assembly performs several essential functions, but is not inherently tied to either end of the straight riser assembly. For clarity and to avoid unnecessary limitations, it will will be shown at the top end of the straight riser assembly and be referred to in this specification as the spring folding idler assembly. This term reflects the 2 principal mechanical roles of the assembly: (1) providing a turning point, or idler, for the bowstring, and (2) implementing the return mechanism that enables the use of elongated axial tensile springs by effectively doubling the working length of the spring through folding and load sharing.

The spring folding idler assembly fulfills 3 major purposes in the disclosed design:

1. It provides an idler wheel over which the bowstring loops before returning toward the cam assembly. This idler is mounted to minimize friction, support heavy loads, and allow reliable, repeatable string operation.
2. The module incorporates an independent string tension adjustment mechanism, enabling precise adjustment of string length relative to the fixed axle-to-axle riser geometry. This is particularly useful for fine-tuning without the need for additional tools or a bow press and allows the archer to compensate for string creep or stretch during service.
3. The module implements a return mechanism for the axial tensile springs. Since currently available high-performance materials (e.g., S-glass composites) exhibit limited elongation, the effective working length of the spring must be doubled to deliver sufficient travel and energy storage. This is accomplished by dividing the spring into 2 legs and joining them at the return module, either with a seesaw-like lever that distributes displacement equally between legs or with a flexible ribbon joiner that loops over a low-friction bearing roller. Both approaches are functionally interchangeable and can be implemented using largely the same hardware. If materials are developed with adequate energy return and elongation to allow a single spring segment, the lever or roller may be omitted, and the axial tension spring ends may be fastened directly to the axle of the idler wheel, or more generally to a secure mount opposite the cam side of the riser.

Secondary but important functions of the spring folding idler assembly include sealing the interior of the hollow riser tubes to resist dirt and moisture ingress and providing a single point of assembly and adjustment that can be accessed at 1 end of the bow. The module is designed to be highly modular and adaptable to various riser cross-sections beyond the obround tubes shown in the preferred embodiment, including rectangular, C-channel, and other common extrusions. Throughout this section, care is taken not to limit the invention to particular bearing types, geometries, or riser shapes. The module described herein is illustrative of the general principles and preferred features that allow the bow to function efficiently with the axial tensile spring and slope-based cam system disclosed.

Figure 28:
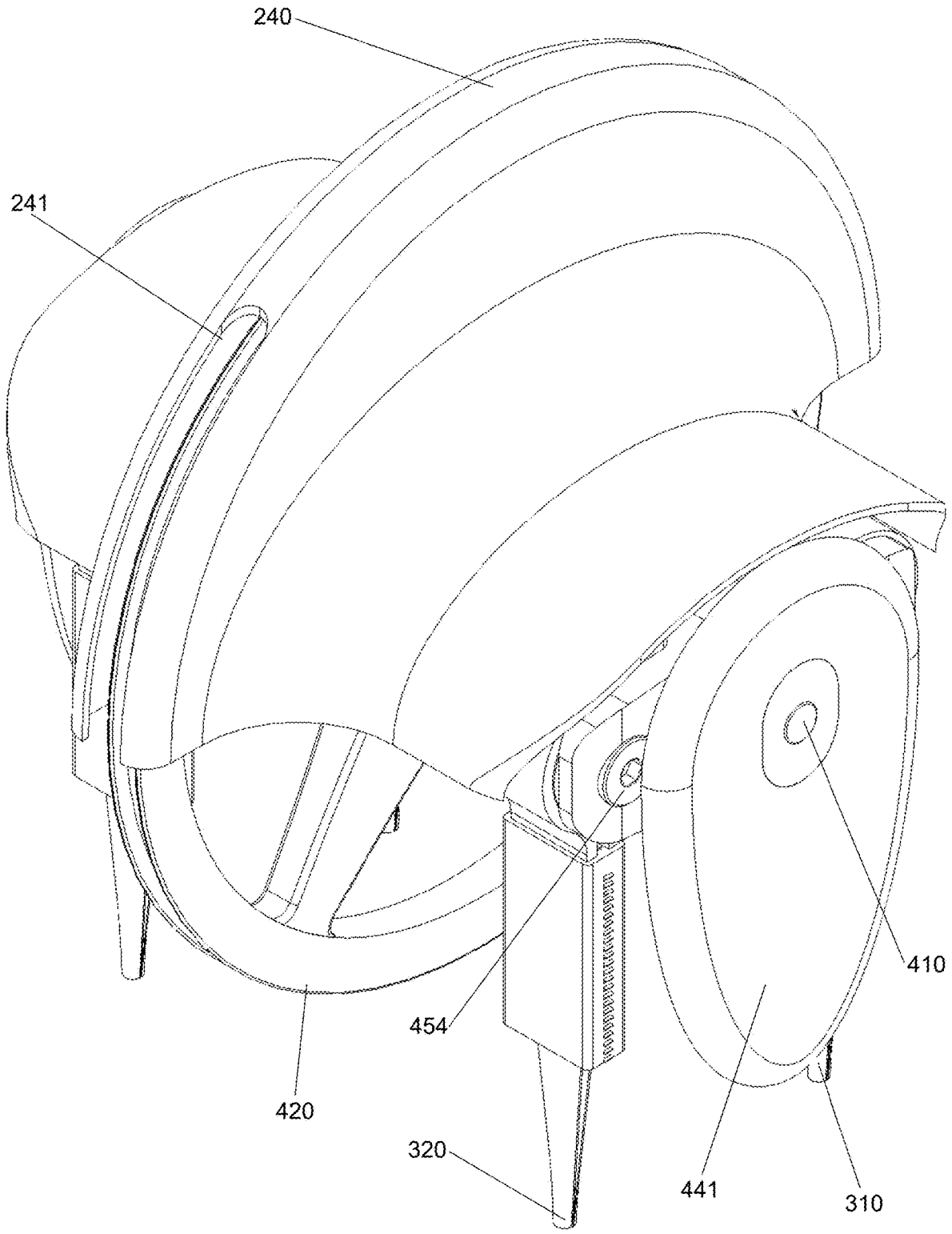
FIG. 28 is an isometric view of the spring folding idler assembly, showing the protective cap, idler wheel, pivot axle, structural reinforcement plate, cam-side and tensioning-side spring segments, and secondary spring axles.

FIG. 28 provides an isometric view of the spring folding idler assembly, illustrating its major components and their relationships.

A removable protective cap 240 encloses and shields the moving elements of the module. The cap 240 is non-structural and primarily serves to protect internal components from dirt, debris, and moisture, as well as to dampen noise and vibration. Because the protective cap 240 is not load-bearing, it may be fabricated from a variety of materials, including lightweight plastics, foams, or composites with desirable damping and silencing properties. The protective cap 240 may be removed or replaced easily for maintenance or adjustment of internal components. A cutout 241 is formed in the cap to accommodate the angle of the bowstring at full draw, where the string forms 2 legs of a near-equilateral triangle.

The bowstring itself passes over an idler wheel 420, which functions as the turning point for the bowstring. The idler wheel 420 is designed to operate with minimal rotational friction and inertia, as any residual kinetic energy left in the idler wheel at arrow launch is wasted energy. Accordingly, the idler wheel 420 may be constructed using lightweight yet stiff materials such as carbon fiber over a structural foam core, with low-friction bearings (not shown here) at its hub. While the illustrated embodiment depicts an idler wheel with a particular number of spokes, the wheel design is not limited to any particular spoke count, pattern, or material.

The spring folding idler assembly also implements the spring return mechanism, which enables each pair of axial tensile springs to share the required elongation between 2 segments. This effectively doubles the working length of the spring compared to a single segment, a necessity given the elongation limits of present-day high-performance spring materials. The return mechanism operates on a simple principle: as the cam assembly draws 1 segment of the spring in a given direction, the return mechanism transmits this displacement into an equal and opposite displacement of the second segment of the spring.

In the illustrated embodiment, there are a total of 4 spring segments-one 310 cam-side and 1 320 tensioning-side on each of the 2 riser tubes.

Figure 30:
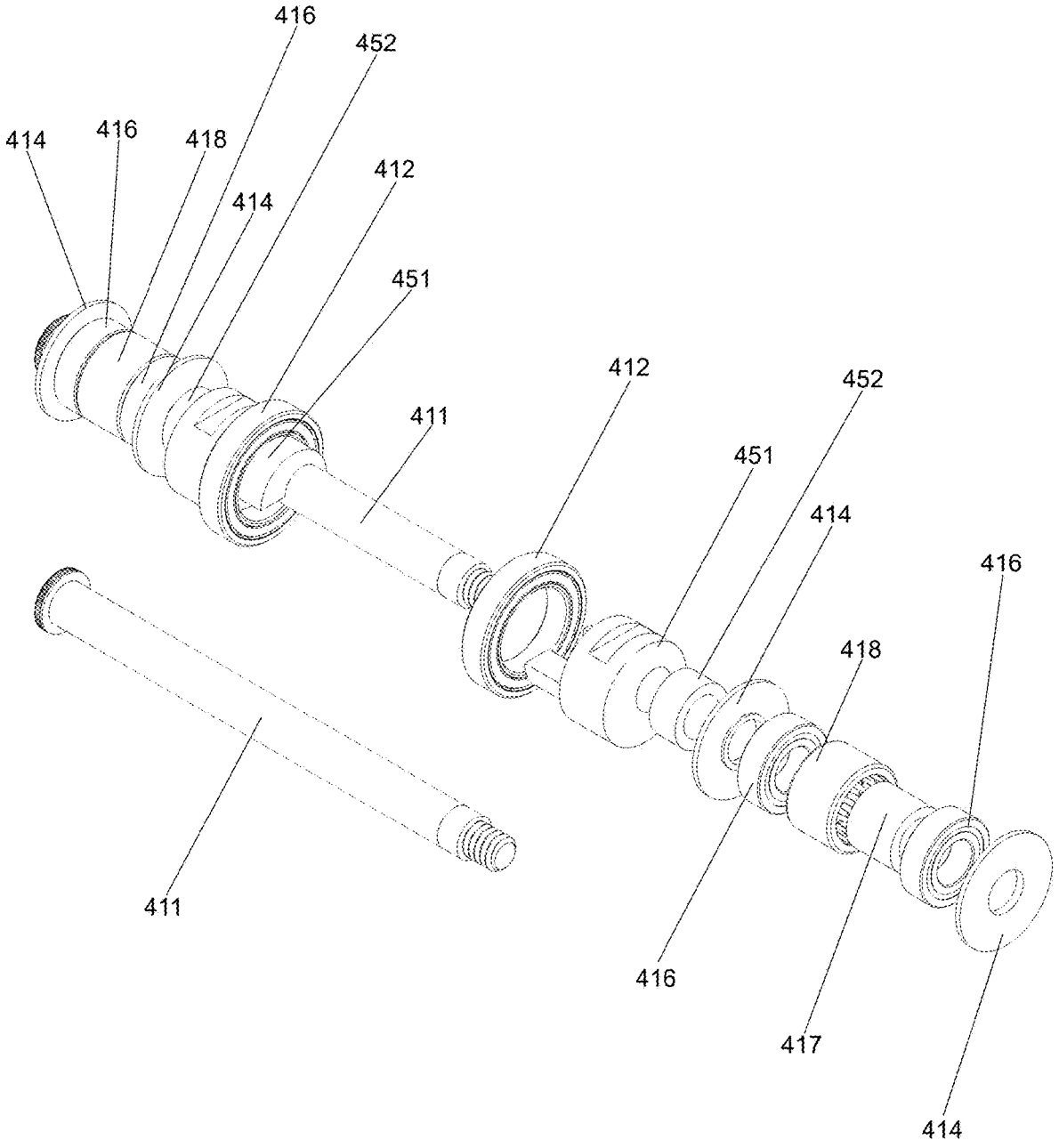
FIG. 30 is a partially exploded isometric view of the return axle assembly, showing the non-rotating axle, eccentric bushings, bearings, ferrules, and washers.
Figure 31:
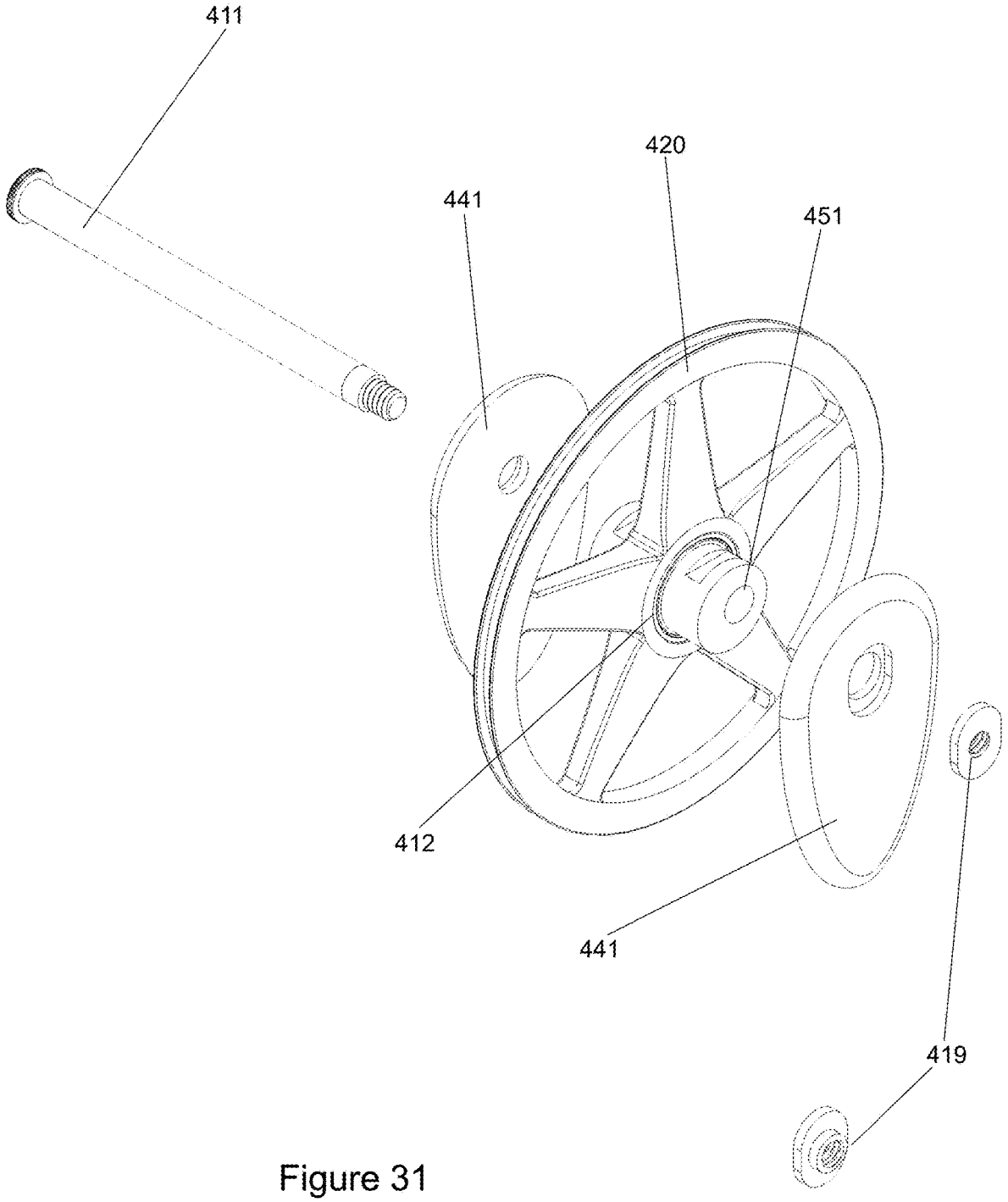
FIG. 31 is an exploded isometric view of the external components of the return axle assembly, showing the shoulder screw, support plates, idler wheel, eccentric bushings, and keyed nut.
Figure 32:
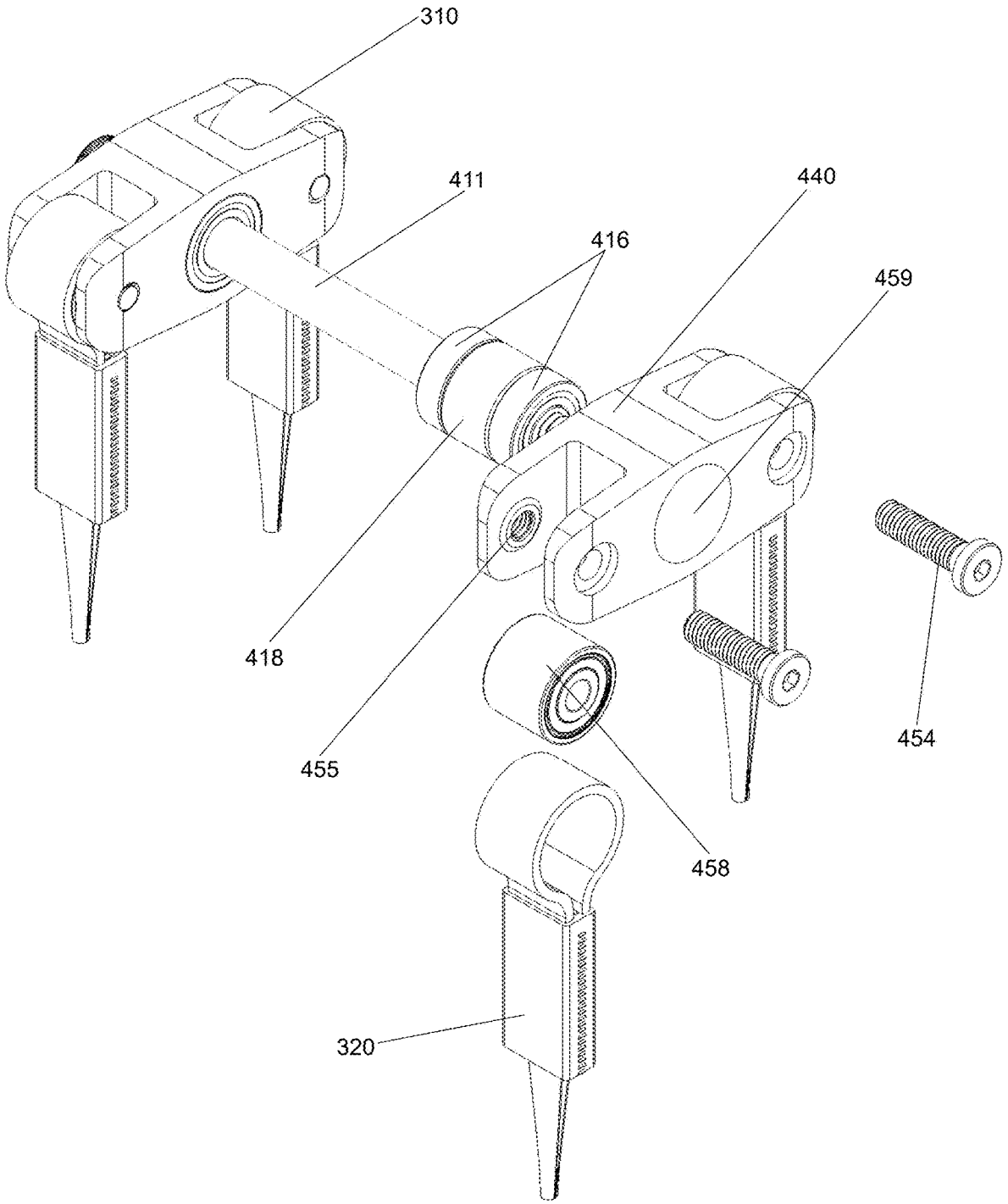
FIG. 32 is a partially exploded isometric view of the spring transfer lever assemblies, showing the internal bearings, spring end connections, and pivoting arrangement about the non-translating axle.

The spring return mechanism is built around a robust lever pivot axle assembly 410, which serves as the fulcrum of a lever (not shown here in full detail; see FIGS. 30-32). This lever (or optionally a ribbon-and-roller mechanism described later) distributes the spring extension between the cam-side and tensioning-side segments. The ends of the spring segments are free to rotate about secondary axles 454, allowing the spring rods to remain aligned under tension without imposing bending moments or lateral deflections. In the illustrated embodiment, 3 of the 4 secondary axles 454 are concealed.

Finally, the riser tube itself is reinforced at the pivot point by a structural plate 441, which distributes the heavy spring loads imparted through the lever pivot axle assembly 410 to the riser walls and prevents localized deformation.

Figure 29:
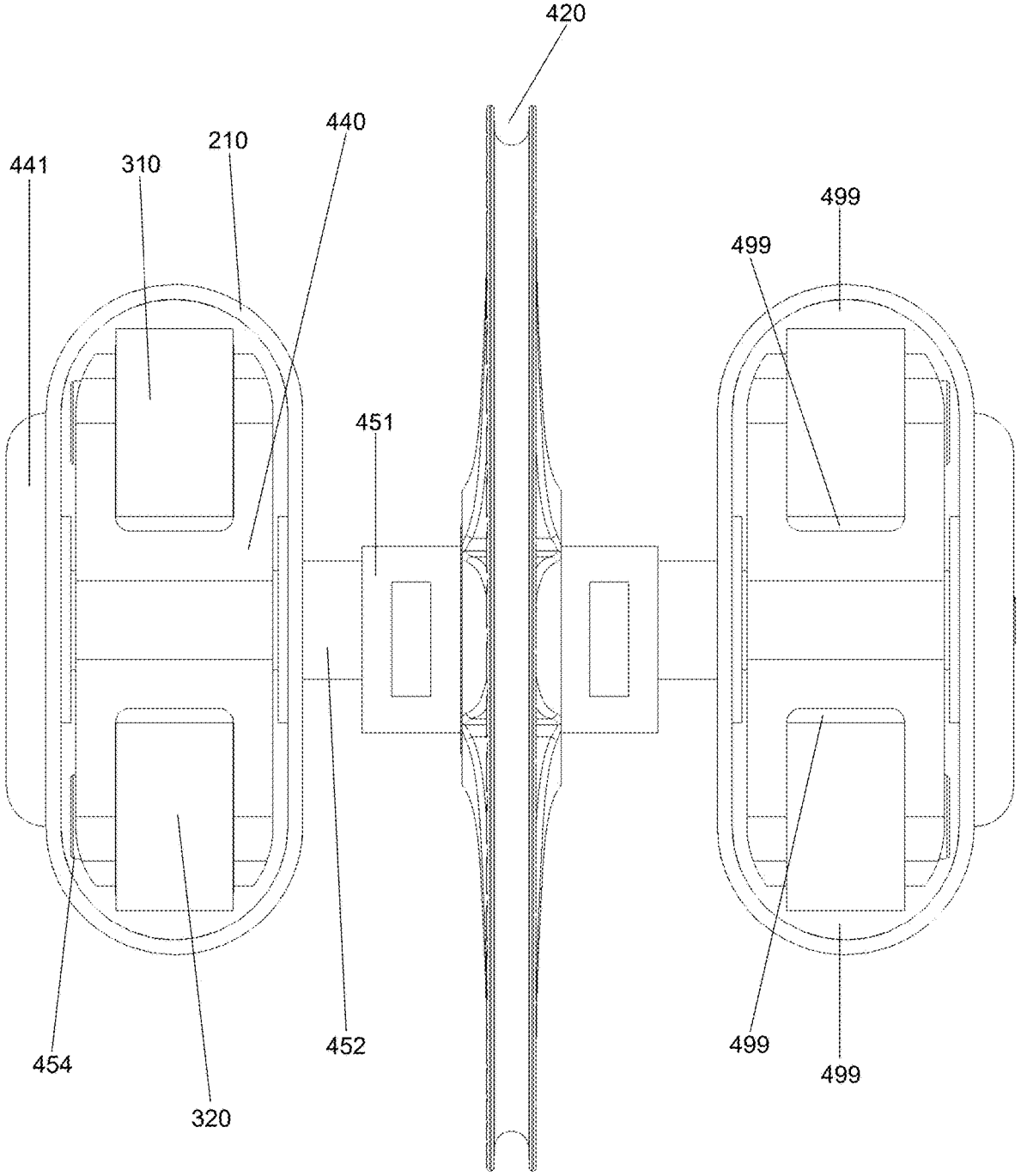
FIG. 29 is a top-down view of the spring folding idler assembly with the protective cover removed, showing the spring transfer lever, idler wheel, spring terminations, eccentric spacers, and associated components mounted to the straight riser assembly.

This overview of the spring folding idler assembly illustrates its key functions and establishes the terminology used throughout this section. The following figures and text detail the specific embodiments of the spring return mechanism, including the lever-based and ribbon-based implementations, and the associated adjustments to accommodate string and spring elongation. FIG. 29 is a top-down view of the spring folding idler assembly, with the protective cap 240 removed to reveal the internal components. The idler wheel 420 is shown at the center of the assembly, with its U-shaped groove clearly visible for receiving and guiding the bowstring (not shown). The riser tube 210 is visible below the assembly as the obround section with inner and outer walls indicated.

On the left side of the figure, the riser-side support plate 441 is shown. The spring transfer lever 440 is located adjacent to the support plate and is configured to rotate about a central axle (not visible in this figure but shown and described in detail in FIG. 30). The spring transfer lever 440 carries the upper ends of 2 axial tensile spring segments: spring segment 310, referred to here as the cam-side spring segment, and spring segment 320, referred to as the tensioning-side spring segment. These spring segments are constructed using the method shown for connector 362 in FIG. 27 and terminate in rotatable joints that are mounted to the spring transfer lever 440 via secondary axles 454. The secondary axles 454 allow the spring ends to rotate freely and remain substantially straight during operation.

On the right side of the figure, the regions of empty space within the assembly are labeled 499 to clearly delineate non-structural voids between the components for clarity of illustration. These voids are bounded by continuous outer edges in the view but contain no solid material. All other space contains solid components.

Also shown in this view are the eccentric spacers 451, which were introduced in FIG. 7. These spacers allow the position of the idler wheel 420 to be slightly adjusted relative to the central axle to fine-tune the tension in the bowstring. A ferrule 452 is also shown at the interface between the riser cross-support and the central axle. This ferrule acts as a structural spacer and bearing surface that enables the central axle to be fully clamped and preloaded (the preferred engineering term when an axle or bolt is tightened into compression across its length without imposing binding forces on the rotating components it supports) without deforming or crushing the riser components or interfering with the bearings of the rotating elements. The breakdown of the central axle and its associated components is shown in detail in FIG. 30.

FIG. 30 is an isometric partially exploded view of the return axle assembly, with the right side shown in exploded form for clarity. The assembly is symmetric about the centerline, except for the axle itself.

The axle 411 is a non-rotating shoulder screw having a low-profile head on 1 end and external threads on the other, allowing it to be tightened securely between the riser tubes. 3 independent components rotate about axle 411: the idler wheel and 2 spring transfer levers (440, as shown previously in FIG. 29). In the preferred embodiment, the idler wheel (not shown here) mounts over the 2 deep groove bearings 412, which are sized to have a relatively large inner diameter compared to their outer diameter in order to ride on eccentric bushings 451 rather than directly on axle 411.

The eccentric bushings 451 are identical parts oriented oppositely to each other so that their outer bearing surfaces form a concentric cylindrical surface for bearings 412, but their through-bores are offset from the bearing centerline. Each bushing 451 is provided with wrench flats to allow rotation when the axle nut is loose, thus permitting fine adjustment of the idler wheel position relative to the riser. This serves as an independent bowstring tensioning mechanism. As with conventional bows of any style, the string may be twisted or untwisted to slightly shorten or lengthen it. The eccentric bushings allow easier adjustment when the bow is under preload tension from the axial tensile springs.

The cross member of the riser near the top (visible in FIGS. 5 and 7) houses ferrules 452. These ferrules transmit compressive forces along the axle, allowing the riser tubes to clamp securely without crushing or distorting the composite material of the riser walls. The ferrules fit between the riser cross member and the distal faces of the eccentric bushings 451.

Within each riser tube are additional bearing packages that allow the spring transfer levers 440 to rotate freely about axle 411 while being supported radially and with limited thrust capability. These consist of inner rings 417 within needle roller bearings 418, flanked by thrust-capable bearings 416. The assembly shown depicts these packages disassembled for clarity, but in the preferred embodiment, they are pre-assembled and fit within the riser tube's internal bore. Washers 414, also referred to as bearing clearance washers, are positioned on the outside of each riser tube, adjacent to the riser wall. Each washer has an integral raised ridge on its inboard face that bears only against the inner ring of the adjacent bearing, preventing interference between the rotating and stationary components of the bearing. These washers serve to distribute clamping forces from axle 411 over a large area of the riser wall while maintaining clearance for the rotating elements.

Although the preferred embodiment shown uses deep groove and needle roller bearings for their high radial load capacity and compactness, other bearing types may also be employed depending on application requirements, such as combined radial/thrust bearings or crossed roller bearings. Similarly, the eccentric bushings 451 and ferrules 452 may be fabricated from aluminum, steel, stainless steel, or other suitable materials for strength and corrosion resistance.

FIG. 31 is an exploded isometric view of the external components of the return axle assembly, illustrating how the axle 411 is tightened in place. The figure focuses on the parts external to the riser tubes and shows how the axle interfaces with the idler wheel and support plates.

The axle 411 is a shoulder screw with a low-profile head, designed to remain stationary in use. The head of the shoulder screw seats into a counterbore in the left-side support plate 441. The axle passes through the left riser tube (and all of the internal bearing and lever components described previously in FIG. 30), through the spring folding idler assembly, and then through the right riser tube before engaging the right-side support plate 441.

The spring folding idler assembly includes the idler wheel 420, which rotates about bearings 412. These bearings are supported on the eccentric bushings 451, as previously described, which allow fine adjustment of the idler wheel position relative to the riser to set bowstring tension. The wheel 420 and bushings 451 are assembled concentrically, with 420 rotating about the central axis of 451. 451 rotates about the fixed axle 411 only when axle 411 is not fully tightened into nut 419.

On the right side, the shoulder screw's threaded portion protrudes beyond the support plate 441 and is secured by a keyed nut 419. The keyed nut 419 has an outer profile that engages a corresponding keyed recess in the right-side support plate 441, preventing the nut from turning when tightening the screw. This feature allows 1 hand to adjust the eccentric bushing position with a wrench while the other hand tightens the shoulder screw with an Allen key, simplifying the string-tensioning procedure.

For clarity, a separate view of the opposite face of keyed nut 419 is shown at the bottom of the figure. The nut has a round portion sufficient to provide the required thread engagement length, while still incorporating a keyed profile to interface securely with the support plate.

In the preferred embodiment, the support plates 441 are bonded to the distal faces of the riser tubes, ensuring alignment and strength. The components shown in this figure allow the return axle assembly to be fully secured and adjusted while keeping all moving components properly supported and clear of interference.

FIG. 32 is an isometric, partially exploded view of the spring transfer lever assemblies. This view omits all riser elements and the spring folding idler assembly, normally centered on the axle 411, to provide a clear depiction of the internal components and their assembly. The left side of the figure shows the assembly in its fully assembled state, while the right side is shown in an exploded configuration to reveal internal details.

At the center of the assembly is the fixed axle 411, which supports the 2 spring transfer levers 440. Each spring transfer lever 440 contains a large central hole 459, which houses the bearing package described previously in FIG. 30. This bearing package, partially visible on the right side of FIG. 32, consists of 2 bearings 416 flanking a needle roller bearing 418, with an inner ring 417 (not visible here) seated inside the 418 bearing. These bearings allow each spring transfer lever 440 to pivot freely about the stationary axle 411 under load, while accommodating high radial forces and some thrust loading.

At each end of each spring transfer lever 440 are provisions for attaching 1 cam-side spring 310 and 1 tensioning-side spring 320. The ends of the springs are fitted with 362-type connectors, as described in FIG. 26, which are designed to ride over axles formed by screws 454. These screws pass through counterbored holes in the transfer lever 440 to keep their heads flush, and thread into tapped holes 455 in the lever body. The screws 454 serve as short axles on which the spring connectors rotate.

Each spring connector includes a bearing or bearing package 458, which allows the spring ends to rotate freely as the transfer lever tilts. The bearings 458 are shown here as compact combined roller/ball radial and thrust bearings, selected for their ability to handle high radial loads and modest thrust loads while fitting within the limited space available. As with other bearings in this system, alternative designs such as separate radial and thrust bearings, plain bearings, or high-load roller designs could also be used.

Although not visible in this view, it is noted that the spring transfer levers 440 and spring ends carry substantial kinetic energy during operation. To reduce inertia while maintaining stiffness and durability, lightweight materials are preferred for these parts. Aluminum has been used effectively, but other advanced materials, such as compression-molded carbon fiber composites, could also be advantageous.

Figure 33:
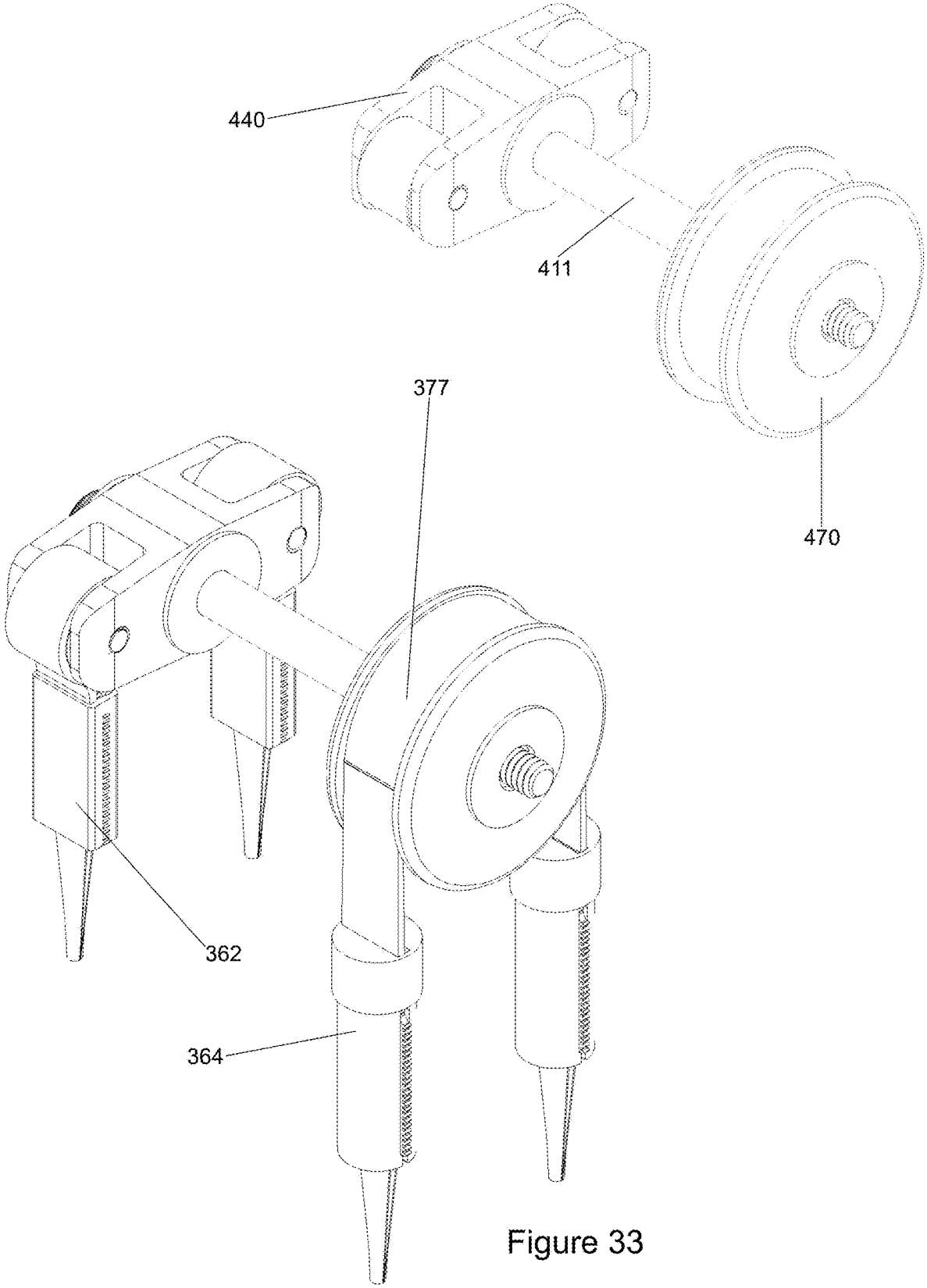
FIG. 33 is an isometric view comparing the spring transfer lever and ribbon roller embodiments of the spring folding mechanism, with the left side showing the lever method and the right side showing the ribbon roller method.

FIG. 33 is an isometric view illustrating 2 alternative embodiments of the spring folding mechanism: the spring transfer lever method and the ribbon roller method. 2 parallel views are shown for comparison: an upper view with the spring ends omitted, and a lower view including the spring ends. In both views, the left side depicts the spring transfer lever method and the right side depicts the ribbon roller method.

In both embodiments, the axle 411 is identical to that described in earlier figures, as are all internal bearing and washer components of the assembly shown previously in FIG. 30. The spring transfer lever method, shown on the left side, utilizes the spring transfer lever 440, which in its assembled form also includes 2 screws 454 and 2 bearings 458 (both referenced in FIG. 32) to allow the ends of the springs to remain straight while the lever pivots.

On the right side, the spring transfer lever is replaced with a ribbon roller 470. This is shown here as a monolithic wheel, but in practice could be constructed with different materials, such as a lightweight structural foam core reinforced with carbon fiber, or hollow aluminum, depending on design priorities. The ribbon roller 470 is designed to rotate about axle 411 and to allow a flexible ribbon to pass over it with minimal friction. The same internal bearing and washer package described earlier supports this rotation.

The lower portion of FIG. 33 shows the same 2 embodiments with the spring ends assembled.

On the left, the spring ends use the 362 style connectors from FIG. 26, which are designed to attach to the spring transfer lever. On the right, the spring ends use the 364 style connectors, which interface with the ribbon 377. The ribbon 377 is draped over the ribbon roller 470 and connects the 2 ends of the folded spring.

It should be noted that these 2 approaches—spring transfer lever and ribbon roller—are intended to be mutually exclusive in any given bow assembly. Although shown together here for purposes of comparison, it is not recommended to use a mixed configuration in which 1 side of the bow uses the lever method and the other side uses the ribbon roller method. The 2 embodiments are otherwise functionally interchangeable within the same riser geometry and axle configuration. These 2 approaches each have distinct advantages and trade-offs. The ribbon roller method reduces the total bearing count and has generally allowed for lighter-weight solutions. However, the ribbon itself has demonstrated faster wear and some creep over time, whereas the spring transfer lever method has shown more repeatable behavior, lower friction, and higher durability, albeit with greater component complexity and weight. The ribbon roller method also facilitates more incremental spring length adjustment during prototyping, while the lever method tends to perform better for consistent production configurations.

Figure 34:
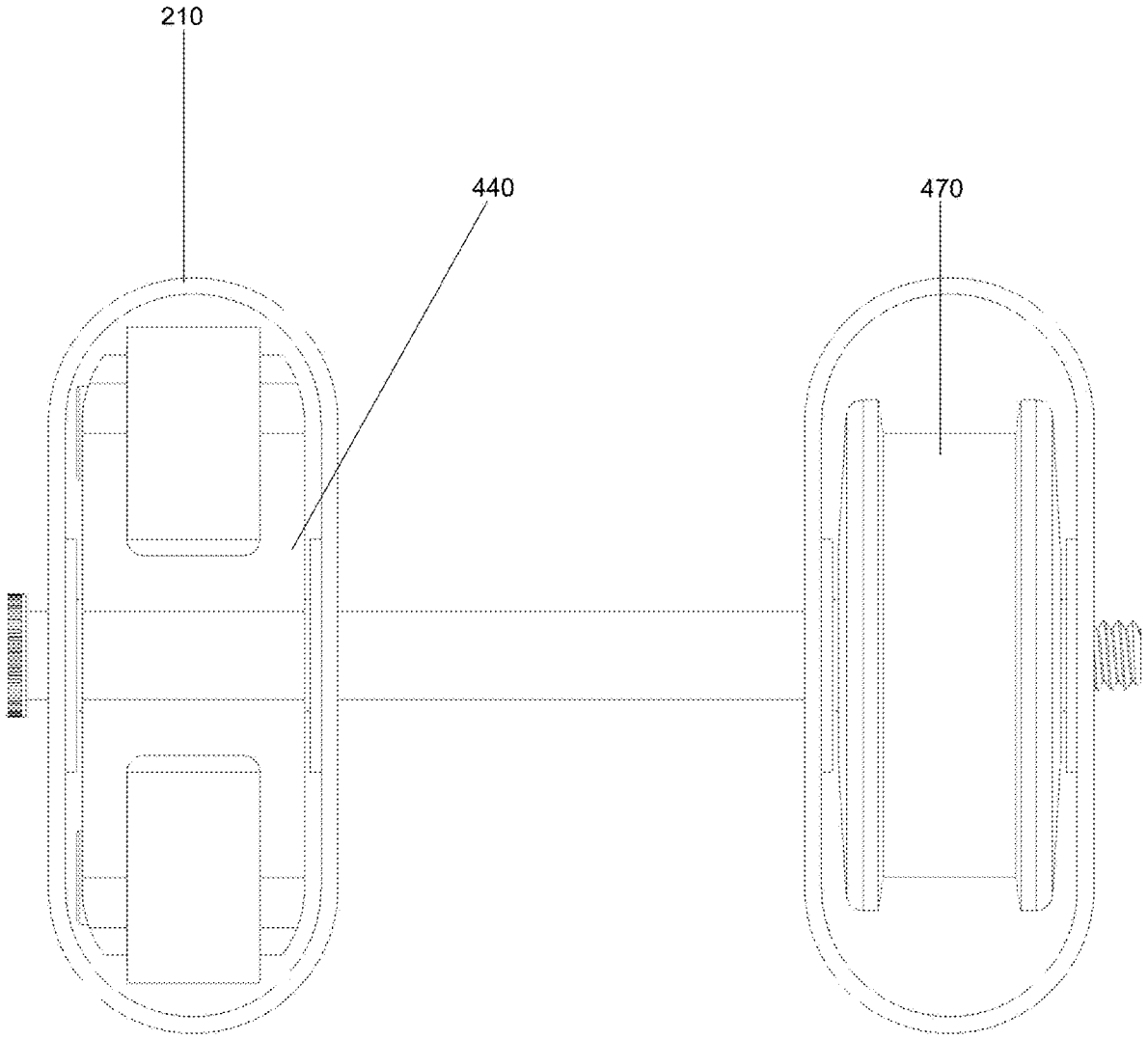
FIG. 34 is a top-down view showing the spring transfer lever and ribbon roller configurations occupying equivalent space within the riser tube.

FIG. 34 is a top-down view, similar in perspective to FIG. 29, showing how the 2 alternative spring folding mechanisms—the spring transfer lever and the ribbon roller—occupy the same space within a riser tube 210. For clarity, the protective cap 240 has been omitted. On the left side of the drawing, the spring transfer lever 440 is shown within the riser tube 210. On the right side, the ribbon roller 470 is shown occupying the corresponding space within an identical riser tube.

This figure demonstrates that both the lever and roller methods are dimensionally compatible with the same riser geometry and axle placement. Both configurations result in nearly identical spacing between the spring ends at the top of the assembly, ensuring that the tops of spring segments 310 and 320 (cam-side and tensioning side, respectively, previously identified in FIG. 6) align properly regardless of which mechanism is selected.

This compatibility allows for the 2 designs to be interchangeable without modification to the riser or the overall spring geometry. This figure also reinforces that it is not intended to mix 1 mechanism on 1 side and the other on the opposite side in a single bow; both sides should use the same folding mechanism for balanced and reliable operation.

Because this is the final figure in which the ribbon roller 470 is shown, it is appropriate to note here that while the ribbon roller embodiment offers advantages such as lower part count and lighter weight, it may be more susceptible to wear and creep of the ribbon 377 compared to the more robust and repeatable spring transfer lever approach. The choice between these 2 configurations may depend on design priorities, including cost, manufacturability, and service life requirements.

Bow Operation

The preceding sections have described in detail the structure, materials, and assembly of the principal components of the bow—including the riser, the cam and non-translating axle assembly, the multi-roller shuttle assembly, the spring folding idler module, and the axial tensile springs—and the various ways these components may be implemented. This section illustrates how those elements interact dynamically through the draw and release cycle of the bow. FIGS. 35-40 depict the sequence of operation as the bowstring is drawn and released. In each figure, the riser and the central portions of the axial tensile springs have been omitted for clarity, so as to focus on the positions and motions of the spring ends, the multi-roller shuttle, and the cam. The figures complement the schematic illustration provided earlier in FIG. 6, but here show greater detail of the mechanical interactions among the components described previously. Because axial tensile springs cannot meaningfully be depicted as stretched within their length in these drawings, their operation is instead shown through the relative displacement of their attachment points: the multi-roller shuttle at the lower end and the spring return lever at the upper end. The position and orientation of the multi-roller shuttle within the cam track throughout the draw sequence clearly demonstrate how the cam shape, slope, and rolling components cooperate to produce a desired draw force curve and maintain spring symmetry.

Figure 35:
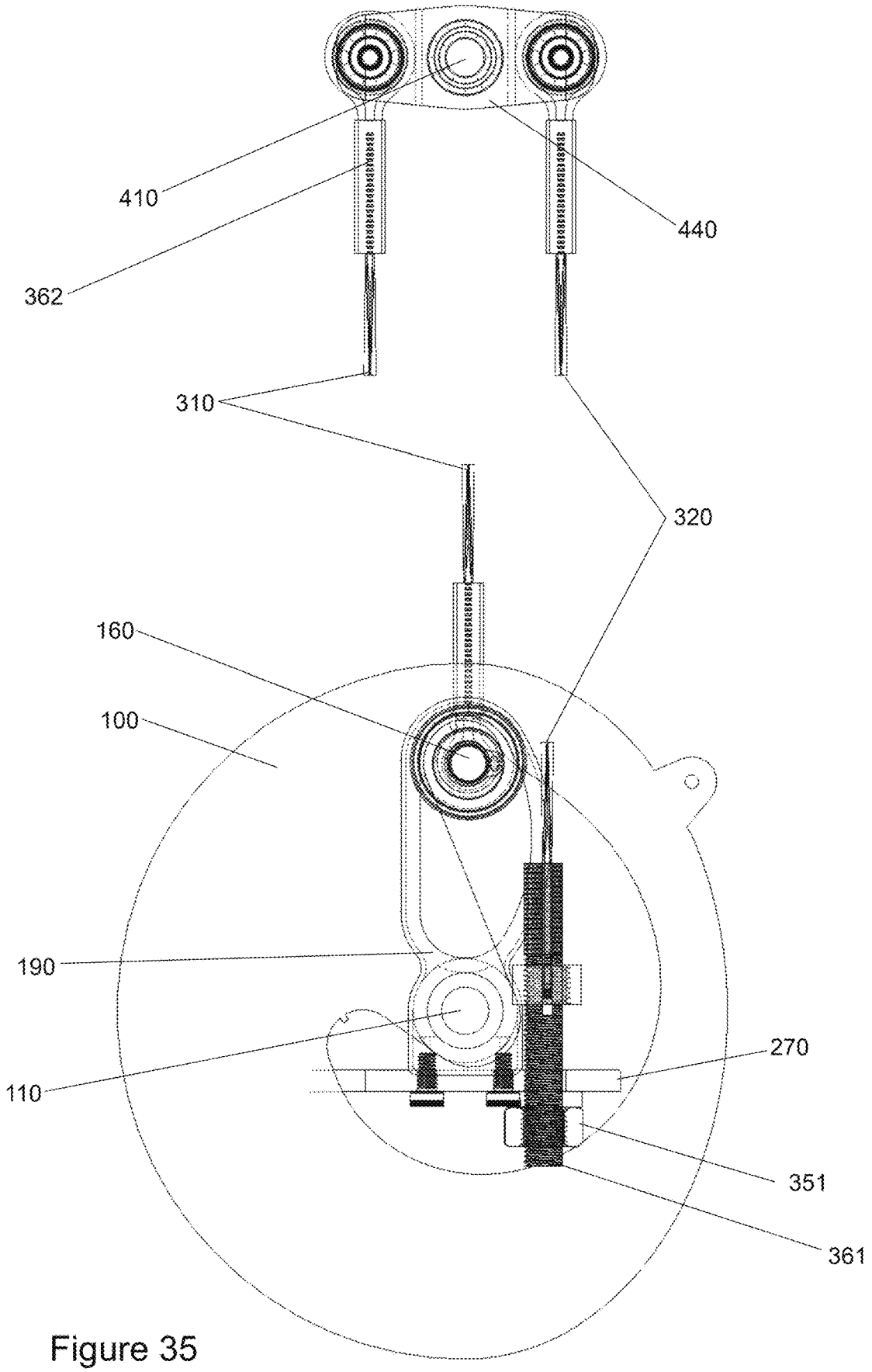
FIG. 35 is a side elevation view of the bow mechanism in the at-rest, un-preloaded state, showing the positions of the major spring ends, cam, multi-roller shuttle, and spring transfer lever assembly. This figure corresponds schematically to the right panel of FIG. 6, but with the idler wheel and bowstring omitted and the central span of the springs removed for clarity.

In the following subsections, each figure will be described in turn, highlighting the progressive changes in cam position, spring extension, and force balance throughout the full operating cycle. FIG. 35 illustrates the assembled bow mechanism in the at-rest condition, prior to any preloading of the springs. The drawing is conceptually equivalent to the right panel of FIG. 6, but presented here in greater detail and with the central span of the springs (approximately 80% of their length) omitted to better highlight the key moving parts. Similarly, the top idler wheel and bowstring are not shown in this figure for clarity.

At the top of the figure, the spring transfer lever 440 is shown in its neutral, level position. The lever pivot axle 410 is fixed relative to the straight riser assembly, while the spring transfer lever 440 pivots about 410 to balance tension between the 2 axial tensile springs. Because 2 versions of the spring transfer mechanism were presented earlier, it is noted here that this figure depicts the lever-based embodiment previously detailed in FIG. 32.

The 2 springs are shown in part: the cam-side axial tensile spring 310 is attached at its upper end to the left arm of spring transfer lever 440 using connector 362 (as previously shown in FIG. 26) and at its lower end to the multi-roller shuttle 160 (the hardened steel multi-roller shuttle design shown earlier in FIG. 17) using an identical connector 362. Spring 320, the tensioning-side spring, is attached at its upper end to the right arm of 440 using connector 362, and at its lower end to the spring tensioning plate 270 by means of tensioning bolt 361 described earlier in FIG. 26. Although the ends of 310 and 320 appear slightly offset in this view, both will form straight, slightly angled narrow columns over the length of the straight riser. The spring tensioning plate 270 is rigidly bolted to the cam guide block 190, which is itself fixed relative to the straight riser assembly and supports the cam.

The cam 100, described in detail in FIG. 15, remains in its neutral, unrotated position, held by the non-translating axle assembly 110 from FIG. 10. The multi-roller shuttle 160 is shown at its highest position (closest to the bow centerline), corresponding to the lowest energy state of the system, with the springs relaxed. The nut 351 on the tensioning bolt 361 is visible in its fully loosened position, as no preload has yet been applied to tensioning-side spring 320.

At this stage of assembly and adjustment, spring transfer lever 440 is horizontal, indicating that both sides of the mechanism are at equal, minimal tension. The multi-roller shuttle has not yet been displaced by cam rotation, and the springs remain effectively unstretched.

Figure 36:
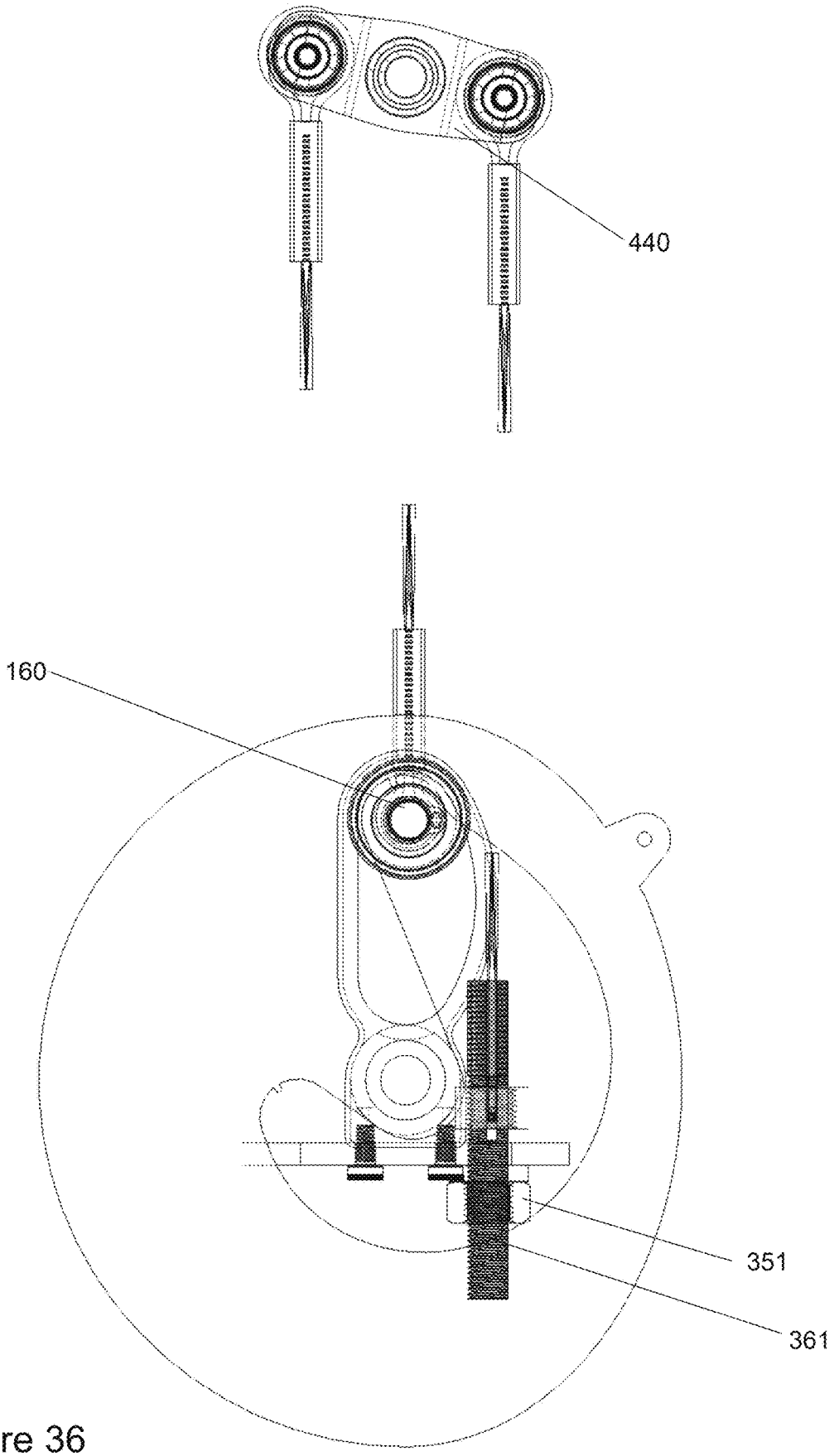
FIG. 36 is a side elevation view of the bow mechanism in the preloaded but undrawn state, showing the effect of tightening the tensioning nut to apply initial preload to the spring system.

FIG. 36 depicts the same mechanism as in FIG. 35, but with the spring system preloaded by tightening the nut 351 on the tensioning bolt 361. This figure corresponds to the bow in the preloaded but undrawn state, with the cam itself remaining in its neutral rotational position. Relative to the at-rest condition of FIG. 35, the nut 351 has been rotated to draw the tensioning bolt 361 downward. Since the lower end of the multi-roller shuttle 160 remains fixed in this frame of reference—already occupying its highest possible position relative to the cam 100—the spring system as a whole must stretch by an amount corresponding to the downward displacement of 361.

The spring transfer lever 440 accommodates this change by pivoting about its lever pivot axle 410 (not labeled in this figure). As a result, the right side of 440 dips downward, while the left side rises upward. This motion distributes the stretch approximately evenly between the 2 legs of the cam-side spring 310, ensuring balanced force in both spring segments.

Figure 37:
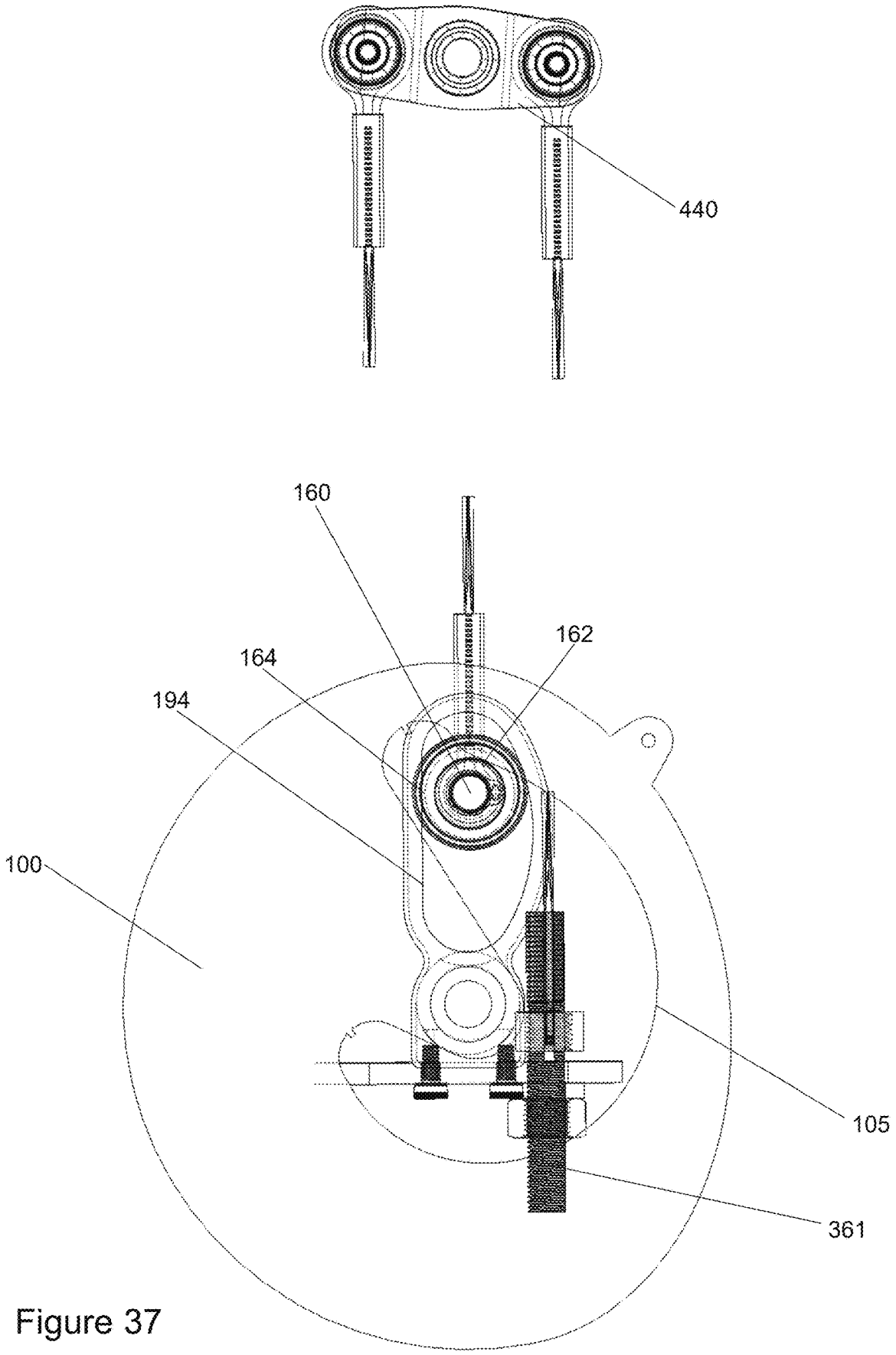
FIG. 37 is a side elevation view of the bow mechanism after initial rotation of the cam, showing the downward motion of the multi-roller shuttle as it rolls between the cam track and guide track surfaces and elongates the axial tensile spring system.

At this stage, the cam remains unrotated and the multi-roller shuttle 160 has not yet descended from its resting position. The mechanism is now properly preloaded, storing a baseline amount of potential energy in the spring system and ensuring proper response when the bowstring is drawn. FIG. 37 depicts the same components as in FIGS. 35-36, now shown after the cam 100 has rotated counterclockwise in response to initial draw of the bowstring (not shown). As noted, the bowstring behaves conventionally—drawing to the right in this frame of reference—and begins to rotate the cam in a familiar compound-bow manner. In this figure, the bowstring has been drawn approximately 20% of its total draw length, but the cam has only rotated about 5% of its total rotation, illustrating the design's early draw force ramp-up, as shown conceptually in FIG. 1, panel III.

At this stage, the multi-roller shuttle 160 has descended significantly from its resting position in FIG. 36, sliding along the inclined surfaces of the cam track 105 (as defined in FIG. 9) and the guide track 194 (as defined in FIG. 19). These 2 surfaces constrain the position of the multi-roller shuttle by contact at the rolling surfaces in different planes: the inner roller 162 bears against 105, and the guide roller 164 bears against 194.

In this embodiment the guide track 194 is straight, but it need not be—alternative embodiments may employ a curved guide track surface, provided that the angle between 105 and 194, together with the known roller diameters, maintains the desired motion path of the multi-roller shuttle 160. This design flexibility allows redistribution of curvature between the cam track and guide track, but the 2 surfaces together uniquely determine the multi-roller shuttle position at any cam rotation.

As 160 moves downward, the axial tensile spring system elongates by the same amount, with the additional length distributed equally between the 2 legs of the spring. To maintain equal tension, the spring transfer lever 440 pivots accordingly, lowering on the left and rising on the right relative to its more tilted position in FIG. 36.

It is emphasized that while non-translating axle 110 and other conventional cam-bearing functions remain present and operational, they are not labeled here, as they perform their ordinary compound bow roles and do not contribute to the novel aspects being illustrated. The focus here is on the unique interaction between the multi-roller shuttle, the cam track and guide track surfaces, and the resulting spring elongation profile. Similarly, tension bolt 361 is now fixed and will not be discussed further in this section.

At this point in the draw cycle, the cam track 105 is still relatively steep, designed to produce a rapid increase in draw force at the beginning of the stroke, maximizing area under the draw-force curve early in the draw.

Figure 38:
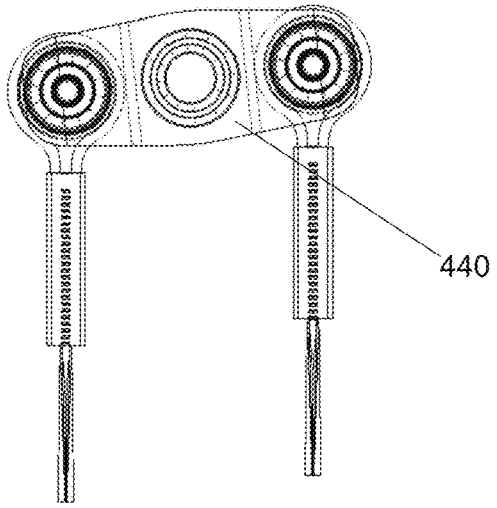
FIG. 38 is a side elevation view of the bow mechanism with the cam rotated approximately 90°, showing the multi-roller shuttle past mid-stroke and illustrating the further elongation of the axial tensile springs and progressive tilting of the spring transfer lever.
Figure 38:
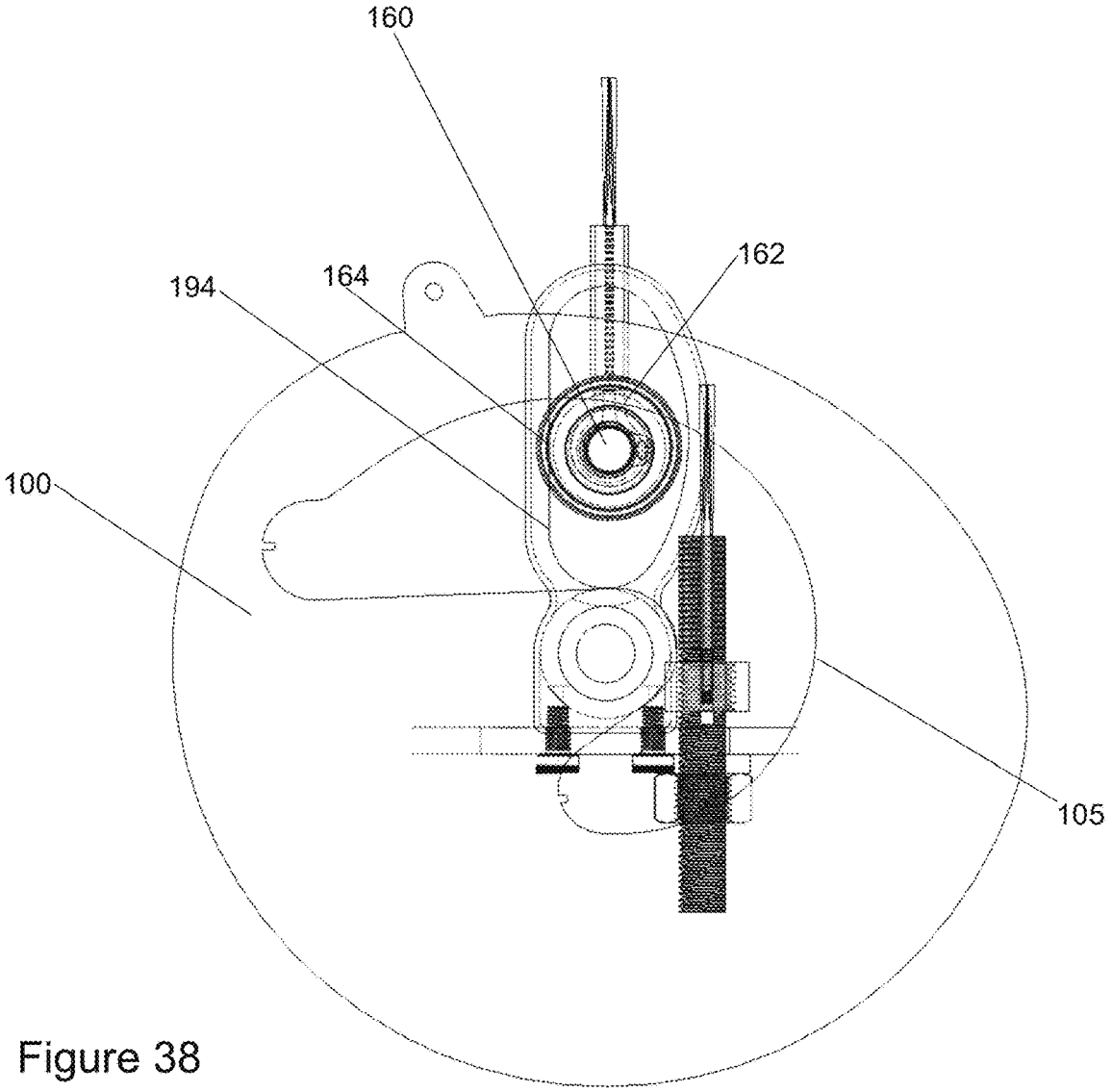

FIG. 38 shows the same system as in FIGS. 35-37, now at approximately the halfway point of the bow's total draw stroke. For clarity, this is intended to correspond to roughly half of the total draw distance beyond brace height, rather than half of the full axle-to-axle distance. (For example, in a bow with a 30" draw length and 6" brace height, this would correspond to about 12" of the 24" of actual string travel beyond brace height.) At this stage, cam 100 has rotated approximately one-quarter turn counterclockwise, and the multi-roller shuttle 160 has descended more than halfway through its available range of motion.

This behavior is expected: since the axial tensile spring system behaves approximately as a preloaded Hookean spring, it requires more than half of its total elongation to store half of its eventual total potential energy. Consequently, 160 has already moved significantly even though cam rotation remains modest at this stage. This relationship supports the design's intent to achieve a sharp force ramp early in the draw while maintaining manageable let-off at full draw. The contact between the inner roller 162 and the cam track 105 has shifted to a region of much gentler slope compared to FIG. 37, consistent with the gradual flattening of the cam profile at higher draw angles. Meanwhile, guide roller 164 continues to roll along the guide track 194, maintaining the constrained, planar path of 160. As previously noted, while 194 is straight in this embodiment, alternative designs may implement a curved guide track surface, provided the geometry maintains the desired roller angle and spacing relative to the cam track surface.

The spring transfer lever 440 has tilted further left as the 2 legs of the axial spring extend equally, with the left end now visibly lower than the right in this frame of reference. This maintains balanced tension across the spring legs, consistent with the operation of the transfer lever detailed in FIG. 32.

At this stage of the draw, the slope of cam track 105 is relatively mild, reflecting the design's goal of achieving flat energy input over the draw cycle. Since the axial tensile springs have now extended significantly, and since the draw angle now gives more cam rotation per unit of draw, a gentler angle is required on cam track 105.

Figure 39:
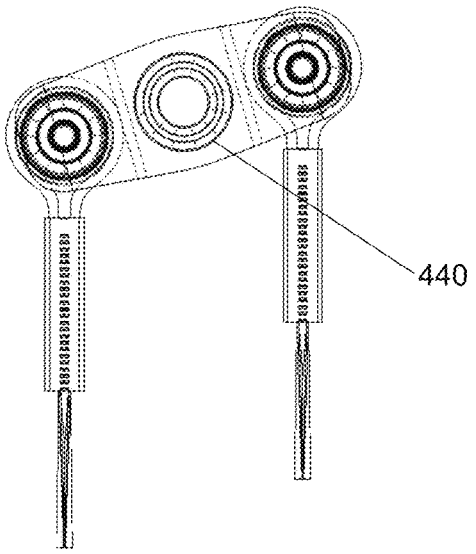
FIG. 39 is a side elevation view of the bow mechanism at full draw, showing the multi-roller shuttle at its lowest position, maximum spring extension, and the cam rotated nearly to its fine adjustment tab.
Figure 39:
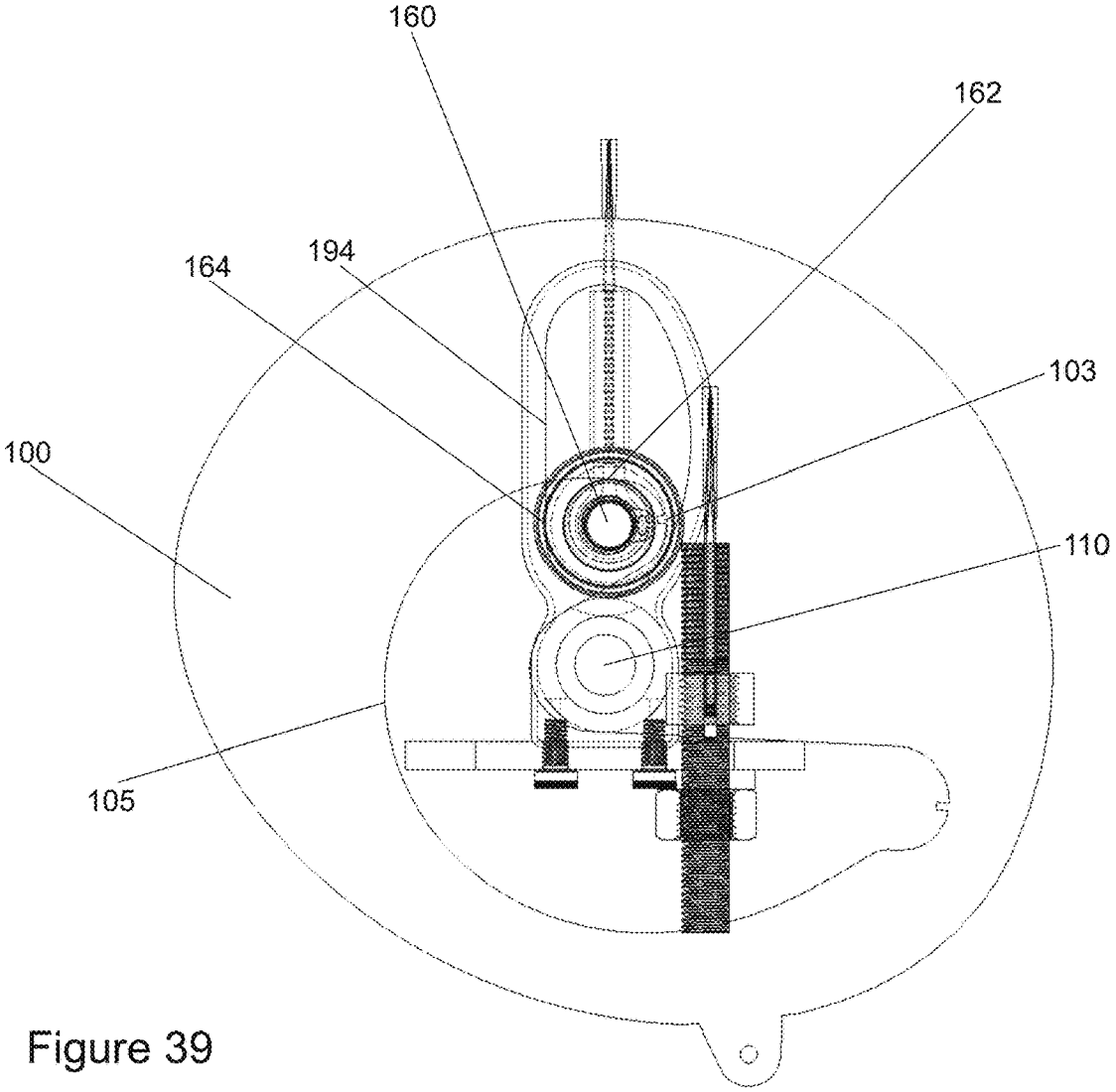

FIG. 39 shows the bow system fully drawn. Multi-roller shuttle 160 has now descended to its lowest position, corresponding to the maximum extension of the axial tensile spring. The total downward movement of 160, from its highest position in FIG. 35, equals the total elongation distributed equally between the 2 legs of the spring. This is reflected in the spring transfer lever 440, which has now reached its maximum tilt, with the left end as low as it can travel and the right end as high as it can travel in this configuration.

Guide roller 164 has moved almost to the end of guide track 194, which has maintained the constrained path of the multi-roller shuttle throughout the draw. Meanwhile, inner roller 162 has nearly completed its travel along the cam track surface 105, approaching the region marked fine adjustment tab 103 in FIG. 9, which serves as the mechanical draw stop in this embodiment. As noted earlier, 103 may be carefully filed or otherwise adjusted to allow slightly more travel of 162, permitting minor tuning of the effective maximum draw length.

Figure 40:
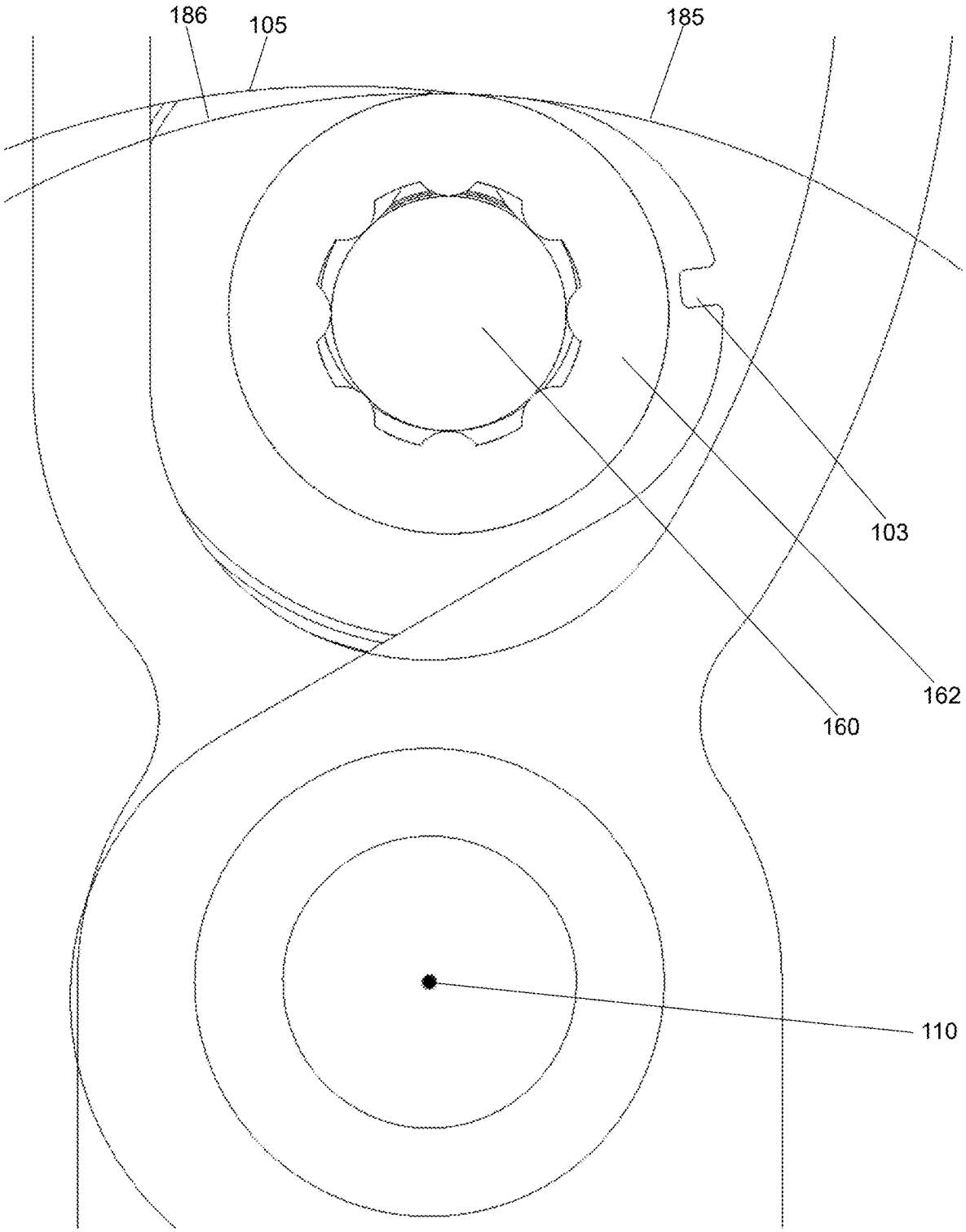
FIG. 40 is an enlarged view of the cam center at full draw, highlighting the slope transition in the cam track responsible for let-off and illustrating the fine-tuning feature of the fine adjustment tab.

At this position, the cam has entered its let-off region, as will be clarified in FIG. 40. The geometry of the cam track 105 beyond this point is designed to substantially reduce the slope, thereby reducing holding force at full draw.

This figure also highlights the importance of compact geometry at the center of cam 100: as multi-roller shuttle 160 reaches its lowest position, its associated rollers and hardware come very close to the non-translating axle 110 and its bearings. Maintaining sufficient clearance in this region is essential to avoid mechanical interference at full draw while preserving stiffness and strength near the cam's hub.

While the draw sequence has been described in FIGS. 35-39, the firing sequence (release of the bowstring) reverses the process: the cam rapidly rotates clockwise, 160 moves upward as the springs contract, and the system progresses quickly back through the positions illustrated in FIGS. 39→38→37→36. The details of let-off and its effect on firing dynamics are addressed in FIG. 40.

FIG. 40 is a close-up of the central region of the cam 100, corresponding to the full draw position shown in FIG. 39. The non-translating axle 110 and multi-roller shuttle 160 are shown for reference, giving a sense of scale and context. The cam roller 162 of the multi-roller shuttle is seen at its final position along the cam track 105, having traversed its full designed path during the draw cycle.

At this position, 162 is nearly in contact with fine adjustment tab 103, which functions as a mechanical draw stop. Beyond this point, additional travel of the cam is prevented by the physical interference of 162 with 103.

Figure 2:
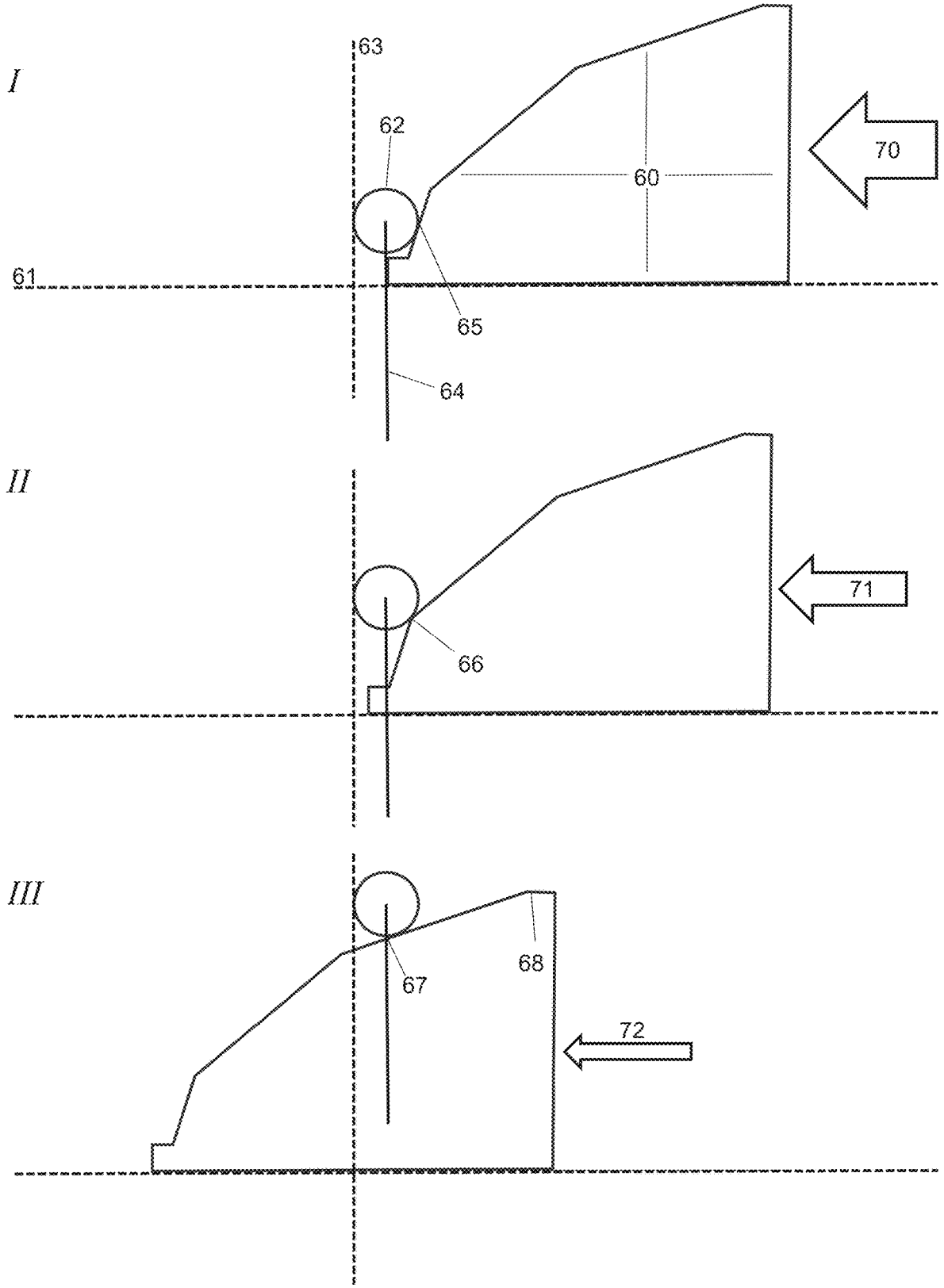
FIG. 2 is a schematic illustration showing how the present invention overcomes these limitations by providing a slope-based cam that more closely follows the desired force curve.
Figure 3:
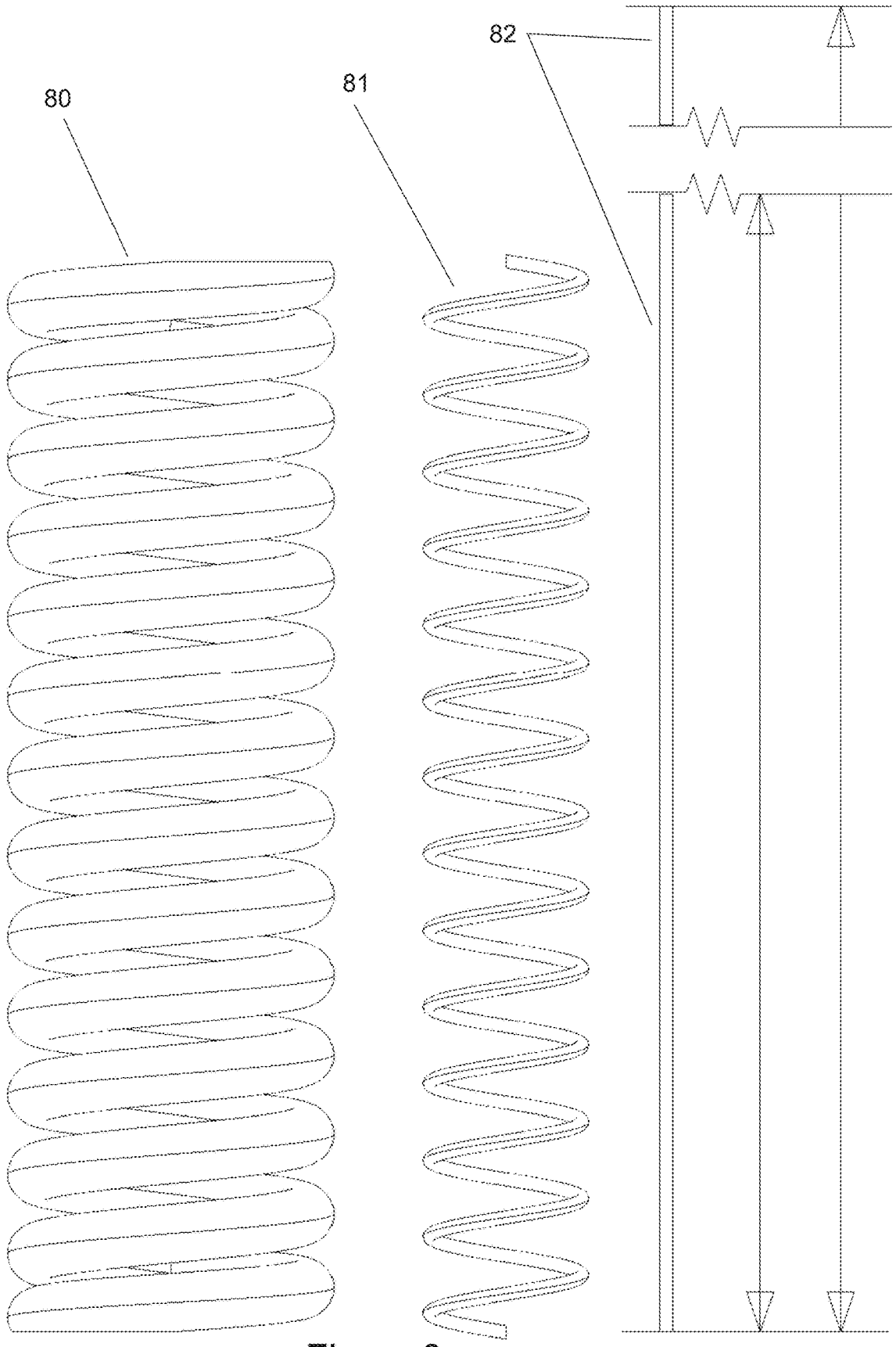
FIG. 3 is a schematic illustration comparing composite axial tensile springs to metal coil springs.

Crucially, the slope of cam track 105 changes abruptly at this position, transitioning to a much gentler slope denoted by curve 185. To illustrate the significance of this transition, an imaginary extension of 185 backwards, labeled 186, is included. This shows how subtle the change in curvature appears geometrically, yet the difference in slope—proportional to force—is dramatic. In this example, a slope reduction from approximately 5% to 1% (an 80% reduction) provides the characteristic let-off felt by the archer at full draw. Such a discontinuity in slope is analogous to point 66 of FIG. 2, panel 2.

The design achieves this let-off transition within a very short segment at the end of the draw-less than an inch in many configurations. The fine-tuning capability of feature 103 allows precise adjustment of the maximum draw length and the effective length of the let-off region, tailoring the "back wall" to the archer's preference. The slope-based cam geometry enables precise control over both the magnitude and sharpness of the let-off, surpassing the tunability of conventional compound cams.

The sequence of FIGS. 35-40 illustrates how the novel slope-based cam system translates cam rotation into controlled elongation of the axial tensile spring, while simultaneously managing load distribution via the multi-roller shuttle and spring transfer lever. The carefully designed slope profiles, combined with mechanical stops and adjustable features, enable precise control of the draw curve, let-off characteristics, and maximum draw length. The return of the system upon string release proceeds in reverse: the spring contracts, the multi-roller shuttle ascends, the cam rotates forward, and energy is delivered through the bowstring to the arrow with minimal hysteresis.

In summary, the components described in this section work synergistically to achieve a mechanically efficient, highly tunable, and repeatable energy storage and release cycle. The slope-based cam with multi-roller shuttle and internal axial spring system represents a significant departure from traditional limb-based compound bows, offering new avenues for performance optimization and customization.

While the invention has been described in detail with reference to specific exemplary embodiments and configurations, these embodiments are presented for purposes of illustration and explanation only, and are not intended to limit the scope of the invention. Various changes, modifications, substitutions, and combinations of the disclosed features, structures, and materials may be made by those of ordinary skill in the art without departing from the spirit and scope of the invention as defined by the appended claims and their legal equivalents.

For example, the use of particular fasteners, washers, retaining rings, or assembly methods in the disclosed embodiments does not preclude alternative fastening techniques, including but not limited to adhesives, press fits, integral features, or other mechanical joining methods. Similarly, the dimensions, materials, finishes, and tolerances shown or described herein are illustrative only; different materials (including composites, metals, alloys, or polymers) and alternative fabrication or surface treatment processes may be substituted in whole or in part.

Features of 1 embodiment may also be combined with, substituted for, or omitted relative to features of other embodiments in ways not expressly shown or described but falling within the scope of the appended claims. The omission of a component in an illustration or example should not be construed as requiring such omission in every embodiment, nor does the presence of a particular element necessarily require its inclusion in every embodiment unless specifically recited in a claim. Singular terms should be understood to include plural referents, and vice versa, unless the context clearly dictates otherwise.

All patents, published applications, and other references cited herein are hereby incorporated by reference in their entirety for all purposes. The Abstract and Summary of the invention are provided in compliance with 37 C.F.R. § 1.72(b) and are not intended to limit the scope of the claims in any way. Accordingly, the invention should be construed in accordance with the following claims, which are intended to cover all modifications, equivalents, and alternative embodiments that fall within their scope.

What is claimed is:

1. An archery bow comprising:

a riser configured to support a bowstring;

a cam module rotatably mounted to a fixed pivot mounted to or supported by the riser, the cam module including:

a cam track defined by an internal or external surface of the cam module and having a slope that varies along its length to produce a desired draw force curve; and at least one string groove on an outer periphery of the cam module configured to engage the bowstring;

a multi-roller shuttle constrained to move along a predetermined path by a guide track surface mounted to or formed in the riser as the cam module rotates, the multi-roller shuttle comprising:

at least one cam roller in rolling contact with the cam track;

at least one guide roller in rolling contact with the guide track surface; and at least one spring attachment feature operatively connected to at least one axial tensile spring;

wherein rotation of the cam module in a draw direction causes the cam track to exert force on the multi-roller shuttle via the cam roller, and the shuttle is constrained by the guide track surface to follow a predetermined path, thereby elongating the at least one axial tensile spring to store energy.

2. The archery bow of claim 1, wherein the at least one axial tensile spring comprises two parallel springs, each folded about a turning element such that each spring presents two tensile legs extending in opposite directions.

3. The archery bow of claim 1, wherein the at least one axial tensile spring is folded about a turning element to present at least two tensile legs extending in opposite directions.

4. The archery bow of claim 3, wherein the turning element is shared with an idler wheel that engages the bowstring.

5. The archery bow of claim 1, further comprising an externally threaded spring terminator and nut configured to apply a preload force in the at least one axial tensile spring by tightening the nut against a fixed anchor plate.

6. The archery bow of claim 1, wherein the at least one axial tensile spring is disposed symmetrically about a vertical plane of the riser to balance lateral forces.

7. The archery bow of claim 1, wherein the riser is configured to enclose the at least one axial tensile spring within a hollow portion in a folded configuration to conserve space while protecting the spring from external elements.

8. The archery bow of claim 1, wherein the cam module includes two parallel string grooves configured to simultaneously engage two portions of the bowstring, the grooves being substantially identical or selectively varied to tune vertical nocking point behavior.

9. The archery bow of claim 1, wherein the cam track is shaped such that its slope varies along its length to produce a draw force curve that rises steeply during an initial portion of draw, remains substantially flat over a central portion, and includes a region of reduced slope near full draw to produce a let-off effect.

10. The archery bow of claim 1, wherein the cam track surface is fully enclosed within the cam module.

11. The archery bow of claim 1, wherein the multi-roller shuttle comprises a dual-track roller assembly, including a cam roller engaging the cam track and a pair of flanking guide rollers engaging the guide track surface mounted to or formed in the riser.

12. The archery bow of claim 1, further comprising at least one stop feature configured to limit the movement of the multi-roller shuttle along the cam track surface, thereby defining at least one of a brace height position and a full draw position.

13. The archery bow of claim 1, wherein the cam module includes replaceable string groove inserts configured for tuning and maintenance.

14. The archery bow of claim 1, wherein the cam module comprises a steel core defining the cam track, reinforced with composite plates and wound fiber layers.

15. The archery bow of claim 11, wherein the multi-roller shuttle includes thrust bearing elements configured to allow relative rotation between any two adjacent components selected from the cam roller, guide roller, and spring attachment feature.

16. The archery bow of claim 1, wherein the multi-roller shuttle includes a carbon fiber axle and shaft collars configured to maintain axial preload without damaging the axle.

17. The archery bow of claim 1, wherein the multi-roller shuttle includes at least one roller configured to engage the cam track from below the fixed pivot of the cam module.

18. The archery bow of claim 1, wherein the riser comprises at least two parallel tubes connected by cross-members.

19. The archery bow of claim 1, wherein the at least one axial tensile spring comprises a composite fiber material selected for high tensile strength and elongation prior to failure.

20. The archery bow of claim 1, wherein the riser includes a non-structural removable grip disposed between two parallel tubes.

* * * * *